US007892718B2

(12) United States Patent
Iwamoto et al.

(10) Patent No.: US 7,892,718 B2
(45) Date of Patent: Feb. 22, 2011

(54) IMAGE FORMING APPARATUS, IMAGE FORMING METHOD AND PROCESS CARTRIDGE

(75) Inventors: Yasuaki Iwamoto, Numazu (JP); Yohichiroh Watanabe, Fuji (JP); Yasutada Shitara, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 874 days.

(21) Appl. No.: 11/738,149

(22) Filed: Apr. 20, 2007

(65) Prior Publication Data

US 2007/0248380 A1 Oct. 25, 2007

(30) Foreign Application Priority Data

Apr. 21, 2006 (JP) ..... 2006-118026
Apr. 21, 2006 (JP) ..... 2006-118087
Apr. 21, 2006 (JP) ..... 2006-118103

(51) Int. Cl.
*G03G 9/087* (2006.01)

(52) U.S. Cl. ..... 430/124.1; 430/109.4

(58) Field of Classification Search ..... 430/124.1, 430/109.4

See application file for complete search history.

(56) References Cited

U.S. PATENT DOCUMENTS 4,507,376 A * 3/1985 Makita et al. ..... 430/109.2
4,508,806 A * 4/1985 Oseto et al. ..... 430/109.2
4,863,825 A 9/1989 Yoshimoto et al.
7,166,403 B2 1/2007 Ichikawa et al.
7,198,874 B2 4/2007 Saito et al.
2005/0079433 A1 4/2005 Watanabe et al.
2005/0089786 A1 4/2005 Sugiura et al.
2005/0089787 A1 4/2005 Uchinokura et al.
2005/0152722 A1 * 7/2005 Tawada et al. ..... 399/346
2005/0277046 A1 12/2005 Sawada et al.
2006/0068312 A1 3/2006 Yamashita et al.

(Continued)

FOREIGN PATENT DOCUMENTS

DE 37 38 024 A1 5/1988

(Continued)

OTHER PUBLICATIONS

U.S. Appl. No. 12/297,952, filed Oct. 21, 2008, Iwamoto, et al.

(Continued)

*Primary Examiner*—Hoa V Le
(74) *Attorney, Agent, or Firm*—Oblon, Spivak, McClelland, Maier & Neustadt, L.L.P.

(57) ABSTRACT

Provided are image forming apparatuses, image forming methods, and process cartridges using a toner that is excellent in low temperature fixing ability, hot offset resistance, and storage stability, and also generate less odor, and thus that can provide high quality images with superior fixing ability, far from tone change with time, and less likely to occur abnormal images such as density-drop and background smear. The image forming apparatuses comprise a latent electrostatic image bearing member, a charging unit, an exposing unit, a developing unit, a transfer unit, and a fixing unit, wherein the toner comprises a binder resin and a colorant, the binder resin comprises a polyester resin prepared by condensation polymerization between an alcohol component that contains an aliphatic polyvalent alcohol and a carboxylic acid component that contains (meth)acrylic acid-modified rosin.

14 Claims, 14 Drawing Sheets

U.S. PATENT DOCUMENTS

| | | | |
|---|---|---|---|
| 2006/0160011 | A1 | 7/2006 | Inoue et al. |
| 2006/0165989 | A1 | 7/2006 | Takikawa et al. |
| 2006/0204883 | A1 | 9/2006 | Nakayama et al. |
| 2006/0240349 | A1 | 10/2006 | Watanabe et al. |
| 2006/0240351 | A1 | 10/2006 | Sigiura et al. |
| 2007/0031748 | A1 | 2/2007 | Kotsugai et al. |
| 2007/0031752 | A1 | 2/2007 | Watanabe et al. |
| 2008/0261131 | A1 | 10/2008 | Nakayama et al. |

FOREIGN PATENT DOCUMENTS

| | | | |
|---|---|---|---|
| EP | 1 701 220 | A2 | 9/2006 |
| JP | 63-313182 | | 12/1988 |
| JP | 1-263679 | | 10/1989 |
| JP | 2-127657 | | 5/1990 |
| JP | 4-70765 | | 3/1992 |
| JP | 4-307557 | | 10/1992 |
| JP | 5-341617 | | 12/1993 |
| JP | 8-22206 | | 1/1996 |
| JP | 10-307419 | | 11/1998 |
| JP | 3194396 | | 6/2001 |
| JP | 3289051 | | 3/2002 |
| JP | 2003-105071 | | 4/2003 |
| JP | 2004-155908 | | 6/2004 |
| JP | 2004-245854 | | 9/2004 |
| JP | 2004-285255 | | 10/2004 |
| JP | 2005-350597 | | 12/2005 |
| WO | WO 2005/031469 | A2 | 4/2005 |

OTHER PUBLICATIONS

U.S. Appl. No. 11/956,378, filed Dec. 14, 2007, Shu, et al.
U.S. Appl. No. 11/943,929, filed Nov. 21, 2007, Nakayama, et al.
U.S. Appl. No. 11/950,114, filed Dec. 4, 2007, Shitara, et al.
U.S. Appl. No. 12/112,601, filed Apr. 30, 2008, Sabu, et al.
U.S. Appl. No. 12/118,006, filed May 9, 2008, Nakayama, et al.
U.S. Appl. No. 11/851,475, filed Sep. 7, 2007, Watanabe, et al.
U.S. Appl. No. 12/253,558, filed Oct. 17, 2008, Nakayama et al.
U.S. Appl. No. 12/142,311, filed Jun. 19, 2008, Nakayama, et al.

* cited by examiner

IMAGE FORMING APPARATUS, IMAGE FORMING METHOD AND PROCESS CARTRIDGE

BACKGROUND OF THE INVENTION

1. Field of the Invention

The present invention relates to image forming apparatuses, image forming methods, and process cartridges, of electrophotographic type, such as copiers, electrostatic printing, printers, facsimiles, and electrostatic recording.

2. Description of the Related Art

Electrophotographic images have been heretofore formed in a wide variety of manners; typically, a surface of a latent electrostatic image bearing member (hereinafter, sometimes referred to as "photoconductor") is charged, then the charged surface of photoconductor is exposed to form an electrostatic latent image. Then the electrostatic latent image is developed by use of a toner, thereby to form a visible image on the photoconductor. The visible image is then is transferred directly or through an intermediate transferring member to a recording medium, then the transferred image is fixed by means of heat and/or pressure, thereby a recorded matter on which images being formed is produced. Residual toner on the photoconductor, after the transferring of images, is cleaned by conventional means such as blades, brushes, and rollers.

Full-color image-forming apparatuses on the basis of such electrophotographic processes are typically classified into two types. One is single or single-drum type, in which one photoconductor and four developing units for four colors of cyan, magenta, yellow and black are mounted in one image forming apparatus. In such single type, a four-color image is formed on a photoconductor or a recording medium. The single type may allow to share a charging, an exposing, a transferring, and a cleaning units, disposed around the photoconductor, thus making possible to downsize and lower the cost compared to tandem type.

Another is tandem or tandem-drum type, in which plural photoconductors are mounted on an image forming apparatus (see Japanese Patent Application Laid-Open (JP-A) No. 05-341617). In general, each one of charging, developing, transferring, and cleaning units are mounted per photoconductor to construct an image forming unit, and plural image forming units, typically four units, are disposed in an image forming apparatus. In the tandem type, visible images are successively transferred on a recording medium through forming one-color visible images by one image forming unit to form full-color images. The tandem type allows high-speed image formation since visible images of respective colors are formed in parallel. That is, the tandem type can shorten the image-processing period by one-fourth compared to the single type, thus leading to four-times high-speed printing. In addition, durability of the units of image forming units like photoconductors may be enhanced indeed. This is due to that four steps of charging, exposing, developing and transferring are carried out to form a full-color image as regards one photoconductor in the single type, whereas only one step of these steps is carried out as regards one photoconductor in the tandem type.

However, the tandem type suffers from larger and expensive systems due to plural image forming units.

For this countermeasure, the diameter of photoconductors is decreased, the respective units around photoconductors are downsized, and the image forming units are small-sized. Consequently, the image forming apparatuses are small-sized and thus material cost is correspondingly reduced, and the total cost can be reduced in a degree. However, the compacted and small-sized image forming apparatuses bring about new requirements for higher performance of the image forming units and significant stabilization thereof.

Recently, image forming apparatuses such as printers, copiers and facsimiles have been commercially demanded for energy conservation and higher speed. In order to achieve these properties, it is essential to improve heat efficiency of fixing units of image forming apparatuses.

In image forming apparatuses, unfixed toner images are typically formed on recording media such as recording sheets, printing paper, photosensitive paper and electrostatic recording paper in an indirect or direct way by image forming processes such as electrophotographic, electrostatic and magnetic recording processes. Contact-heating processes such as heat-roller, film-heating and electromagnetic induction-heating processes are employed generally for fixing the unfixed toner images.

The heat-roller fixing units are typically constructed from a fixing roller, capable of being controlled at a predetermined temperature by use of a heat source such as halogen lump disposed inside thereof, and a pressure roller being urged to press the fixing roller as a pair of rotating rollers. A recording medium is inserted and conveyed between the contacting portion, i.e. so-called nip portion, of the pair of rotating rollers, thereby unfixed toner images are fused and fixed by action of heat and pressure from the pressure roller.

The film-heating-fixing unit is, for example, disclosed in JP-A Nos. 63-313182 and 01-263679. In the film-heating-fixing unit, a heating member, fixed and supported by a support member, is contacted with a recording medium through a heat-resistant thin fixing film, then the fixing film is slid and moved against the heating member, thereby the heat is supplied from the heating member to the recording media through the fixing film.

The heating member is exemplified by a ceramic heater where an electric resistance layer is disposed on a ceramic substrate such as alumina and aluminum nitride having proper heat resistance, insulating property and thermal conductivity. The fixing unit, equipped with such a lower heat-capacity fixing film, may exhibit higher thermal conductivity than the heat-roller fixing units and shorten the warm-up period, and also allow quick-starting and energy-saving.

The fixing unit of the electromagnetic induction-heating processes is exemplified by electromagnetic induction-heating in which Joule heat is generated in a magnetic metal member through an eddy current by action of alternate magnetic filed to cause electromagnetic induction-heating of a heating member (see JP-A No 08-22206).

In the fixing unit of the electromagnetic induction-heating processes, a film with an elastomeric layer is disposed between a heating member and a recording medium in order to heat and melt visible images uniformly in a sufficient enclosing manner of the visible images. When the elastomeric layer is formed of silicone rubber, its lower thermal conductivity degrades thermal response, and thus the thermal difference is remarkably enlarged between the inside face of the film heated by the heating member and the out side of the film contacting with toner. As a result, surface temperature of belts may rapidly drop in cases of much deposited amount of toner, causing possibly so-called cold offset due to insufficient fixing ability.

In addition, the fixing unit of electrophotographic image forming apparatuses is typically demanded for releasing ability of toner with heating members (hereinafter, sometimes referred to as "offset resistance"). The offset resistance may be improved by the presence of release agent at toner surface.

However, unusual toners or reuse of toners may reduce the release agent at the toner surface, possibly deteriorating the offset resistance.

In addition, as the electrophotographic technology has progressed, toner has been demanded for low temperature fixing ability and storage stability or blocking resistance. For example, such toners are proposed as a toner that contains a linear polyester resin with certain properties as molecular weight (see JP-A No. 2004-245854), a toner that contains a non-linear cross-linked polyester resin with rosins as an acid ingredient (JP-A No. 04-70765), and a toner of which the fixing ability is improved by use of rosin modified with maleic acid (JP-A No. 04-307557).

In addition, while high speed and energy saving of image forming apparatuses require toners with superior low temperature fixing ability, the high speed requires the offset resistance that is conflictive property with the low temperature fixing ability. In order to satisfy the both requirements, a toner is proposed in which a rosin monomer is added to a polyester (see JP-A No. 04-70765). A blending process is also proposed in which a lower molecular weight resin and a higher molecular weight resin are blended (JP-A No. 02-127657).

However, the blending process of a lower and a higher molecular weight resins (JP-A No. 02-127657) suffers from insufficient milling ability at the resin production process due to the higher molecular weight ingredient and/or at the production process of milled toner with the binder resin. On the other hand, in the process where only the higher molecular weight resin is used, the offset resistance and storage stability are insufficient, and also the productivity is lower due to resin fusion during milling process by virtue of higher milling property.

When the softening temperature of toner binder resin is lowered so as to enhance the low temperature fixing ability, the toner tends to agglomerate and deteriorate storage stability since the glass transition temperature is inevitably lowered.

While the rosins may effectively improve the lower-temperature fixing ability as described in JP-A Nos. 04-70765 and 04-307557, some types of rosins suffer from odor.

As such, image forming apparatuses, image forming methods and process cartridges are demanded currently that can utilize toners with superior low temperature fixing ability, higher offset resistance, and excellent storage stability and also with less generation of odor, can assure excellent fixing ability and temporal stability, and can provide high quality images for prolonged period.

BRIEF SUMMARY OF THE INVENTION

The present invention aims to solve the problems in the art and to attain the objects below. That is, it is an object of the present invention to provide an image forming apparatus, an image forming method, and a process cartridges using a toner that is excellent in low temperature fixing ability, hot offset resistance, and storage stability, and also generate less odor, and thus that can provide high quality images with superior fixing ability, far from tone change with time, and less likely to occur abnormal images such as density-drop and background smear.

The object may be attained in accordance with the first aspect of the present invention as follows:

<A-1> An image forming apparatus, comprising:

a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner comprises a binder resin and a colorant, the binder resin comprises a polyester resin prepared by condensation polymerization between an alcohol component that contains an aliphatic polyvalent alcohol and a carboxylic acid component that contains (meth)acrylic acid-modified rosin.

<A-2> The image forming apparatus according to <A-1>wherein the charging unit charges the latent electrostatic image bearing member in a contactless manner.

<A-3> The image forming apparatus according to <A-1>wherein the charging unit charges the latent electrostatic image bearing member through contacting therewith.

<A-4> The image forming apparatus according to any one of <A-1> to <A-3>, wherein the developing unit comprises a magnetic field-generating unit disposed therein and a rotatable developer bearing member that bears a two-component developer of a magnetic carrier and a toner thereon.

<A-5> The image forming apparatus according to any one of <A-1> to <A-3>, wherein the developing unit comprises a developer bearing member, to which a toner being supplied, and a layer thickness-control member for forming a toner-thin layer on the surface of the developer bearing member.

<A-6> The image forming apparatus according to any one of <A-1> to <A-5>, wherein the transfer unit transfers a visible image formed on the latent electrostatic image bearing member onto a recording medium.

<A-7> The image forming apparatus according to any one of <A-1> to <A-6>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<A-8> The image forming apparatus according to any one of <A-1> to <A-5>, wherein the transfer unit comprises an intermediate transfer member to which the visible image formed on the latent electrostatic image bearing member is primarily transferred, and a secondary transfer unit that transfers the visible image formed on the intermediate transfer member onto the recording medium.

<A-9> The image forming apparatus according to any one of <A-1> to <A-8>, comprising a cleaning unit, wherein the cleaning unit comprises a cleaning blade that comes into contact with the surface of the latent electrostatic image bearing member.

<A-10> The image forming apparatus according to any one of <A-1> to <A-8>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<A-11> The image forming apparatus according to any one of <A-1> to <A-10>, wherein the fixing unit comprises at least one of a roller and a belt, and the fixing unit is heated from the side other than in contact with the toner, and fixes the image transferred on the recording medium by heat and pressure.

<A-12> The image forming apparatus according to any one of <A-1> to <A-10>, wherein the fixing unit comprises at least one of a roller and a belt, and the fixing unit is heated from the side in contact with the toner, and fixes the image transferred on the recording medium by heat and pressure.

<A-13> The image forming apparatus according to any one of <A-1> to <A-12>, wherein the aliphatic polyvalent alcohol comprises one having a carbon number of 2 to 6.

<A-14> The image forming apparatus according to any one of <A-1> to <A-13>, wherein the content of the (meth) acrylic acid-modified rosin is 5% by mass to 85% by mass in the carboxylic acid component.

<A-15> The image forming apparatus according to any one of <A-1> to <A-14>, wherein the (meth)acrylic acid-modified rosin is prepared by modifying a purified rosin with (meth)acrylic acid.

<A-16> The image forming apparatus according to any one of <A-1> to <A-15>, wherein the alcohol component comprises an alcohol of trivalent or more, and/or the carboxylic acid component comprises a carboxylic acid of trivalent or more.

<A-17> The image forming apparatus according to any one of <A-1> to <A-16>, wherein the content of low molecular weight components having a molecular weight of 500 or less is 12% by mass or less in the polyester resin.

<A-18> The image forming apparatus according to any one of <A-1> to <A-17>, wherein the condensation polymerization is carried out in the presence of a titanium compound and/or a tin (II) compound having no Sn—C bond.

<A-19> An image forming method, comprising:

charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner comprises a binder resin and a colorant, the binder resin comprises a polyester resin prepared by condensation polymerization between an alcohol component that contains an aliphatic polyvalent alcohol and a carboxylic acid component that contains (meth)acrylic acid-modified rosin.

<A-20> The image forming method according to <A-19>, wherein the charging unit charges the latent electrostatic image bearing member in a contactless manner.

<A-21> The image forming method according to <A-19>, wherein the charging unit charges the latent electrostatic image bearing member through contacting therewith.

<A-22> The image forming method according to any one of <A-19> to <A-21>, wherein the developing unit comprises a magnetic field-generating unit disposed therein and a rotatable developer bearing member that bears a two-component developer of a magnetic carrier and a toner thereon.

<A-23> The image forming method according to any one of <A-19> to <A-21>, wherein the developing unit comprises a developer bearing member, to which a toner being supplied, and a layer thickness-control member for forming a toner-thin layer on the surface of the developer bearing member.

<A-24> The image forming method according to any one of <A-19> to <A-23>, wherein the transfer unit transfers a visible image formed on the latent electrostatic image bearing member onto a recording medium.

<A-25> The image forming method according to any one of <A-19> to <A-24>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<A-26> The image forming method according to any one of <A-19> to <A-23>, wherein the transfer unit comprises an intermediate transfer member to which the visible image formed on the latent electrostatic image bearing member is primarily transferred, and a secondary transfer unit that transfers the visible image formed on the intermediate transfer member onto the recording medium.

<A-27> The image forming method according to any one of <A-19> to <A-26>, comprising a cleaning unit, wherein the cleaning unit comprises a cleaning blade that comes into contact with the surface of the latent electrostatic image bearing member.

<A-28> The image forming method according to any one of <A-19> to <A-27>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<A-29> The image forming method according to any one of <A-19> to <A-28>, wherein the fixing unit comprises at least one of a roller and a belt, and the fixing unit is heated from the side other than in contact with the toner, and fixes the image transferred on the recording medium by heat and pressure.

<A-30> The image forming method according to any one of <A-19> to <A-28>, wherein the fixing unit comprises at least one of a roller and a belt, and the fixing unit is heated from the side in contact with the toner, and fixes the image transferred on the recording medium by heat and pressure.

<A-31> The image forming method according to any one of <A-19> to <A-30>, wherein the aliphatic polyvalent alcohol comprises one having a carbon number of 2 to 6.

<A-32> The image forming method according to any one of <A-19> to <A-31>, wherein the content of the (meth) acrylic acid-modified rosin is 5% by mass to 85% by mass in the carboxylic acid component.

<A-33> The image forming method according to any one of <A-19> to <A-32>, wherein the (meth)acrylic acid-modified rosin is prepared by modifying a purified rosin with (meth)acrylic acid.

<A-34> The image forming method according to any one of <A-19> to <A-33>, wherein the alcohol component comprises an alcohol of trivalent or more, and/or the carboxylic acid component comprises a carboxylic acid of trivalent or more.

<A-35> The image forming method according to any one of <A-19> to <A-34>, wherein the content of low molecular weight components having a molecular weight of 500 or less is 12% by mass or less in the polyester resin.

<A-36> The image forming method according to any one of <A-19> to <A-35>, wherein the condensation polymerization is carried out in the presence of a titanium compound and/or a tin (II) compound having no Sn—C bond.

<A-37> A process cartridge, comprising a latent electrostatic image bearing member and a developing unit configured to develop the latent electrostatic image formed on the latent electrostatic image bearing member using a toner to form a visible image, wherein the process cartridge is detachably mounted to an image forming apparatus, and the toner comprises a binder resin and a colorant, the binder resin comprises a polyester resin prepared by condensation polymerization between an alcohol component that contains an aliphatic polyvalent alcohol and a carboxylic acid component that contains (meth)acrylic acid-modified rosin.

<A-38> The process cartridge according to <A-37>, wherein the aliphatic polyvalent alcohol comprises one having a carbon number of 2 to 6.

<A-39> The process cartridge according to <A-37> or <A-38>, wherein the content of the (meth)acrylic acid-modified rosin is 5% by mass to 85% by mass in the carboxylic acid component.

<A-40> The process cartridge according to any one of <A-37> to <A-39>, wherein the (meth)acrylic acid-modified rosin is prepared by modifying a purified rosin with (meth) acrylic acid.

<A-41> The process cartridge according to any one of <A-37> to <A-40>, wherein the alcohol component comprises an alcohol of trivalent or more, and/or the carboxylic acid component comprises a carboxylic acid of trivalent or more.

<A-42> The process cartridge according to any one of <A-37> to <A-41>, wherein the content of low molecular weight components having a molecular weight of 500 or less is 12% by mass or less in the polyester resin.

<A-43> The process cartridge according to any one of <A-37> to <A-42>, wherein the condensation polymerization is carried out in the presence of a titanium compound and/or a tin (II) compound having no Sn—C bond.

The object may also be attained in accordance with the second aspect of the present invention as follows:

<B-1> An image forming apparatus, comprising:

a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner comprises a binder resin and a colorant, the binder resin comprises a polyester resin prepared by condensation polymerization between an alcohol component and a carboxylic acid component that contains fumaric acid-modified rosin.

<B-2> The image forming apparatus according to <B-1>, wherein the charging unit charges the latent electrostatic image bearing member in a contactless manner.

<B-3> The image forming apparatus according to <B-1>, wherein the charging unit charges the latent electrostatic image bearing member through contacting therewith.

<B-4> The image forming apparatus according to any one of <B-1> to <B-3>, wherein the developing unit comprises a magnetic field-generating unit disposed therein and a rotatable developer bearing member that bears a two-component developer of a magnetic carrier and a toner thereon.

<B-5> The image forming apparatus according to any one of <B-1> to <B-3>, wherein the developing unit comprises a developer bearing member, to which a toner being supplied, and a layer thickness-control member for forming a toner-thin layer on the surface of the developer bearing member.

<B-6> The image forming apparatus according to any one of <B-1> to <B-5>, wherein the transfer unit transfers a visible image formed on the latent electrostatic image bearing member onto a recording medium.

<B-7> The image forming apparatus according to any one of <B-1> to <B-6>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<B-8> The image forming apparatus according to any one of <B-1> to <B-5>, wherein the transfer unit comprises an intermediate transfer member to which the visible image formed on the latent electrostatic image bearing member is primarily transferred, and a secondary transfer unit that transfers the visible image formed on the intermediate transfer member onto the recording medium.

<B-9> The image forming apparatus according to any one of <B-1> to <B-8>, comprising a cleaning unit, wherein the cleaning unit comprises a cleaning blade that comes into contact with the surface of the latent electrostatic image bearing member.

<B-10> The image forming apparatus according to any one of <B-1> to <B-8>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<B-11> The image forming apparatus according to any one of <B-1> to <B-10>, wherein the fixing unit comprises at least one of a roller and a belt, and the fixing unit is heated from the side other than in contact with the toner, and fixes the image transferred on the recording medium by heat and pressure.

<B-12> The image forming apparatus according to any one of <B-1> to <B-10>, wherein the fixing unit comprises at least one of a roller and a belt, and the fixing unit is heated from the side in contact with the toner, and fixes the image transferred on the recording medium by heat and pressure.

<B-13> The image forming apparatus according to any one of <B-1> to <B-12>, wherein the content of the fumaric acid-modified rosin is 5% by mass to 85% by mass in the carboxylic acid component.

<B-14> The image forming apparatus according to any one of <B-1> to <B-13>, wherein the fumaric acid-modified rosin is prepared by modifying a purified rosin with fumaric acid.

<B-15> The image forming apparatus according to any one of <B-1> to <B-14>, wherein the condensation polymerization is carried out in the presence of a titanium compound and/or a tin (II) compound having no Sn—C bond.

<B-16> An image forming method, comprising:

charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner comprises a binder resin and a colorant, the binder resin comprises a polyester resin prepared by condensation polymerization between an alcohol component and a carboxylic acid component that contains fumaric acid-modified rosin.

<B-17> The image forming method according to <B-16>, wherein the charging unit charges the latent electrostatic image bearing member in a contactless manner.

<B-18> The image forming method according to <B-16>, wherein the charging unit charges the latent electrostatic image bearing member through contacting therewith.

<B-19> The image forming method according to any one of <B-16> to <B-18>, wherein the developing unit comprises a magnetic field-generating unit disposed therein and a rotatable developer bearing member that bears a two-component developer of a magnetic carrier and a toner thereon.

<B-20> The image forming method according to any one of 15<B-16> to <B-18>, wherein the developing unit comprises a developer bearing member, to which a toner being supplied, and a layer thickness-control member for forming a toner-thin layer on the surface of the developer bearing member.

<B-21> The image forming method according to any one of 20<B-16> to <B-20>, wherein the transfer unit transfers a visible image formed on the latent electrostatic image bearing member onto a recording medium.

<B-22> The image forming method according to any one of <B-16> to <B-21>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<B-23> The image forming method according to any one of <B-16> to <B-20>, wherein the transfer unit comprises an intermediate transfer member to which the visible image formed on the latent electrostatic image bearing member is primarily transferred, and a secondary transfer unit that transfers the visible image formed on the intermediate transfer member onto the recording medium.

<B-24> The image forming method according to any one of <B-16> to <B-23>, comprising a cleaning unit, wherein the cleaning unit comprises a cleaning blade that comes into contact with the surface of the latent electrostatic image bearing member.

<B-25> The image forming method according to any one of <B-16> to <B-23>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<B-26> The image forming method according to any one of <B-16> to <B-25>, wherein the fixing unit comprises at least one of a roller and a belt, and the fixing unit is heated from the side other than in contact with the toner, and fixes the image transferred on the recording medium by heat and pressure.

<B-27> The image forming method according to any one of <B-16> to <B-25>, wherein the fixing unit comprises at least one of a roller and a belt, and <B-28> The image forming method according to any one of <B-16> to <B-27>, wherein the content of the fumaric acid-modified rosin is 5% by mass to 85% by mass in the carboxylic acid component.

<B-29> The image forming method according to any one of <B-16> to <B-28>, wherein the fumaric acid-modified rosin is prepared by modifying a purified rosin with fumaric acid.

<B-30> The image forming method according to any one of <B-16> to <B-29>, wherein the condensation polymerization is carried out in the presence of a titanium compound and/or a tin (II) compound having no Sn—C bond.

<B-31> A process cartridge, comprising a latent electrostatic image bearing member and a developing unit configured to develop the latent electrostatic image formed on the latent electrostatic image bearing member using a toner to form a visible image, wherein the process cartridge is detachably mounted to an image forming apparatus, and the toner comprises a binder resin and a colorant, the binder resin comprises a polyester resin prepared by condensation polymerization between an alcohol component and a carboxylic acid component that contains fumaric acid-modified rosin.

<B-32> The process cartridge according to <B-31>, wherein the content of the fumaric acid-modified rosin is 5% by mass to 85% by mass in the carboxylic acid component.

<B-33> The process cartridge according to <B-31> or <B-32>, wherein the fumaric acid-modified rosin is prepared by modifying a purified rosin with fumaric acid.

<B-34> The process cartridge according to any one of <B-31> to <B-33>, wherein the condensation polymerization is carried out in the presence of a titanium compound and/or a tin (II) compound having no Sn—C bond.

The object may also be attained in accordance with the third aspect of the present invention as follows:

<C-1> An image forming apparatus, comprising:

a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner comprises a binder resin and a colorant, the binder resin comprises a polyester resin prepared by condensation polymerization between an alcohol component that contains an aliphatic polyvalent alcohol and a carboxylic acid component that contains fumaric acid-modified rosin.

<C-2> The image forming apparatus according to <C-1>wherein the charging unit charges the latent electrostatic image bearing member in a contactless manner.

<C-3> The image forming apparatus according to <C-1>, wherein the charging unit charges the latent electrostatic image bearing member through contacting therewith.

<C-4> The image forming apparatus according to any one of <C-1> to <C-3>, wherein the developing unit comprises a magnetic field-generating unit disposed therein and a rotatable developer bearing member that bears a two-component developer of a magnetic carrier and a toner thereon.

<C-5> The image forming apparatus according to any one of <C-1> to <C-3>, wherein the developing unit comprises a developer bearing member, to which a toner being supplied, and a layer thickness-control member for forming a toner-thin layer on the surface of the developer bearing member.

<C-6> The image forming apparatus according to any one of <C-1> to <C-5>, wherein the transfer unit transfers a visible image formed on the latent electrostatic image bearing member onto a recording medium.

<C-7> The image forming apparatus according to any one of <C-1> to <C-6>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<C-8> The image forming apparatus according to any one of <C-1> to <C-5>, wherein the transfer unit comprises an intermediate transfer member to which the visible image formed on the latent electrostatic image bearing member is primarily transferred, and a secondary transfer unit that transfers the visible image formed on the intermediate transfer member onto the recording medium.

<C-9> The image forming apparatus according to any one of <C-1> to <C-8>, comprising a cleaning unit, wherein the cleaning unit comprises a cleaning blade that comes into contact with the surface of the latent electrostatic image bearing member.

<C-10> The image forming apparatus according to any one of <C-1> to <C-8>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<C-11> The image forming apparatus according to any one of <C-1> to <C-10>, wherein the fixing unit comprises at least one of a roller and a belt, and the fixing unit is heated from the side other than in contact with the toner, and fixes the image transferred on the recording medium by heat and pressure.

<C-12> The image forming apparatus according to any one of <C-1> to <C-10>, wherein the fixing unit comprises at least one of a roller and a belt, and the fixing unit is heated from the side in contact with the toner, and fixes the image transferred on the recording medium by heat and pressure.

<C-13> The image forming apparatus according to any one of <C-1> to <C-12>, wherein the aliphatic polyvalent alcohol comprises one having a carbon number of 2 to 6.

<C-14> The image forming apparatus according to any one of <C-1> to <C-13>, wherein the content of the fumaric acid-modified rosin is 5% by mass to 85% by mass in the carboxylic acid component.

<C-15> The image forming apparatus according to any one of <C-1> to <C-14>, wherein the fumaric acid-modified rosin is prepared by modifying a purified rosin with fumaric acid.

<C-16> The image forming apparatus according to any one of <C-1> to <C-15>, wherein the alcohol component comprises an alcohol of trivalent or more, and/or the carboxylic acid component comprises a carboxylic acid of trivalent or more.

<C-17> The image forming apparatus according to any one of <C-1> to <C-16>, wherein the condensation polymerization is carried out in the presence of a titanium compound and/or a tin (II) compound having no Sn—C bond.

<C-18> An image forming method, comprising:

charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner comprises a binder resin and a colorant, the binder resin comprises a polyester resin prepared by condensation polymerization between an alcohol component that contains an aliphatic polyvalent alcohol and a carboxylic acid component that contains fumaric acid-modified rosin.

<C-19> The image forming method according to <C-18>, wherein the charging unit charges the latent electrostatic image bearing member in a contactless manner.

<C-20> The image forming method according to <C-18>, wherein the charging unit charges the latent electrostatic image bearing member through contacting therewith.

<C-21> The image forming method according to any one of <C-18> to <C-20>, wherein the developing unit comprises a magnetic field-generating unit disposed therein and a rotatable developer bearing member that bears a two-component developer of a magnetic carrier and a toner thereon.

<C-22> The image forming method according to any one of <C-18> to <C-20>, wherein the developing unit comprises a developer bearing member, to which a toner being supplied, and a layer thickness-control member for forming a toner-thin layer on the surface of the developer bearing member.

<C-23> The image forming method according to any one of <C-18> to <C-22>, wherein the transfer unit transfers a visible image formed on the latent electrostatic image bearing member onto a recording medium.

<C-24> The image forming method according to any one of <C-18> to <C-23>, comprising plural image forming elements each comprising a latent electrostatic image bearing member, a charging unit, a developing unit, and a transferring unit, wherein the transfer unit transfers images formed on the latent electrostatic image bearing member in series onto recording media of which the surface moves through the transfer site while facing the latent electrostatic image bearing member.

<C-25> The image forming method according to any one of <C-18> to <C-22>, wherein the transfer unit comprises an intermediate transfer member to which the visible image formed on the latent electrostatic image bearing member is primarily transferred, and a secondary transfer unit that transfers the visible image formed on the intermediate transfer member onto the recording medium.

<C-26> The image forming method according to any one of <C-18> to <C-25>, comprising a cleaning unit, wherein the cleaning unit comprises a cleaning blade that comes into contact with the surface of the latent electrostatic image bearing member.

<C-27> The image forming method according to any one of <C-18> to <C-25>, wherein the developing unit comprises a developer bearing member that comes into contact with the surface of the latent electrostatic image bearing member, and the developing unit develops a latent electrostatic image formed on the surface of the latent electrostatic image bearing member, and collects the toner remaining on the latent electrostatic image bearing member.

<C-28> The image forming method according to any one of <C-18> to <C-27>, wherein the fixing unit comprises at least one of a roller and a belt, and the fixing unit is heated from the side other than in contact with the toner, and fixes the image transferred on the recording medium by heat and pressure.

<C-29> The image forming method according to any one of <C-18> to <C-27>, wherein the fixing unit comprises at least one of a roller and a belt, and the fixing unit is heated from the side in contact with the toner, and fixes the image transferred on the recording medium by heat and pressure.

<C-30> The image forming method according to any one of <C-18> to <C-27>, wherein the aliphatic polyvalent alcohol comprises one having a carbon number of 2 to 6.

<C-31> The image forming method according to any one of <C-18> to <C-30>, wherein the content of the fumaric acid-modified rosin is 5% by mass to 85% by mass in the carboxylic acid component.

<C-32> The image forming method according to any one of <C-18> to <C-31>, wherein the fumaric acid-modified rosin is prepared by modifying a purified rosin with fumaric acid.

<C-33> The image forming method according to any one of <C-18> to <C-32>, wherein the alcohol component comprises an alcohol of trivalent or more, and/or the carboxylic acid component comprises a carboxylic acid of trivalent or more.

<C-34> The image forming method according to any one of <C-18> to <C-33>, wherein the condensation polymerization is carried out in the presence of a titanium compound and/or a tin (II) compound having no Sn—C bond.

<C-35> A process cartridge, comprising a latent electrostatic image bearing member and a developing unit configured to develop the latent electrostatic image formed on the latent electrostatic image bearing member using a toner to form a visible image, wherein the process cartridge is detachably mounted to an image forming apparatus, and the toner comprises a binder resin and a colorant, the binder resin comprises a polyester resin prepared by condensation polymerization between an alcohol component that contains an aliphatic polyvalent alcohol and a carboxylic acid component that contains fumaric acid-modified rosin.

<C-36> The process cartridge according to <C-35>, wherein the aliphatic polyvalent alcohol comprises one having a carbon number of 2 to 6.

<C-37> The process cartridge according to <C-35> or <C-36>, wherein the content of the fumaric acid-modified rosin is 5% by mass to 85% by mass in the carboxylic acid component.

<C-38> The process cartridge according to any one of <C-35> to <C-37>, wherein the fumaric acid-modified rosin is prepared by modifying a purified rosin with fumaric acid.

<C-39> The process cartridge according to any one of <C-35> to <C-38>, wherein the alcohol component comprises an alcohol of trivalent or more, and/or the carboxylic acid component comprises a carboxylic acid of trivalent or more.

<C-40> The process cartridge according to any one of <C-35> to <C-39>, wherein the condensation polymerization is carried out in the presence of a titanium compound and/or a tin (II) compound having no Sn—C bond.

In the first aspect of the present invention, the image forming apparatus comprises a latent electrostatic image bearing member, a charging unit configured to charge the surface of the latent electrostatic image bearing member, an exposing unit configured to expose the charged surface of the latent electrostatic image bearing member, a developing unit configured to develop a visible image from the electrostatic latent image by use of a toner, a transferring unit configured to transfer the visible image onto a recording medium, and a fixing unit configured to fix the transferred image on the recording medium; the toner comprises a binder resin and a colorant, and the binder resin comprises a polyester resin that is prepared by condensation polymerization between an alcohol component that contains an aliphatic polyvalent alcohol and a carboxylic acid component that contains (meth)acrylic acid-modified rosin. In the inventive image forming apparatus, the charging unit uniformly charges the surface of the latent electrostatic image bearing member. The exposing unit exposes the surface of the latent electrostatic image bearing member to form an electrostatic latent image. The developing unit develops the electrostatic latent image formed on the latent electrostatic image bearing member to form a visible image by use of a toner. The transferring unit transfers the visible image onto a recording medium. The fixing unit fixes the transferred image on the recording medium. In these processes, the usage of the polyester resin, as the binder resin of the toner, prepared by condensation polymerization between an alcohol component that contains an aliphatic polyvalent alcohol and a carboxylic acid component that contains (meth)acrylic acid-modified rosin may lead to a toner with excellent properties in low temperature fixing ability, hot offset resistance, and storage stability, and result in extremely high quality images with excellent fixing ability, far from tone change with time, and with substantially no occurrences of abnormal images such as density-drop and background smear.

In the first aspect of the present invention, the image forming method comprises a step of charging a surface of a latent electrostatic image bearing member, a step of exposing the charged surface of the latent electrostatic image bearing member to form an electrostatic image, a step of developing a visible image from the electrostatic latent image by use of a toner, a step of transferring the visible image onto a recording medium, and a step of fixing the transferred image on the recording medium; and the binder resin comprises a polyester resin that is prepared by condensation polymerization between an alcohol component that contains an aliphatic polyvalent alcohol and a carboxylic acid component that contains (meth)acrylic acid-modified rosin. In the inventive image forming method, the charging step uniformly charges the surface of the latent electrostatic image bearing member. The exposing step exposes the surface of the latent electrostatic image bearing member to form an electrostatic latent image. The developing step develops the electrostatic latent image formed on the latent electrostatic image bearing member to form a visible image by use of a toner. The transferring step transfers the visible image onto a recording medium. The fixing step fixes the transferred image on the recording medium. In this method, the usage of the polyester resin, as the binder resin of the toner, prepared by condensation polymerization between an alcohol component that contains an aliphatic polyvalent alcohol and a carboxylic acid component that contains (meth)acrylic acid-modified rosin may lead to a toner with excellent properties in low temperature fixing ability, hot offset resistance, and storage stability, and result in extremely high quality images with excellent fixing ability, far from tone change with time, and with substantially no occurrences of abnormal images such as density-drop and background smear.

In the first aspect of the present invention, the process cartridge comprises a latent electrostatic image bearing member and a developing unit configured to develop a visible image from the electrostatic latent image formed on the latent electrostatic image bearing member by use of a toner, and is detachably attached to the image forming apparatus; the toner comprises a binder resin and a colorant, and the binder resin comprises a polyester resin that is prepared by condensation polymerization between an alcohol component that contains an aliphatic polyvalent alcohol and a carboxylic acid component that contains (meth)acrylic acid-modified rosin. In the inventive process cartridge, the usage of the polyester resin, as the binder resin of the toner, prepared by condensation polymerization between an alcohol component that contains an aliphatic polyvalent alcohol and a carboxylic acid component that contains (meth)acrylic acid-modified rosin may lead to a toner with excellent properties in low temperature fixing ability, hot offset resistance, and storage stability, and result in extremely high quality images with excellent fixing ability, far from tone change with time, and with substantially no occurrences of abnormal images such as density-drop and background smear.

In the second aspect of the present invention, the image forming apparatus comprises a latent electrostatic image bearing member, a charging unit configured to charge the surface of the latent electrostatic image bearing member, an exposing unit configured to expose the charged surface of the latent electrostatic image bearing member, a developing unit configured to develop a visible image from the electrostatic latent image by use of a toner, a transferring unit configured to transfer the visible image onto a recording medium, and a fixing unit configured to fix the transferred image on the recording medium; the toner comprises a binder resin and a colorant, and the binder resin comprises a polyester resin that is prepared by condensation polymerization between an alcohol component and a carboxylic acid component that contains fumaric acid-modified rosin. In the inventive image forming apparatus, the charging unit uniformly charges the surface of the latent electrostatic image bearing member. The exposing unit exposes the surface of the latent electrostatic image bearing member to form an electrostatic latent image. The developing unit develops the electrostatic latent image formed on the latent electrostatic image bearing member to form a visible image by use of a toner. The transferring unit transfers the visible image onto a recording medium. The fixing unit fixes the transferred image on the recording medium. In these processes, the usage of the polyester resin, as the binder resin of the toner, prepared by condensation polymerization between an alcohol component and a carboxylic acid component that contains fumaric acid-modified rosin may lead to a toner with excellent properties in low temperature fixing ability and storage stability, and result in extremely high quality images with excellent fixing ability, far from tone change with time, and with substantially no occurrences of abnormal images such as density-drop and background smear.

In the second aspect of the present invention, the image forming method comprises a step of charging a surface of a latent electrostatic image bearing member, a step of exposing the charged surface of the latent electrostatic image bearing member to form an electrostatic image, a step of developing a visible image from the electrostatic latent image by use of a toner, a step of transferring the visible image onto a recording medium, and a step of fixing the transferred image on the recording medium; and the binder resin comprises a polyester resin that is prepared by condensation polymerization between an alcohol component and a carboxylic acid component that contains fumaric acid-modified rosin. In the inventive image forming method, the charging step uniformly charges the surface of the latent electrostatic image bearing member. The exposing step exposes the surface of the latent electrostatic image bearing member to form an electrostatic latent image. The developing step develops the electrostatic latent image formed on the latent electrostatic image bearing member to form a visible image by use of a toner. The transferring step transfers the visible image onto a recording medium. The fixing step fixes the transferred image on the recording medium. In these processes, the usage of the polyester resin, as the binder resin of the toner, prepared by condensation polymerization between an alcohol component and a carboxylic acid component that contains fumaric acid-modified rosin may lead to a toner with excellent properties in low temperature fixing ability and storage stability, and result in extremely high quality images with excellent fixing ability, far from tone change with time, and with substantially no occurrences of abnormal images such as density-drop and background smear.

In the second aspect of the present invention, the process cartridge comprises a latent electrostatic image bearing member and a developing unit configured to develop a visible image from the electrostatic latent image formed on the latent electrostatic image bearing member by use of a toner, and is detachably attached to the image forming apparatus; the toner comprises a binder resin and a colorant, and the binder resin comprises a polyester resin that is prepared by condensation polymerization between an alcohol component and a carboxylic acid component that contains fumaric acid-modified rosin. In the inventive process cartridge, the usage of the polyester resin, as the binder resin of the toner, prepared by condensation polymerization between an alcohol component and a carboxylic acid component that contains fumaric acid-modified rosin may lead to a toner with excellent properties in low temperature fixing ability and storage stability, and result in extremely high quality images with excellent fixing ability, far from tone change with time, and with substantially no occurrences of abnormal images such as density-drop and background smear.

In the third aspect of the present invention, the image forming apparatus comprises a latent electrostatic image bearing member, a charging unit configured to charge the surface of the latent electrostatic image bearing member, an exposing unit configured to expose the charged surface of the latent electrostatic image bearing member, a developing unit configured to develop a visible image from the electrostatic latent image by use of a toner, a transferring unit configured to transfer the visible image onto a recording medium, and a fixing unit configured to fix the transferred image on the recording medium; the toner comprises a binder resin and a colorant, and the binder resin comprises a polyester resin that is prepared by condensation polymerization between an alcohol component that contains an aliphatic polyvalent alcohol and a carboxylic acid component that contains fumaric acid-modified rosin. In the inventive image forming apparatus, the charging unit uniformly charges the surface of the latent electrostatic image bearing member. The exposing unit exposes the surface of the latent electrostatic image bearing member to form an electrostatic latent image. The developing unit develops the electrostatic latent image formed on the latent electrostatic image bearing member to form a visible image by use of a toner. The transferring unit transfers the visible image onto a recording medium. The fixing unit fixes the transferred image on the recording medium. In these processes, the usage of the polyester resin, as the binder resin of the toner, prepared by condensation polymerization between an alcohol component that contains an aliphatic polyvalent alcohol and a carboxylic acid component that contains fumaric acid-modified rosin may lead to a toner with excellent properties in low temperature fixing ability, offset resistance, and storage stability, and result in extremely high quality images with excellent fixing ability, far from tone change with time, and with substantially no occurrences of abnormal images such as density-drop and background smear.

In the third aspect of the present invention, the image forming method comprises a step of charging a surface of a latent electrostatic image bearing member, a step of exposing the charged surface of the latent electrostatic image bearing member to form an electrostatic image, a step of developing a visible image from the electrostatic latent image by use of a toner, a step of transferring the visible image onto a recording medium, and a step of fixing the transferred image on the recording medium; and the binder resin comprises a polyester resin that is prepared by condensation polymerization between an alcohol component that contains an aliphatic polyvalent alcohol and a carboxylic acid component that contains fumaric acid-modified rosin. In the inventive image forming method, the charging step uniformly charges the surface of the latent electrostatic image bearing member. The exposing step exposes the surface of the latent electrostatic image bearing member to form an electrostatic latent image. The developing step develops the electrostatic latent image formed on the latent electrostatic image bearing member to form a visible image by use of a toner. The transferring step transfers the visible image onto a recording medium. The fixing step fixes the transferred image on the recording medium. In this method, the usage of the polyester resin, as the binder resin of the toner, prepared by condensation polymerization between an alcohol component that contains an aliphatic polyvalent alcohol and a carboxylic acid component that contains fumaric acid-modified rosin may lead to a toner with excellent properties in low temperature fixing ability, offset resistance, and storage stability, and result in extremely high quality images with excellent fixing ability, far from tone change with time, and with substantially no occurrences of abnormal images such as density-drop and background smear.

In the third aspect of the present invention, the process cartridge comprises a latent electrostatic image bearing member and a developing unit configured to develop a visible image from the electrostatic latent image formed on the latent electrostatic image bearing member by use of a toner, and is detachably attached to the image forming apparatus; the toner comprises a binder resin and a colorant, and the binder resin comprises a polyester resin that is prepared by condensation polymerization between an alcohol component that contains an aliphatic polyvalent alcohol and a carboxylic acid component that contains fumaric acid-modified rosin. In the inventive process cartridge of the third aspect, the usage of the polyester resin, as the binder resin of the toner, prepared by condensation polymerization between an alcohol component that contains an aliphatic polyvalent alcohol and a carboxylic acid component that contains fumaric acid-modified rosin may lead to a toner with excellent properties in low temperature fixing ability, offset resistance, and storage stability, and result in extremely high quality images with excellent fixing ability, far from tone change with time, and with substantially no occurrences of abnormal images such as density-drop and background smear.

The present invention may solve the problems in the art, that is, image forming apparatuses, image forming methods, and process cartridges may be provided that use a toner with excellent properties in low temperature fixing ability, hot offset resistance, and storage stability, and may result in extremely high quality images with excellent fixing ability, far from tone change with time, and with substantially no occurrences of abnormal images such as density-drop and background smear.

DETAILED DESCRIPTION OF THE INVENTION

Figure 1:
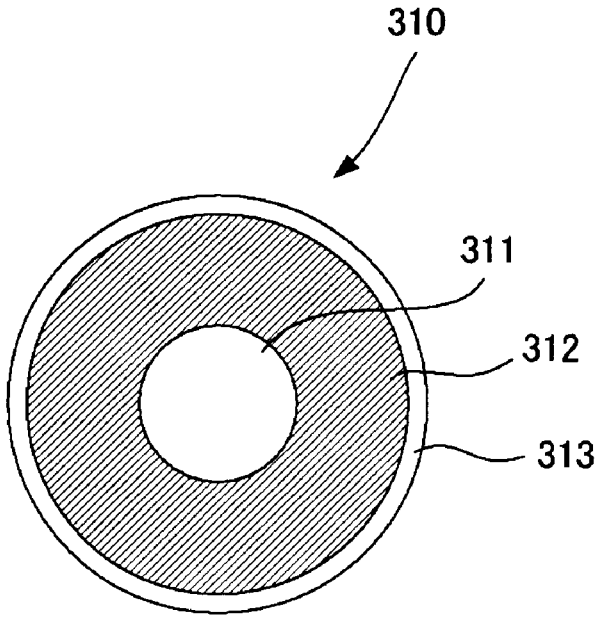
FIG. 1 is a schematic cross-section that exemplarily shows a charging roller utilized in an inventive image forming apparatus.

Image Forming Apparatus and Image Forming Method

The image forming apparatus of the present invention comprises a latent electrostatic image bearing member, a charging unit, an exposing unit, a developing unit, a transfer unit, and a fixing unit, and also other units such as a cleaning unit, a discharging unit, a recycling unit, and a controlling unit as required. In some cases, the charging unit and the exposing unit are collectively referred to as a "latent electrostatic image forming unit".

The image forming method of the present invention comprises a charging step, an exposing step, a developing step, a transfer step, and a fixing step, and also other steps such as a cleaning step, a discharging step, a recycling step, and a controlling step as required. In some cases, the charging unit and the exposing unit are collectively referred to as a "latent electrostatic image forming step".

The image forming method of the present invention can be preferably carried out by the image forming apparatus of the present invention; the charging step can be preferably carried out by the charging unit; the exposing step can be preferably carried out by the exposing unit; the developing step can be preferably carried out by the developing unit; the transfer step can be preferably carried out by the transfer unit; the fixing step can be preferably carried out by the fixing unit; the cleaning step can be preferably carried out by the cleaning unit; and the other steps can be preferably carried out by the other units.

Latent Electrostatic Image Bearing Member

The latent electrostatic image bearing member may be properly selected in terms of material, shape, configuration, size, etc.; the shape may be of drum, sheet, or endless belt; the configuration may be of mono-layer or multi-layer; the size may be properly selected depending on the type and specification of the image forming apparatus. The materials thereof are, for example, inorganic photoconductors such as of amorphous silicon, selenium, CdS, and ZnO, organic photoconductors (OPC) such as polysilane and phthalopolymethine, and the like.

The amorphous silicon photoconductor is formed, for example, by heating a substrate at 50° C. to 400° C., and forming a photoconductive layer on the substrate by depositing a-Si in accordance with a film formation method such as vapor deposition, sputtering, ion plating, thermal-CVD, photo-CVD, and plasma-CVD methods. Among these methods, the plasma-CVD method is preferable, where an a-Si deposition layer is formed on the substrate by decomposing a source gas with DC, or high-frequency or microwave glow discharge.

The organic photoconductors (OPC) have been conventionally utilized as the image-bearing member due to such reasons as (1) optical properties including wide wavelength band of optical absorption and large amount of light absorption; (2) electric properties including high-sensitive and stable charge property; (3) wide selection of material; (4) easy production; (5) low cost; and (6) non-toxicity. The layer structure of the organic photoconductor is classified broadly into a single-layered structure, and a laminated structure.

The photoconductors of the single-layered structure contains a substrate, a single-layered photosensitive layer on the substrate, and further contains a protective layer, an intermediate layer and other layers as necessary. The photoconductors of the laminated structure contain a substrate, a laminated photosensitive layer having at least a charge generating layer, and a charge transport layer in this order, and further contains a protective layer, an intermediate layer and other layers as necessary.

Charging Step and Charging Unit

The charging step is one where the surface of latent electrostatic image bearing member is charged and is carried out by the charging unit.

The charging unit may be appropriately selected according to the purpose as long as capable of charging uniformly the surface of the latent electrostatic image bearing member by applying a voltage. There are two types of charging units, i.e. (1) charging unit of contact type configured to contact and charge the image bearing member and (2) charging unit of non-contact type configured to charge the latent electrostatic image bearing member without contacting.

Examples of (1) the contact charging unit include conductive or semiconductive charging rollers, magnetic brushes, fur brushes, films, and rubber blades. Among these, the charging roller can significantly reduce the amount of generated ozone compared with corona discharges, and is excellent in stability when latent electrostatic image bearing member are repeatedly used, and is effective to prevent deterioration of image quality.

The magnetic brush is typically made from a nonmagnetic conductive sleeve that supports various ferrite particles such as of Zn—Cu ferrite and a magnetic roll inserted into the sleeve. The fur brush is typically constructed by way of winding or laminating a fur, having been made conductive using carbon, copper sulfide, metals or metal oxides, onto a core metal.

FIG. 1 is a schematic cross-section that exemplarily shows a charging roller. The charging roller 310 has a core metal 311 of a cylindrical conductive support, conductivity-adjusting layer 312 around outer surface of the core metal 311, and a protective layer 313 to coat and to protect leak of the conductivity-adjusting layer 312.

The conductivity-adjusting layer 312 may be formed by extrusion molding or injection molding a thermosensitive resin composition, containing a thermosensitive resin and an ion conductive polymer, around the surface of the core metal 311.

The volume resistivity of the conductivity-adjusting layer 312 is preferably $10^6$ to $10^9$ ohm·cm. The volume resistivity above $10^9$ ohm·cm may make impossible for the photoconductor drum to take a charged voltage sufficient for uniform images due to insufficient charge amount, and the volume resistivity below $10^6$ ohm·cm may possibly generate leak toward the entire photoconductor drums.

The thermoplastic resin, utilized in the conductivity-adjusting layer 312, may be properly selected depending on the application; examples of the resin include polyethylene (PE), polypropylene (PP), polymethylmethacrylate (PMMA), polystyrene (PS), and PS copolymers such as AS and ABS.

The ion conductive polymer may be those having a specific resistivity of about $10^6$ to $10^{10}$ ohm·cm and capable of reducing the resistivity of the resins; examples thereof are compounds having a constituent of polyether ester amide. In order to achieve the resistivity of the conductivity-adjusting layer 312 within the range described above, the amount of the ion conductive polymer is preferably 30 to 70 parts by mass based on 100 parts by mass of the thermoplastic resin.

The ion conductive polymer may be one containing a quaternary ammonium base. The polymer containing a quaternary ammonium base is exemplified by polyolefins containing a quaternary ammonium base. In order to achieve the resistivity of the conductivity-adjusting layer 312 within the range described above, the amount of the polyolefin is preferably 10 to 40 parts by mass based on 100 parts by mass of the thermoplastic resin.

The ion conductive polymer may be dispersed into the thermoplastic resin by use of twin-axis mixers or kneaders. The ion conductive polymer may be uniformly dispersed into the thermoplastic resin in a molecular order, thus resistivity fluctuation scarcely generates in the conductivity-adjusting layer 312 due to inferior dispersion contrary to contrary conductivity-adjusting layers in which conductive pigments being dispersed. The ion conductive polymer, by virtue of a polymer compound, is dispersed and fixed within the thermosensitive resin composition and thus is unlikely to bleed out.

The protective layer 313 is designed to have a resistivity higher than that of the conductivity-adjusting layer 312, by which leak into defective portions of photoconductor drum may be avoided. In cases where the resistivity of the protective layer 313 is excessively high, the charging efficiency tends to be decreased, thus it is preferred that the difference of the resistivities is no more than $10^3$ ohm·cm between the protective layer 313 and the conductivity-adjusting layer 312.

The material of the protective layer 313 is preferably resin materials in view of proper film-formability. The resin materials are preferably fluorocarbon resins, polyamide resins, polyester resins, and polyvinylacetal resins due to excellent non-tackiness in view of preventing toner deposition. The resin materials are typically electrically insulative, thus the property of charging rollers is unsatisfactory when the protective layers 313 is formed from the resin material itself. Therefore, the resistivity of the protective layer 313 is adjusted by dispersing various electrically conductive agents into the resin material. A reactive hardener such as of isocyanate may be optionally included into the resin material in order to enhance the adhesion between the protective layers 313 and the conductivity-adjusting layer 312.

The charging roller 310 is connected to a power source to apply a predetermined voltage. The voltage may be of direct current voltage (DC), more preferably DC superimposed with an alternating current voltage (AC). Such application of AC voltage may bring about more uniformly charged surfaces of photoconductor drums.

Figure 2:
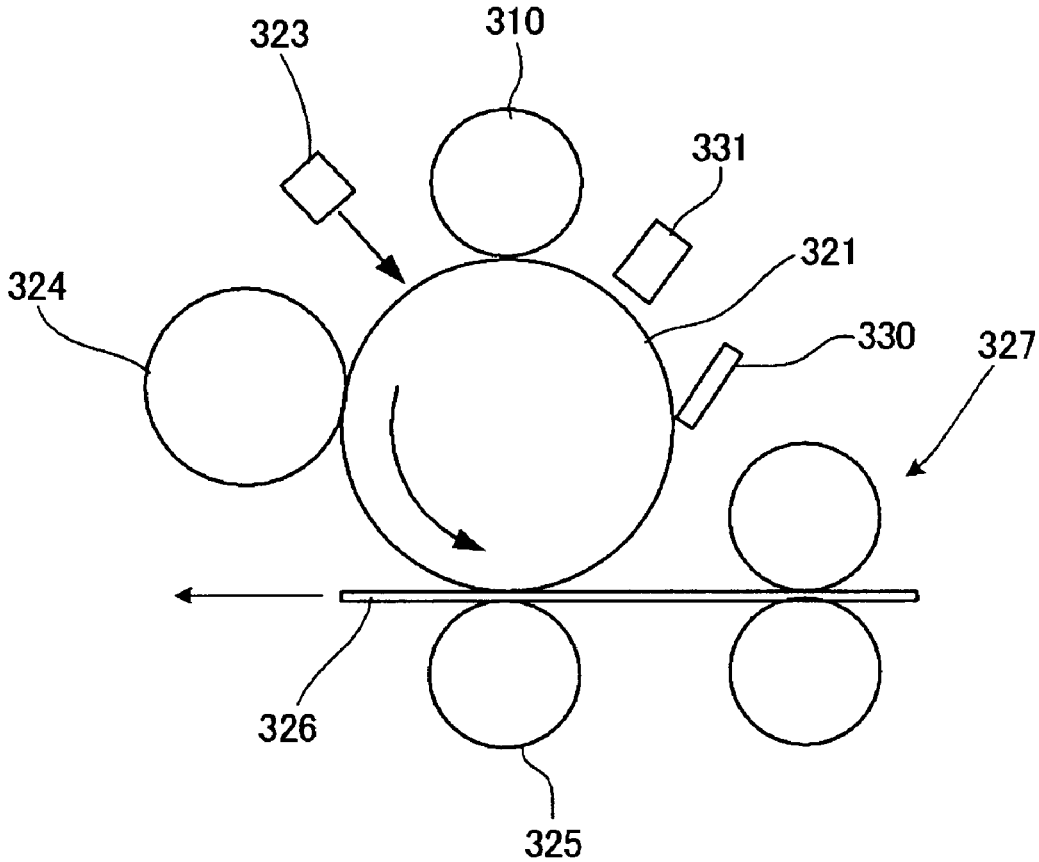
FIG. 2 is a schematic view that exemplarily shows an inventive image forming apparatus equipped with a charging roller of contacting type.

FIG. 2 is a schematic view that exemplarily shows an image forming apparatus equipped with a charging roller 310 of contacting type as shown in FIG. 1. As shown in FIG. 2, a charging unit 310 configured to charge the surface of the photoconductor, an exposing unit 323 configured to expose the charged surface of the photoconductor, a developing unit 324 configured to develop a visible image from the electrostatic latent image by use of a toner, a transferring unit 325 configured to transfer the visible image onto a recording medium, a fixing unit 327 configured to fix the transferred image on the recording medium, a cleaning unit 330 configured to remove the residual toner on the photoconductor, and a charge eliminating unit 331 configured to eliminate the residual toner on the photoconductor drum are disposed in order around the photoconductor drum 321 as a latent electrostatic image bearing member.

The charging roller 310 of contact-type as shown in FIG. 1 is disposed as the charging unit 310, by which the surface of the photoconductor drum 321 is uniformly charged.

Charging Unit of Non-Contact Type

The charging unit (2) of non-contact type described above may be non-contact chargers, needle electrode devices, solid discharging elements on the basis of corona discharge, or conductive or semiconductive charging rollers disposed with a small clearance from the photoconductor.

The corona discharge may be useful as a non-contact charging means in which positive or negative ions generated by corona discharge in air atmosphere is applied to surface of photoconductors. There exist coroton chargers where a certain amount of electric charge is applied on photoconductors and scoroton chargers where a certain voltage is applied on photoconductors.

The coroton chargers are constructed from a casing electrode that occupies about half space around a charging wire which is disposed almost at the center of the casing electrode.

The scoroton chargers are constructed by adding a grid electrode to the coroton charger. The grid electrode is typically disposed at a site of 1.0 to 2.0 mm from a surface of photoconductors.

Figure 3:
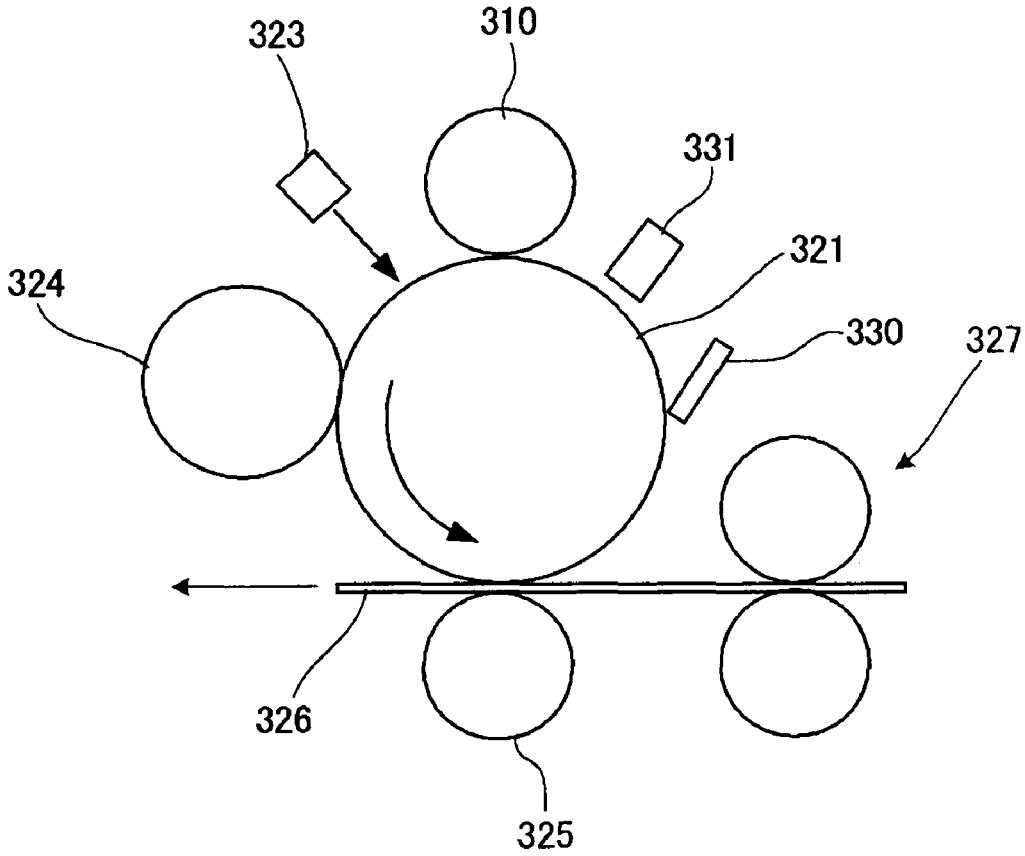
FIG. 3 is a schematic view that exemplarily shows an inventive image forming apparatus equipped with a corona charger of non-contacting type.

FIG. 3 is a schematic view that exemplarily shows an image forming apparatus equipped with a corona charger of non-contacting type. The reference numbers in FIG. 3 are the same as those of FIG. 2 when indicating the similar ones.

The charging unit, which being a corona charger 311 of non-contact type, charges uniformly the surface of photoconductor drum 321.

The charging roller, having a small clearance from the photoconductor, is improved on the basis of previous charging rollers as described above so as to take a small gap from the photoconductor. The small gap is preferably 10 to 200 μm, more preferably 10 to 100 μm.

Figure 4:
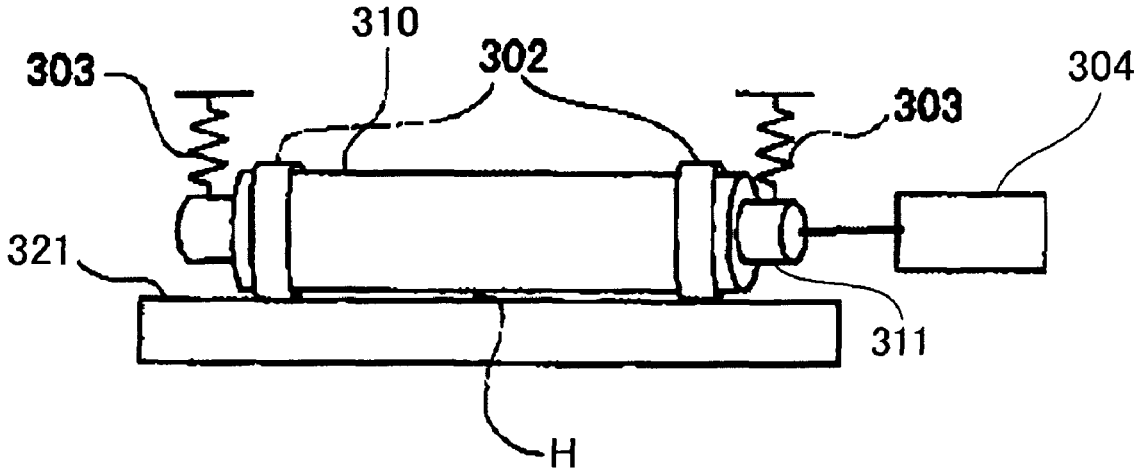
FIG. 4 is a schematic view that exemplarily shows a charging roller of non-contacting type applied to an inventive image forming apparatus.

FIG. 4 is a schematic view that exemplarily shows a charging roller of non-contacting type. The charging roller shown in FIG. 4 is disposed to have a small gap H from the photoconductor drum 321. The small gap H may be arranged by way that a spacer material is winded to a certain thickness at both ends of the charging roller 310 and then the surface of the spacer material is made contact with the surface of photoconductor drum 321. In FIG. 4, a power source 304 appears.

In the construction of FIG. 4, film 302 is winded as a spacer material at both ends of the charging roller 310. The spacer 302 is made contact with photoconductive surface of a photoconductor, thereby producing a certain small gap H between the charging roller and an image region of the photoconductor. As a bias, an AC superimposed voltage is applied and the photoconductor is charged by electric discharge at the small gap H between the charging roller and the photoconductor. The spring 303, which pressing the axis 311 of the charging roller as shown in FIG. 4, may increase the dimensional accuracy of the small gap H.

The spacer member formed of the spacer material may be formed integrally with the charging roller. In such a case, at least the surface of the gap portion is made insulative, thereby discharge at the gap portion may be avoided, thereby such a problem may be prevented that discharge product deposits at the gap portion, toner adheres firmly at the gap portion due to tackiness of the discharge product, and the gap is widened.

The spacer material may be a heat-shrinkable tube such as SUMI tube for 105° C. (article name: F105, by Sumitomo Chemical Co.).

Exposing Step and Exposing Unit

The exposing may be carried out, for example, by irradiating imagewise the surface of photoconductors by use of the exposing unit.

The optical systems for the exposing may be classified into analogue optical systems and digital optical systems. The analogue optical systems are those projecting directly an original image onto photoconductors by use of an optical system, and the digital optical systems are those where image information is input as electric signals, which is then converted into optical signals and photoconductors are exposed to form images.

The exposing unit may be properly selected as long as capable of exposing imagewise on the surface of photoconductors charged by charging units; examples of the exposing unit include various irradiating systems such as optical copy systems, rod-lens-eye systems, optical laser systems, optical liquid crystal shatter systems, and LED optical systems. In the present invention, a backlight system may be applied for the exposure, in which the exposure is carried out imagewise from back side of photoconductors.

Developing Step and Developing Unit

In the developing unit, latent electrostatic images are developed to form visual images by use of toners or developers. The visible images may be formed, for example, by developing latent electrostatic images using toners or developers, which being carried out by the developing unit.

The developing unit may be conventional ones as long as capable of developing by use of toners or developers, preferable example is ones containing toners or developers and having a developing unit to apply in contact or non-contact manner the toners or developers to the latent electrostatic images.

In the first aspect of the present invention, the toner comprises a binder resin and a colorant, preferably a release agent, a charge control agent, an external additive, and also other optional ingredients.

Binder Resin

The binder resin comprises a polyester resin prepared by condensation polymerization, preferably in the presence of esterification catalyst, between an alcohol component that contains an aliphatic polyvalent alcohol and a carboxylic acid component that contains (meth)acrylic acid-modified rosin, and also optional other components.

In the toner of the present invention, the (meth)acrylic acid-modified rosin as the carboxylic acid component may make possible to fix at remarkably lower temperatures and to increase storage stability.

The maleic acid-modified rosin in the prior art may act as a crosslinking agent by virtue of having three functional groups. When a polyester resin is prepared from the carboxylic acid component that contains much amounts of maleic acid-modified rosin for the purpose of higher fixing ability, higher contents of low molecular weight components as well as high molecular weight components make difficult to satisfy all of the low temperature fixing ability, offset resistance, and storage stability. On the other hand, lower amounts of the maleic acid-modified rosin degrade the low temperature fixing ability of the resulting polyester resin.

On the contrary, the (meth)acrylic acid-modified rosin available in the present invention is one having two functional groups, therefore, the molecular weight may increase through extending the molecular chain as a part of polyester principle chain, and also the amount of low molecular weight components having a molecular weight of less than 500, i.e. residual monomers and oligomer components, may be reduced. In addition, the aliphatic polyvalent alcohol, available in the present invention, is of molecularly compact and reactive, thus polyester resin may be produced with higher number-average molecular weight even in a combination of molecularly bulky and low reactive (meth)acrylic acid-modified rosin. That is, condensation polymerization between the alcohol component containing the aliphatic polyvalent alcohol and the carboxylic acid component containing (meth)acrylic acid-modified rosin may lead to polyester resin that contains less contents of low molecular weight components and has high number average molecular weights, as such it is assumed that a surprising effect may be taken to satisfy all of the low temperature fixing ability, offset resistance, and storage stability that are typically conflictive properties each other.

Carboxylic Acid Component

The (meth)acrylic acid-modified rosin is utilized as the carboxylic acid component of the polyester resin. The (meth) acrylic acid-modified rosin is a rosin modified by (meth) acrylic acid, and may be prepared by an addition reaction of a rosin having a main component of abietic acid, neoabietic acid, parastoline acid, pimaric acid, isopimaric acid, sandarac pimaric acid, dehydroabietic acid, or levopimaric acid with (meth)acrylic acid. More specifically, the (meth)acrylic acid-modified rosin may be prepared through Diels-Alder reaction between levopimaric acid, abietic acid, neoabietic acid, or parastoline acid that has a conjugated double bond in rosin and (meth)acrylic acid under a heating condition.

In this specification, the term "(meth)acrylic" refers to methacrylic as well as acrylic. Therefore, the (meth)acrylic acid means acrylic acid as well as methacrylic acid, and "(meth)acrylic acid-modified rosin" means acrylic acid-modified rosin as well as methacrylic acid-modified rosin. In the present invention, the (meth)acrylic acid-modified rosin is preferably acrylic acid-modified rosin that is modified with acrylic acid of less steric hindrance in view of reactive activity under the Diels-Alder reaction.

The modification degree of rosin by the (meth)acrylic acid ((meth)acrylic acid-modification degree) is preferably 5 to 105, more preferably 20 to 105, still more preferably 40 to 105, particularly preferably 60 to 105 from the viewpoint of higher molecular weight of the polyester resin and lower content of oligomer components with lower molecular weight. The modification degree of rosin by (meth)acrylic acid, i.e. (meth)acrylic acid-modification degree, (referred to as "MD by AA") is calculated from the Formula (1A):

$$MD \text{ by } AA = \frac{X_1 - Y}{X_2 - Y} \times 100$$

In the Formula (1A), $X_1$ represents an SP value of (meth) acrylic acid-modified rosin to be calculated for the modification degree; $X_2$ represents a saturated SP value of (meth) acrylic acid-modified rosin obtained by reaction between one mole of (meth)acrylic acid and one mole of rosin; Y is an SP value of rosin.

The SP value described above indicates a softening temperature that is measured by use of the softening point meter of annulus ring type explained in Examples later. The saturated SP value means the value of rosin obtained through the reaction between the (meth)acrylic acid and the rosin, in which the reaction is continued till the SP value of the resulting (meth)acrylic acid-modified rosin comes to a saturated value. The numerator $(X_1-Y)$ in Formula (1A) means a rising degree of SP value of (meth)acrylic acid-modified rosin. The larger is the modification degree expressed by the Formula (1A), the higher is the modification level.

The method for producing the (meth)acrylic acid-modified rosin may be properly selected depending on the application; for example, rosin and (meth)acrylic acid are mixed and heated to about 180° C. to 260° C., then (meth)acrylic acid is addition-reacted to an acid with a conjugated double bond within the rosin through Diels-Alder reaction thereby to obtain the (meth)acrylic acid-modified rosin. The resulting (meth)acrylic acid-modified rosin may be used without further processing or purified before use by operations such as distillation.

The rosin used for the (meth)acrylic acid-modified rosin may be anything as long as being rosin such as natural rosin obtained from pines, isomerized rosin, dimerized rosin, polymerized rosin, and dismutated rosin, that contains, as its main component, abietic acid, neoabietic acid, parastoline acid, pimaric acid, isopimaric acid, sandarac pimaric acid, dehydroabietic acid, or levopimaric acid; preferably, the rosin is tall rosin produced from tall oil that is a by-product in production processes of natural rosin pulp, gum rosin obtained from neat pitch pine, or wood rosin obtained from cut stocks of pines in view of color sense, more preferable is tall rosin in view of low temperature fixing ability.

The (meth)acrylic acid-modified rosin has been reduced in terms of its odor, since impurities to generate the odor has been decreased through Diels-Alder reaction under a heating condition. In order to suppress the odor still further, it is preferred that the (meth)acrylic acid-modified rosin is prepared by modifying purified rosin with (meth)acrylic acid, more preferably by modifying purified tall rosin with (meth) acrylic acid.

The purified rosin means one that is reduced for its impurities through a purifying step. As such, purifying the rosin may remove impurities within the rosin. The main impurities are exemplified by 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, and 4-(1-methylethyl)benzaldehyde. Among these, in the present invention, three peak strengths of hexanoic acid, pentanoic acid, and benzaldehyde detected by a head space GC-MS method as volatile components may be employed as an index of purified rosin. The index based on the volatile components rather than absolute amount of impurities is derived from the fact that the purified rosin is employed in the invention for the purpose of improving odor over the previous polyester resins.

Specifically, the purified rosin indicates those having a peak strength of no more than $0.8\times10^7$ for hexanoic acid, a peak strength of no more than $0.4\times10^7$ for pentanoic acid, and a peak strength of no more than $0.4\times10^7$ for benzaldehyde measured by the head space GC-MS method under conditions described in Examples. From the viewpoint of storage stability and odor, the peak strength of hexanoic acid is preferably no more than $0.6\times10^7$, more preferably no more than $0.5\times10^7$; the peak strength of pentanoic acid is preferably no more than $0.3\times10^7$, more preferably no more than $0.2\times10^7$; and the peak strength of benzaldehyde is preferably no more than $0.3\times10^7$, more preferably no more than $0.2\times10^7$.

Moreover, it is preferred from the viewpoint of storage stability and odor that n-hexanal and 2-pentylfuran are also reduced in addition to the three compounds. The peak strength of n-hexanal is preferably no more than $1.7\times10^7$, more preferably no more than $1.6\times10^7$, still more preferably no more than $1.5\times10^7$. The peak strength of 2-pentylfuran is preferably no more than $1.0\times10^7$, more preferably no more than $0.9\times10^7$, still more preferably no more than $0.8\times10^7$.

The method for purifying rosin may be conventional ones such as distillation, recrystallization, and extraction, preferably, the rosin is purified by distillation. The distillation method may be vacuum distillation, molecular distillation, steam distillation, or the like as described in JP-A No. 07-286139, for example; it is preferred that the purification is carried out by vacuum distillation. The vacuum distillation is typically carried out under a pressure of no more than 6.67 kPa at 200° C. to 300° C. The vacuum distillation may be thin-film distillation or rectification distillation in addition to conventional simple distillation. Under typical distillation conditions, 2 to 10% by mass of polymer components is removed from raw rosin as a pitch ingredient, and also 2 to 10% by mass of initial distilled ingredients is removed.

The softening temperature of the unmodified rosin is preferably 50° C. to 100° C., more preferably 60° C. to 90° C., still more preferably 65° C. to 85° C. The softening temperature of rosin means one measured by the method described in Examples later in a way that a rosin is once melted followed by allowing to cool in an atmosphere of temperature 25° C. and relative humidity 50% for one hour and then the softening temperature is measured.

The acid value of the unmodified rosin is preferably 100 to 200 mgKOH/g, more preferably 130 to 180 mgKOH/g, still more preferably 150 to 170 mgKOH/g. The acid value of rosin may be measured in accordance with the method described in JIS K0070, for example.

From the viewpoint of low temperature fixing ability, the content of the (meth)acrylic acid-modified rosin is preferably no less than 5% by mass based on the carboxylic acid component, more preferably no less than 10% by mass; and from the viewpoint of storage stability, the content is preferably no more than 85% by mass, more preferably no more than 65% by mass, still more preferably no more than 50% by mass. From these viewpoints, the content of the (meth)acrylic acid-modified rosin is preferably 5 to 85% by mass based on the carboxylic acid component, more preferably 5 to 65% by mass, still more preferably 10 to 50% by mass.

The carboxylic acid other than the (meth)acrylic acid-modified rosin within the carboxylic acid component may be properly selected depending on the application; examples thereof include aliphatic dicarboxylic acids such as oxalic acid, malonic acid, maleic acid, (meth)acrylic acid, citraconic acid, itaconic acid, glutaconic acid, succinic acid, adipic acid, sebacic acid, azelaic acid, n-dodecylsuccinic acid, and dodecenylsuccinic acid; aromatic dicarboxylic acids such as phthalic acid, isophthalic acid, and terephthalic acid; cycloaliphatic dicarboxylic acid such as cyclohexane dicarboxylic acid; polyvalent carboxylic acids such as trimellitic acid and pyromellitic acid; and anhydrides and alkylesters (carbon number: 1 to 3). In this specification, the carboxylic acid compound entirely encompasses these acids, acid anhydrides, and alkyl esters of these acids.

In the second aspect of the present invention, the toner comprises a binder resin and a colorant, preferably a release agent, a charge control agent, an external additive, and also other optional ingredients.

Binder Resin

The binder resin comprises a polyester resin prepared by condensation polymerization, preferably in the presence of esterification catalyst, between an alcohol component and a carboxylic acid component that contains fumaric acid-modified rosin, and also optional other components.

In the toner of the second aspect of the present invention, the fumaric acid-modified rosin as the carboxylic acid component may make possible to fix at remarkably lower temperatures and to increase storage stability.

The conventional polyester resin, produced from a plenty amount of maleic acid-modified rosin as a carboxylic acid component for the purpose of improving fixing ability, contains a significant amount of higher molecular weight components effective for durability, and also a significant amount of low molecular weight components deleterious for durability, thus the durability is insufficient. When the amount of the maleic acid-modified rosin is decreased, there tends to appear a problem of poor low temperature fixing ability in the resulting polyester resin.

On the contrary, the fumaric acid-modified rosin in the second aspect has a remarkably high glass transition temperature Tg compared to conventional rosin and maleic acid-modified rosin, therefore, it is assumed that a surprising effect may be taken to satisfy all of the low temperature fixing ability, offset resistance, and storage stability that are typically conflictive properties each other.

Carboxylic Acid Component

The fumaric acid-modified rosin is utilized as a carboxylic acid component of the polyester resin. The fumaric acid-modified rosin is a rosin modified by fumaric acid, and may be prepared by an addition reaction of a rosin having a main component of abietic acid, neoabietic acid, parastoline acid, pimaric acid, isopimaric acid, sandarac pimaric acid, dehydroabietic acid, or levopimaric acid with fumaric acid. More specifically, the fumaric acid-modified rosin may be prepared through Diels-Alder reaction between levopimaric acid, abietic acid, neoabietic acid, or parastoline acid that has a conjugated double bond in rosin and fumaric acid under a heating condition.

The modification degree of rosin by the fumaric acid (fumaric acid-modification degree) is preferably 5 to 105, more preferably 20 to 105, still more preferably 40 to 105, particularly preferably 60 to 105 from the viewpoint of higher molecular weight and higher glass transition temperatures of the polyester resin. The modification degree of rosin by fumaric acid, i.e. fumaric acid-modification degree, (referred to as "MD by FA") is calculated from the Formula (1B):

$$MD \text{ by } FA = \frac{X_1 - Y}{X_2 - Y} \times 100$$

In the Formula (1B), $X_1$ represents an SP value of fumaric acid-modified rosin to be calculated for the modification degree; $X_2$ represents an SP value of fumaric acid-modified rosin obtained by reaction between one mole of fumaric acid and 0.7 mole of rosin; Y is an SP value of rosin.

The SP value described above indicates a softening temperature that is measured by use of the softening point meter of annulus ring type explained in Examples later. The numerator ($X_1$−Y) in Formula (1B) means a rising degree of SP value of fumaric acid-modified rosin. The larger is the modification degree expressed by the Formula (1B), the higher is the modification level.

From the viewpoint of enhancing storage stability of the resulting polyester resin, the glass transition temperature Tg of the fumaric acid-modified is preferably 40° C. to 90° C., more preferably 45° C. to 85° C., still more preferably 50° C. to 80° C. The glass transition temperature of the fumaric acid-modified rosin may be measured by the method described in Examples later, for example.

The method for producing the fumaric acid-modified rosin may be properly selected depending on the application; for example, rosin and fumaric acid are mixed and heated to about 180° C. to 260° C., then fumaric acid is addition-reacted to an acid with a conjugated double bond within the rosin through Diels-Alder reaction thereby to obtain the fumaric acid-modified rosin.

From the viewpoint of effective reaction between rosin and fumaric acid, it is preferred that the rosin and fumaric acid are reacted in the presence of phenol compounds. The phenol compounds are preferably divalent phenol compounds or phenolic compounds that have a substituent at least on the ortho position in relation to hydroxide group (hereinafter referred to as "hindered phenol"), and particularly preferable are the hindered phenol.

The divalent phenol compounds are those compounds having two OH groups exclusively attached to a benzene ring, in particular hydroquinone is preferable. The hindered phenol may be properly selected depending on the application; examples thereof include mono-t-butyl-p-cresol, mono-t-butyl-m-cresol, t-butylcatechol, 2,5-di-t-butylhydroquinone, 2,5-di-t-amylhydroquinone, propylgallate, 4,4'-methylenebis(2,6-t-butylphenol), 4,4'-isopropylidenebis(2,6-di-t-butylphenol), 4,4'-butylidenebis(3-methyl-6-t-butylphenol), butylhydroxy anisole, 2,6-di-t-butyl-p-cresol, 2,6-di-t-butylphenol, 2,6-di-t-butyl-4-ethylphenol, 2,4,6-tri-t-butylphenol, octadecyl-3-(4-hydroxy-3',5'-di-t-butylphenyl)propionate, distearyl(4-hydroxy-3-methyl-5-t-butyl) benzylmalonate, 6-(4-hydroxy-3,5-di-t-butylanilino)-2,4-bisoctylthio-1,3,5-triazine, 2,6-diphenyl-4-octadecanoxyphenol, 2,2'-methylenebis(4-methyl-6-t-butylphenol), 2,2'-methylenebis(4-ethyl-6-t-butylphenol), 2,2'-isobutylidenebis(4,6-dimethylphenol), 2,2'-dihydroxy-3,3'-di-(alpha-methylcyclohexyl)-5,5'-dimethyldiphenylmethane, 2,2'-methylenebis(4-methyl-6-cyclohexylphenol), tris[beta-(3,5-di-t-butyl-4-hydroxyphenyl)propionyloxyethyl]-isocyanurate, 1,3,5-tris(2,6-dimethyl-3-hydroxy-4-t-butylbenzyl)isocyanurate, tris(3,5-di-t-butyl-4-hydroxyphenol)isocyanurate, 1,1,3'-tris(2-methyl-4-hydroxy-5-t-butylphenyl)butane, 2,6-bis(2'-hydroxy-3'-t-butyl-5'-methylbenzyl)-4-methylphenol, N,N'-hexamethylenebis(3,5-di-t-butyl-4-hydroxyhydrocinnamate), hexamethyleneglycolbis[beta-(3,5-di-t-butyl-4-hydroxyphenyl)-propionate], triethyleneglycolbis[beta-(3-t-butyl-5-methyl-4-hydroxyphenyl)-propionate], and tetrakis[methylene-3-(3,5-di-t-butyl-4-hydroxyphenyl)propionate]-methane. Among these, t-butylcatechol is preferable in particular.

The amount of the phenol compounds is preferably 0.001 to 0.5 part by mass based on 100 parts by mass of the raw monomer of fumaric acid-modified rosin, more preferably 0.003 to 0.1 part by mass, still more preferably 0.005 to 0.1 part by mass. The resulting fumaric acid-modified rosin may be used without further processing or purified before use by operations such as distillation.

The rosin used for the fumaric acid-modified rosin may be anything as long as being rosin such as natural rosin obtained from pines, isomerized rosin, dimerized rosin, polymerized rosin, and dismutated rosin, that contains, as its main component, abietic acid, neoabietic acid, parastoline acid, pimaric acid, isopimaric acid, sandarac pimaric acid, dehydroabietic acid, or levopimaric acid; preferably, the rosin is tall rosin produced from tall oil that is a by-product in production processes of natural rosin pulp, gum rosin obtained from neat pitch pine, or wood rosin obtained from cut stocks of pines in view of color sense, more preferable is tall rosin in view of low temperature fixing ability.

The fumaric acid-modified rosin has been reduced in terms of its odor, since impurities to generate the odor has been decreased through Diels-Alder reaction under a heating condition. In order to suppress the odor still further, it is preferred that the fumaric acid-modified rosin is prepared by modifying purified rosin with fumaric acid, more preferably by modifying purified tall rosin with fumaric acid.

The purified rosin means one that is reduced for its impurities through a purifying step. As such, purifying the rosin may remove impurities within the rosin. The main impurities are exemplified by 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, and 4-(1-methylethyl)benzaldehyde. Among these, in the present invention, three peak strengths of hexanoic acid, pentanoic acid, and benzaldehyde detected by a head space GC-MS method as volatile components may be employed as an index of purified rosin. The index based on the volatile components rather than absolute amount of impurities is derived from the fact that the purified rosin is employed in the invention for the purpose of improving odor over the previous polyester resins.

Specifically, the purified rosin indicates those having a peak strength of no more than $0.8\times10^7$ for hexanoic acid, a peak strength of no more than $0.4\times10^7$ for pentanoic acid, and a peak strength of no more than $0.4\times10^7$ for benzaldehyde measured by the head space GC-MS method under conditions described in Examples. From the viewpoint of storage stability and odor, the peak strength of hexanoic acid is preferably no more than $0.6\times10^7$, more preferably no more than $0.5\times10^7$; the peak strength of pentanoic acid is preferably no more than $0.3\times10^7$, more preferably no more than $0.2\times10^7$; and the peak strength of benzaldehyde is preferably no more than $0.3\times10^7$, more preferably no more than $0.2\times10^7$.

Moreover, it is preferred from the viewpoint of storage stability and odor that n-hexanal and 2-pentylfuran are also reduced in addition to the three compounds. The peak strength of n-hexanal is preferably no more than $1.7\times10^7$, more preferably no more than $1.6\times10^7$, still more preferably no more than $1.5\times10^7$. The peak strength of 2-pentylfuran is preferably no more than $1.0\times10^7$, more preferably no more than $0.9\times10^7$, still more preferably no more than $0.8\times10^7$.

The method for purifying rosin may be conventional ones such as distillation, recrystallization, and extraction, preferably, the rosin is purified by distillation. The distillation method may be vacuum distillation, molecular distillation, steam distillation, or the like as described in JP-A No. 07-286139, for example; it is preferred that the purification is carried out by vacuum distillation. The vacuum distillation is typically carried out under a pressure of no more than 6.67 kPa at 200° C. to 300° C. The vacuum distillation may be thin-film distillation or rectification distillation in addition to conventional simple distillation. Under typical distillation conditions, 2 to 10% by mass of polymer components is removed from raw rosin as a pitch ingredient, and also 2 to 10% by mass of initial distilled ingredients is removed.

The softening temperature of the unmodified rosin is preferably 50° C. to 100° C., more preferably 60° C. to 90° C., still more preferably 65° C. to 85° C. The softening temperature of rosin means one measured by the method described in Examples later in a way that a rosin is once melted followed by allowing to cool in an atmosphere of temperature 25° C. and relative humidity 50% for one hour and then the softening temperature is measured.

The glass transition temperature of the unmodified rosin is preferably 10° C. to 50° C., more preferably 15° C. to 50° C. from the viewpoint of the glass transition temperature of the fumaric acid-modified rosin.

The acid value of the unmodified rosin is preferably 100 to 200 mgKOH/g, more preferably 130 to 180 mgKOH/g, still more preferably 150 to 170 mgKOH/g. The acid value of rosin may be measured in accordance with the method described in JIS K0070, for example.

From the viewpoint of low temperature fixing ability, the content of the fumaric acid-modified rosin is preferably no less than 5% by mass based on the carboxylic acid component, more preferably no less than 8% by mass, still more preferably no less than 10% by mass; and from the viewpoint of storage stability, the content is preferably no more than 85% by mass, more preferably no more than 70% by mass, still more preferably no more than 60% by mass, particularly preferably no more than 50% by mass. From these viewpoints, the content of the fumaric acid-modified rosin is preferably 5 to 85% by mass based on the carboxylic acid component, more preferably 5 to 70% by mass, still more preferably 8 to 60% by mass, particularly preferably 10 to 50% by mass.

The carboxylic acid other than the fumaric acid-modified rosin within the carboxylic acid component may be properly selected depending on the application; examples thereof include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and dodecenylsuccinic acid; aromatic dicarboxylic acids such as phthalic acid, isophthalic acid, and terephthalic acid; cycloaliphatic dicarboxylic acid such as cyclohexane dicarboxylic acid; polyvalent carboxylic acids such as trimellitic acid and pyromellitic acid; and anhydrides and alkylesters (carbon number: 1 to 3). In this specification, the carboxylic acid compound entirely encompasses these acids, acid anhydrides, and alkyl esters of these acids.

In the third aspect of the present invention, the toner comprises a binder resin and a colorant, preferably a release agent, a charge control agent, an external additive, and also other optional ingredients.

Binder Resin

The binder resin comprises a polyester resin prepared by condensation polymerization, preferably in the presence of esterification catalyst, between an alcohol component that contains an aliphatic polyvalent alcohol and a carboxylic acid component that contains fumaric acid-modified rosin, and also optional other components.

In the toner according to the third aspect of the present invention, the fumaric acid-modified rosin as the carboxylic acid component may make possible to fix at remarkably lower temperatures and to increase storage stability. The conventional maleic acid-modified rosin with lower modification degrees in the prior art may act as a crosslinking agent by virtue of having three functional groups. When a polyester resin is prepared from the carboxylic acid component that contains much amounts of maleic acid-modified rosin for the purpose of higher fixing ability, higher contents of low molecular weight components as well as high molecular weight components make difficult to satisfy all of the low temperature fixing ability, offset resistance, and storage stability. On the other hand, lower amounts of the maleic acid-modified rosin degrade the low temperature fixing ability of the resulting polyester resin.

On the contrary, the fumaric acid-modified rosin available in the third aspect of the present invention may lead to less contents of low molecular weight components, by virtue of remarkably higher glass transition temperatures Tg, even though the rosin has three functional groups. In addition, the aliphatic polyvalent alcohol, available in the present invention, is of molecularly compact and reactive, thus the polyester resin may be produced with higher number-average molecular weight even in a combination of molecularly bulky and low reactive fumaric acid-modified rosin. That is, condensation polymerization between the alcohol component containing the aliphatic polyvalent alcohol and the carboxylic acid component containing fumaric acid-modified rosin may lead to the polyester resin that contains less contents of low molecular weight components and has high number average molecular weights, as such it is assumed that a surprising effect may be taken to satisfy all of the low temperature fixing ability, offset resistance, and storage stability that are typically conflictive properties each other, without deteriorating milling ability.

Carboxylic Acid Component

The fumaric acid-modified rosin is utilized as a carboxylic acid component of the polyester resin. The fumaric acid-modified rosin is a rosin modified by fumaric acid, and may be prepared by an addition reaction of a rosin having a main component of abietic acid, neoabietic acid, parastoline acid, pimaric acid, isopimaric acid, sandarac pimaric acid, dehydroabietic acid, or levopimaric acid with fumaric acid. More specifically, the fumaric acid-modified rosin may be prepared through Diels-Alder reaction between levopimaric acid, abietic acid, neoabietic acid, or parastoline acid that has a conjugated double bond in rosin and fumaric acid under a heating condition.

The modification degree of rosin by the fumaric acid (fumaric acid-modification degree) is preferably 5 to 105, more preferably 20 to 105, still more preferably 40 to 105, particularly preferably 60 to 105 from the viewpoint of higher molecular weight of the polyester resin and higher glass transition temperature. The modification degree of rosin by fumaric acid, i.e. fumaric acid-modification degree, (referred to as "MD by FA") is calculated from the Formula (1C):

$$MD \text{ by } FA = \frac{X_1 - Y}{X_2 - Y} \times 100$$

In the Formula (1C), $X_1$ represents an SP value of fumaric acid-modified rosin to be calculated for the modification degree; $X_2$ represents a saturated SP value of fumaric acid-modified rosin obtained by reaction between one mole of fumaric acid and 0.7 mole of rosin; Y is an SP value of rosin.

The SP value described above indicates a softening temperature that is measured by use of the softening point meter of annulus ring type explained in Examples later. The numerator ($X_1$−Y) in Formula (1C) means a rising degree of SP value of fumaric acid-modified rosin. The larger is the modification degree expressed by the Formula (1C), the higher is the modification level.

From the viewpoint of enhancing storage stability of the resulting polyester resin, the glass transition temperature Tg of the fumaric acid-modified is preferably 40° C. to 90° C., more preferably 45° C. to 85° C., still more preferably 50° C. to 80° C. The glass transition temperature of the fumaric acid-modified rosin may be measured by the method described in Examples later, for example.

The method for producing the fumaric acid-modified rosin may be properly selected depending on the application; for example, rosin and fumaric acid are mixed and heated to about 180° C. to 260° C., then fumaric acid is addition-reacted to an acid with a conjugated double bond within the rosin through Diels-Alder reaction thereby to obtain the fumaric acid-modified rosin.

From the viewpoint of effective reaction between rosin and fumaric acid, it is preferred that the rosin and fumaric acid are reacted in the presence of phenol compounds. The phenol compounds are preferably divalent phenol compounds or phenolic compounds that have a substituent at least on the ortho position in relation to hydroxide group (hereinafter referred to as "hindered phenol"), and particularly preferable are the hindered phenol.

The divalent phenol compounds are those compounds having two OH groups exclusively attached to a benzene ring, in particular hydroquinone is preferable. The hindered phenol may be properly selected depending on the application; examples thereof include mono-t-butyl-p-cresol, mono-t-butyl-m-cresol, t-butylcatechol, 2,5-di-t-butylhydroquinone, 2,5-di-t-amylhydroquinone, propylgallate, 4,4'-methylenebis(2,6-t-butylphenol), 4,4'-isopropylidenebis(2,6-di-t-butylphenol), 4,4'-butylidenebis(3-methyl-6-t-butylphenol), butylhydroxy anisole, 2,6-di-t-butyl-p-cresol, 2,6-di-t-butylphenol, 2,6-di-t-butyl-4-ethylphenol, 2,4,6-tri-t-butylphenol, octadecyl-3-(4-hydroxy-3',5'-di-t-butylphenyl)propionate, distearyl(4-hydroxy-3-methyl-5-t-butyl)benzylmalonate, 6-(4-hydroxy-3,5-di-t-butylanilino)-2,4-bisoctylthio-1,3,5-triazine, 2,6-diphenyl-4-octadecanoxyphenol, 2,2'-methylenebis(4-methyl-6-t-butylphenol), 2,2'-methylenebis(4-ethyl-6-t-butylphenol), 2,2'-isobutylidenebis(4,6-dimethylphenol), 2,2'-dihydroxy-3,3'-di-(alpha-methylcyclohexyl)-5,5'-dimethyldiphenylmethane, 2,2'-methylenebis(4-methyl-6-cyclohexylphenol), tris[beta-(3,5-di-t-butyl-4-hydroxyphenyl)propionyloxyethyl]-isocyanurate, 1,3,5-tris(2,6-dimethyl-3-hydroxy-4-t-butylbenzyl)isocyanurate, tris(3,5-di-t-butyl-4-hydroxyphenol)isocyanurate, 1,1,3'-tris(2-methyl-4-hydroxy-5-t-butylphenyl)butane, 2,6-bis(2'-hydroxy-3'-t-butyl-5'-methylbenzyl)-4-methylphenol, N,N'-hexamethylenebis(3,5-di-t-butyl-4-hydroxyhydrocinnamate), hexamethyleneglycolbis[beta-(3,5-di-t-butyl-4-hydroxyphenyl)-propionate], triethyleneglycolbis[beta-(3-t-butyl-5-methyl-4-hydroxyphenyl)-propionate], and tetrakis[methylene-3-(3,5-di-t-butyl-4-hydroxyphenyl)propionate]-methane. Among these, t-butylcatechol is preferable in particular.

The amount of the phenol compounds is preferably 0.001 to 0.5 part by mass based on 100 parts by mass of the raw monomer of fumaric acid-modified rosin, more preferably 0.003 to 0.1 part by mass, still more preferably 0.005 to 0.1 part by mass. The resulting fumaric acid-modified rosin may be used without further processing or purified before use by operations such as distillation.

The rosin used for the fumaric acid-modified rosin may be anything as long as being rosin such as natural rosin obtained from pines, isomerized rosin, dimerized rosin, polymerized rosin, and dismutated rosin, that contains, as its main component, abietic acid, neoabietic acid, parastoline acid, pimaric acid, isopimaric acid, sandarac pimaric acid, dehydroabietic acid, or levopimaric acid; preferably, the rosin is tall rosin produced from tall oil that is a by-product in production processes of natural rosin pulp, gum rosin obtained from neat pitch pine, or wood rosin obtained from cut stocks of pines in view of color sense, more preferable is tall rosin in view of low temperature fixing ability.

The fumaric acid-modified rosin has been reduced in terms of its odor, since impurities to generate the odor has been decreased through Diels-Alder reaction under a heating condition. In order to suppress the odor still further, it is preferred that the fumaric acid-modified rosin is prepared by modifying purified rosin with fumaric acid, more preferably by modifying purified tall rosin with fumaric acid.

The purified rosin means one that is reduced for its impurities through a purifying step. As such, purifying the rosin may remove impurities within the rosin. The main impurities are exemplified by 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, and 4-(1-methylethyl)benzaldehyde. Among these, in the present invention, three peak strengths of hexanoic acid, pentanoic acid, and benzaldehyde detected by a head space GC-MS method as volatile components may be employed as an index of purified rosin. The index based on the volatile components rather than absolute amount of impurities is derived from the fact that the purified rosin is employed in the invention for the purpose of improving odor over the previous polyester resins.

Specifically, the purified rosin indicates those having a peak strength of no more than $0.8\times10^7$ for hexanoic acid, a peak strength of no more than $0.4\times10^7$ for pentanoic acid, and a peak strength of no more than $0.4\times10^7$ for benzaldehyde measured by the head space GC-MS method under conditions described in Examples. From the viewpoint of storage stability and odor, the peak strength of hexanoic acid is preferably no more than $0.6\times10^7$, more preferably no more than $0.5\times10^7$; the peak strength of pentanoic acid is preferably no more than $0.3\times10^7$, more preferably no more than $0.2\times10^7$; and the peak strength of benzaldehyde is preferably no more than $0.3\times10^7$, more preferably no more than $0.2\times10^7$.

Moreover, it is preferred from the viewpoint of storage stability and odor that n-hexanal and 2-pentylfuran are also reduced in addition to the three compounds. The peak strength of n-hexanal is preferably no more than $1.7\times10^7$, more preferably no more than $1.6\times10^7$, still more preferably no more than $1.5\times10^7$. The peak strength of 2-pentylfuran is preferably no more than $1.0\times10^7$, more preferably no more than $0.9\times10^7$, still more preferably no more than $0.8\times10^7$.

The method for purifying rosin may be conventional ones such as distillation, recrystallization, and extraction, preferably, the rosin is purified by distillation. The distillation method may be vacuum distillation, molecular distillation, steam distillation, or the like as described in JP-A No. 07-286139, for example; it is preferred that the purification is carried out by vacuum distillation. The vacuum distillation is typically carried out under a pressure of no more than 6.67 kPa at 200° C. to 300° C. The vacuum distillation may be thin-film distillation or rectification distillation in addition to conventional simple distillation. Under typical distillation conditions, 2 to 10% by mass of polymer components is removed from raw rosin as a pitch ingredient, and also 2 to 10% by mass of initial distilled ingredients is removed.

The softening temperature of the unmodified rosin is preferably 50° C. to 100° C., more preferably 60° C. to 90° C., still more preferably 65° C. to 85° C. The softening temperature of rosin means one measured by the method described in Examples later in a way that a rosin is once melted followed by allowing to cool in an atmosphere of temperature 25° C. and relative humidity 50% for one hour and then the softening temperature is measured.

The glass transition temperature of the unmodified rosin is preferably 10° C. to 50° C., more preferably 15° C. to 50° C. from the viewpoint of the glass transition temperature of the fumaric acid-modified rosin.

The acid value of the unmodified rosin is preferably 100 to 200 mgKOH/g, more preferably 130 to 180 mgKOH/g, still more preferably 150 to 170 mgKOH/g. The acid value of rosin may be measured in accordance with the method described in JIS K0070, for example.

From the viewpoint of low temperature fixing ability, the content of the fumaric acid-modified rosin is preferably no less than 5% by mass based on the carboxylic acid component, more preferably no less than 8% by mass, still more preferably no less than 10% by mass; and from the viewpoint of storage stability, the content is preferably no more than 85% by mass, more preferably no more than 70% by mass, still more preferably no more than 60% by mass, particularly preferably no more than 50% by mass. From these viewpoints, the content of the fumaric acid-modified rosin is preferably 5 to 85% by mass based on the carboxylic acid component, more preferably 5 to 70% by mass, still more preferably 8 to 60% by mass, particularly preferably 10 to 50% by mass.

The carboxylic acid other than the fumaric acid-modified rosin within the carboxylic acid component may be properly selected depending on the application; examples thereof include aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and dodecenylsuccinic acid; aromatic dicarboxylic acids such as phthalic acid, isophthalic acid, and terephthalic acid; cycloaliphatic dicarboxylic acid such as cyclohexane dicarboxylic acid; polyvalent carboxylic acids such as trimellitic acid and pyromellitic acid; and anhydrides and alkylesters (carbon number: 1 to 3). In this specification, the carboxylic acid compound entirely encompasses these acids, acid anhydrides, and alkyl esters of these acids.

Alcohol Component

The alcohol components in the first and the third aspects comprise an aliphatic polyvalent alcohol. The aliphatic polyvalent alcohol is preferably those from divalent to hexavalent, more preferably divalent or trivalent from the viewpoint of reactivity with the carboxylic acid that contains (meth)acrylic acid-modified rosin.

It is preferred that the aliphatic polyvalent alcohol contains those having a carbon number of 2 to 6 that are molecularly compact and highly reactive. Examples of the aliphatic polyvalent alcohol having a carbon number of 2 to 6 include ethylene glycol, neopentyl glycol, 1,2-propanediol, 1,3-propanediol, 1,4-butanediol, 1,6-hexanediol, 2,3-butanediol, pentaerythritol, trimethylolpropane, sorbitol, and glycerin. These may be use alone or in combination. Among these, 1,2-propanediol, 1,3-propanediol, and glycerin are preferable in particular.

The content of the aliphatic polyvalent alcohol having a carbon number of 2 to 6 is preferably no less than 60% by mole in the entire aliphatic polyvalent alcohol, more preferably no less than 80% by mole, still more preferably no less than 90% by mole, particularly preferable is 100% by mole substantially.

Alcohol compounds, other than the aliphatic polyvalent alcohols, contained in the alcohol component may be properly selected depending on the application; examples of the alcohol compounds are alkylene (carbon number: 2 to 3) oxide (average added mole number: 1 to 16) adducts of bisphenol A such as polyoxypropylene-2,2-bis(4-hydroxyphenyl)propane and polyoxyethylene-2,2-bis(4-hydroxyphenyl)propane; 1,4-cyclohexanedimethanol, hydrogenated bisphenol A, and alkylene (carbon number: 2 to 4) oxide (average added mole number: 1 to 16) adducts thereof.

From the viewpoint of reactivity with (meth)acrylic acid-modified rosin, the content of the aliphatic polyvalent alcohol is preferably no less than 50% by mole in the alcohol component, more preferably no less than 60%, still more preferably no less than 85%, particularly preferable is 100% substantially.

From the viewpoint to improve offset resistance, the polyester resin may contain at least one of polyvalent alcohols of trivalent or more and polyvalent carboxylic acids of trivalent or more as a monomer of raw material within a non-harmful range for storage stability. It is preferred that the polyvalent alcohol of trivalent or more is included in the alcohol component and the polyvalent carboxylic acid of trivalent or more is included in the carboxylic acid component. The (meth) acrylic acid-modified rosin, in the present invention, is a rosin having two functional groups, therefore, a monomer of raw material of trivalent or more may be used without degrading the low temperature fixing ability of rosin and also the offset resistance may be increased while maintaining the low temperature fixing ability. From these viewpoint, it is preferred that the content of the polyvalent carboxylic acid of trivalent or more is 0.001 to 40 moles based on 100 moles of the alcohol component, more preferably 0.1 to 25 moles; the content of the polyvalent alcohol of trivalent or more is 0.001 to 40% by mole based on of the alcohol component, more preferably 0.1 to 25% by mole.

For example, the polyvalent carboxylic acid of trivalent or more is trimellitic acid and derivatives thereof; the polyvalent alcohol of trivalent or more is glycerin, trimethylolpropane, sorbitol, or alkylene (carbon number: 2 to 4) oxide (average added mole number: 1 to 16) adducts thereof. Among these, glycerin, trimellitic acid, derivatives thereof are particularly preferable by reason of forming a branched site, acting as a crosslinker, and effectively improving the low temperature fixing ability.

The alcohol component in the second aspect of the present invention may be properly selected from alcohol components conventionally utilized for condensation polymerization of polyester resins. Preferably, the alkylene oxide adducts of bisphenol A expressed by the Structural Formula (I):

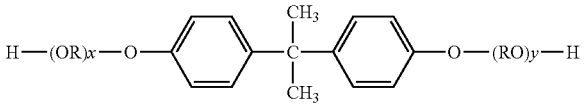

are employed in view of charging ability and durability. In the Structural Formula (I), RO represents an alkylene oxide; R represents an alkylene group of 2 or 3 carbon atoms; x and y are each a positive number that represents an average mole number of added alkylene oxide; sum of x plus y is preferably 1 to 16, more preferably 1 to 8, still more preferably 1.5 to 4.

The alkylene oxide adducts of bisphenol A expressed by the Structural Formula (I) are exemplified by alkylene (carbon number: 2 or 3) oxide (average added mole number: 1 to 16) adducts of bisphenol A such as polyoxypropylene(2.2)-2,2-bis(4-hydroxyphenyl)propane and polyoxyethylene (2.2)-2,2-bis(4-hydroxyphenyl)propane.

The content of the alkylene oxide adducts of bisphenol A expressed by the Structural Formula (I) is preferably no less than 30% by mole in the alcohol component, more preferably no less than 50% by mole, still more preferably no less than 80% by mole, particularly preferable is 100% by mole substantially.

The other alcohol component is exemplified by ethylene glycol, propylene glycol, neopentyl glycol, glycerin, pentaerythritol, trimethylolpropane, hydrogenated bisphenol A, sorbitol, and alkylene (carbon number: 2 to 4) oxide (average added mole number: 1 to 16) adducts thereof.

From the viewpoint to reduce residual monomers and to improve fixing ability, the polyester resin may contain at least one of polyvalent alcohols of trivalent or more and polyvalent carboxylic acids of trivalent or more as a monomer of raw material within a non-harmful range for storage stability. It is preferred that the polyvalent alcohol of trivalent or more is included in the alcohol component and the polyvalent carboxylic acid of trivalent or more is included in the carboxylic acid component. From the viewpoint of storage stability and residual monomers, it is preferred that the content of the polyvalent carboxylic acid of trivalent or more is 0.001 to 40 moles based on 100 moles of the alcohol component, more preferably 0.1 to 25 moles; the content of the polyvalent alcohol of trivalent or more is 0.001 to 40% by mole based on of the alcohol component, more preferably 0.1 to 25% by mole.

Concerning monomers of raw material of trivalent or more, for example, the polyvalent carboxylic acid of trivalent or more is trimellitic acid and derivatives thereof; the polyvalent alcohol of trivalent or more is glycerin, trimethylolpropane, sorbitol, or alkylene (carbon number: 2 to 4) oxide (average added mole number: 1 to 16) adducts thereof. Among these, glycerin, trimellitic acid, derivatives thereof are particularly preferable by reason of forming a branched site, acting as a crosslinker, or effectively improving the low temperature fixing ability.

Esterification Catalyst

It is preferred that the condensation polymerization between the alcohol component and the carboxylic acid component is carried out under the presence of an esterification catalyst. The esterification catalyst is exemplified by titanium compounds and tin (II) compounds having no Sn—C bond. These catalysts may be used alone or in combination.

The titanium compound is preferably those having a Ti—O bond, more preferably having an alkoxy group, an alkenyloxy, or an acyloxy group of 1 to 28 carbon atoms in total.

Examples of the titanium compound include titaniumdiisopropylate bistriethanolaminato $Ti(C_6H_{14}O_3N)_2(C_3H_7O)_2$, titaniumdiisopropylate bisdiethanolaminato $Ti(C_4H_{10}O_2N)_2(C_3H_7O)_2$, titaniumdipentylate bistriethanolaminato $Ti(C_6H_{14}O_3N)_2(C_5H_{11}O)_2$, titaniumdiethylate bistriethanolaminato $Ti(C_6H_{14}O_3N)_2(C_2H_5O)_2$, titaniumdihydroxy octylatebistriethanolaminato $Ti(C_6H_{14}O_3N)_2(OHC_8H_{16}O)_2$, titaniumdistearate bistriethanolaminato $Ti(C_6H_{14}O_3N)_2(C_{18}H_{37}O)_2$, titaniumtriisopropylate triethanolaminato $Ti(C_6H_{14}O_3N)(C_3H_7O)_3$, and titanium monopropylatetris (triethanolaminato) $Ti(C_6H_{14}O_3N)_3(C_3H_7O)$. Among these, titaniumdiisopropylate bistriethanolaminato, titaniumdiisopropylate bisethanolaminato, and titanium dipentylate bistriethanolaminato are preferable in particular. These may be commercially available from Matsumoto Trading Co., for example.

Specific examples of the other preferable titanium compounds are tetra-n-butyltitanate $Ti(C_4H_9O)_4$, tetrapropyltitanate $Ti(C_3H_7O)_4$, tetrastearyltitanate $Ti(C_{18}H_{37}O)_4$, tetramyristyltitanate $Ti(C_{14}H_{29}O)_4$, tetraoctyltitanate $Ti(C_8H_{17}O)_4$, dioctyldihydroxyoctyltitanate $Ti(C_8H_{17}O)_2(OHC_8H_{16}O)_2$, and dimyristyldioctyltitanate $Ti(C_{14}H_{29}O)_2(C_8H_{17}O)_2$; among these, tetrastearyltitanate, tetramyristyltitanate, tetraoctyltitanate, and dioctyldihydroxyoctyltitanate are preferable. These may be synthesized by reaction of halogenated titanium and corresponding alcohols, or commercially available from Nisso Co., for example.

The amount of the titanium compound is preferably 0.01 to 1.0 part by mass based on 100 parts by mass of the total of the alcohol component and the carboxylic acid component, more preferably 0.1 to 0.7 parts by mass.

The tin (II) compound having no Sn—C bond described above is preferably tin (II) compounds having an Sn—O bond or tin (II) compounds having an Sn—X bond (X: halogen atoms), more preferably tin (II) compounds having an Sn—O bond.

The tin (II) compounds having an Sn—O bond are exemplified by tin (II) carboxylates of 2 to 28 carbon atoms such as tin (II) oxalate, tin (II) diacetate, tin (II) dioctanate, tin (II) dilaurate, tin (II) distearate, and tin (II) dioleate; tin (II) dialkoxide of 2 to 28 carbon atoms such as dioctyloxy tin (II), dilauryloxy tin (II), distearyloxy tin (II), and dioleyloxy tin (II); tin (II) oxide, and tin (II) sulfate.

The tin (II) compounds having an Sn—X bond (X: halogen atoms) are exemplified by halogenated tin (II) such as tin (II) chloride and tin (II) bromide; in particular, tin (II) fatty acid expressed by $(R^1COO)_2Sn$ ($R^1$: alkyl or alkenyl group of 5 to 19 carbon atoms), $(R^2O)_2Sn$ ($R^2$: alkyl or alkenyl group of 6 to 20 carbon atoms), and tin (II) oxide expressed by SnO are preferable in view of an effect at initial charging and catalytic ability; tin (II) fatty acid expressed by $(R^1COO)_2Sn$ and tin (II) oxide are more preferable; tin (II) dioctanate, tin (II) distearate, and tin (II) oxide are more preferable.

The amount of the tin (II) compound having no Sn—C bond is preferably 0.01 to 1.0 part by mass based on 100 parts by mass of the total of the alcohol component and the carboxylic acid component, more preferably 0.1 to 0.7 parts by mass.

When the titanium compound and the tin (II) compound having no Sn—C bond are used together, the total amount of the titanium compound and the tin (II) compound is preferably 0.01 to 1.0 part by mass based on 100 parts by mass of the total of the alcohol component and the carboxylic acid component, more preferably 0.1 to 0.7 part by mass.

The condensation polymerization of the alcohol component and the carboxylic acid component may be carried out at 180° C. to 250° C. under inert atmosphere in the presence of the esterification catalyst.

The softening temperature of the polyester resin is preferably 90° C. to 160° C., more preferably 95° C. to 155° C., still more preferably 100° C. to 150° C. from the viewpoint of fixing ability, storage stability, and durability.

The glass transition temperature of the polyester resin is preferably 45° C. to 75° C., more preferably 50° C. to 75° C., still more preferably 50° C. to 70° C. from the viewpoint of fixing ability, storage stability, and durability.

The acid value of the polyester resin is preferably 1 to 80 mgKOH/g, more preferably 5 to 60 mgKOH/g, still more preferably 5 to 50 mgKOH/g from the viewpoint of charging ability and environmental stability.

The hydroxyl value of the polyester resin is preferably 1 to 80 mgKOH/g, more preferably 8 to 50 mgKOH/g, still more preferably 8 to 40 mgKOH/g from the viewpoint of charging ability and environmental stability.

It is preferred in the polyester resin that the content of low molecular weight components, having a molecular weight of no more than 500, such as monomers or oligomers is no more than 12% in the polyester resin, more preferably no more than 10%, still more preferably no more than 9%, particularly preferably no more than 8%. The content of the low molecular weight components may be reduced by way of increasing the modulation rate of rosin by (meth)acrylic acid, for example.

The polyester resin may be modified ones in a range of substantially not diminishing the inherent properties. The modified polyester resin may be grafted or blocked polyester resins using phenol, urethane, or epoxy by the methods described in JP-A Nos. 11-133668, 10-239903, 08-20636, for example.

The present invention may provide toner with superior properties in fixing ability, offset resistance, and storage stability, and also reduced odor at fixing by means of the polyester resin as the toner binder resin.

The toner may contain other optional conventional resins such as vinyl resins like styrene-acrylic resins, polycarbonate resins, and polyurethane resins; the content of the polyester resin in the binder resin is preferably no more than 70% by mass, more preferably no less than 80% by mass, still more preferably no less than 90% by mass, particularly preferable is 100% by mass substantially.

The colorant may be selected from conventional dyes and pigments depending on the application; examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone. These may be used singly or in combination.

The color of the coloring agent may be properly selected depending on the purpose, and may be those for monochrome or color.

Examples of black colorants include carbon black (C.I. pigment black 7) such as furnace black, lamp black, acetylene black, and channel black; metals such as copper iron (C.I. pigment black 11) and titanium oxide; organic pigments such as aniline black (C.I. pigment black 1).

Examples of magenta colorants include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; C.I.; C.I. Vat Red 1, 2, 10, 13, 15, 23, 29, and 35.

Examples of cyan colorants include C.I. Pigment Blue 2, 3, 15, 15:1, 15:2, 15:3, 15:4, 15:6, 16, 17, and 60; C.I. Vat Blue 6; C.I. Acid Blue 45 or Cu phthalocyanine pigments with a phthalocyanine skeleton having 1 to 5 substituted phthalimide methyl groups; Green 7, and Green 36.

Examples of magenta colorants include yellow pigments include C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, and 180; C.I. Vat Yellow 1, and 3, 20; Orange 36.

The content of the colorant in the toner may be properly selected depending on the application; preferably, the content is 1% by mass to 15% by mass, and more preferably 3% by mass to 10% by mass. When the content is less than 1% by mass, tinting strength of the colorant is insufficient, and when the content is more than 15% by mass, pigment dispersion is likely to be insufficient in the toner, resulting in degradation of tinting strength or electric properties of the toner.

The colorants may be combined with resins to form masterbatches. Such resins may be properly selected depending on the application; examples thereof include polymers of styrene or substituted styrenes, styrene copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyral, polyacrylic acid resins, rosin, modified rosins, terpene resins, aliphatic or alicyclic hydrocarbon resins, aromatic petroleum resins, chlorinated paraffin, paraffin, and the like. These may be used alone or in combination.

Examples of polymers of styrene or substituted styrenes include polyester resin, polystyrene, poly-p-chlorostyrene, polyvinyl toluene, and the like. Examples of styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl alpha-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and the like.

The masterbatch may be produced by mixing and kneading resins for the masterbatch and a colorant with high shear force. In order to improve interaction between colorant and a resin, an organic solvent may be used. In addition, the "flushing process" in which a wet cake of colorant being applied directly is preferable because drying is unnecessary. In the flushing process, a water-based paste containing colorant and water is mixed and kneaded with the resin and an organic solvent so that the colorant migrates towards the resin, and that water and the organic solvent are removed. The materials are preferably mixed and kneaded using a triple roll mill and other high-shear dispersing devices.

The release agent may be properly selected from conventional ones, and is exemplified by waxes. Examples of wax include carbonyl group-containing waxes, polyolefin waxes, long-chain hydrocarbons, and the like. These may be used alone or in combination. Among these, carbonyl group-containing waxes are preferable.

Examples of the carbonyl group-containing wax include polyalkanoic acid esters, polyalkanol esters, polyalkanoic acid amides, polyalkyl amides, dialkyl ketones, and the like. Examples of the polyalkanoic esters include carnauba wax, montan wax, trimethylolpropane tribehenate, pentaerythritol tetrabehenate, pentaerythritol diacetate dibehenate, glycerin tribehenate, 1,18-octadecan diol distearate, and the like. Examples of the polyalkanol esters include trimellitic tristearate, distearyl maleate, and the like. Examples of the polyalkanoic acid amides include behenyl amide and the like. Examples of the polyalkyl amides include trimellitic acid tristearyl amide, and the like. Examples of the dialkyl ketones include distearyl ketone, and the like. Among these carbonyl group-containing waxes, the polyalkanoic acid esters are particularly preferable.

Examples of polyolefin wax include polyethylene wax, polypropylene wax, and the like. Examples of long-chain hydrocarbon include paraffin wax, Sasol wax, and the like.

The melting point of the release agent may be properly selected depending on the application; preferably, the melting point is 40° C. to 160° C., more preferably 50° C. to 120° C., and most preferably 60° C. to 90° C. When the melting point is below 40° C., the wax may adversely affect high-temperature preservability; and when the melting point is above 160° C., it is liable to cause cold offset at fixing processes under lower temperatures.

The viscosity of the melted release agent is, measured at the temperature 20° C. higher than the melting point of the wax, preferably 5 cps to 1000 cps, and more preferably 10 cps to 100 cps. In cases where the viscosity is less than 5 cps, releasing ability may be deteriorated, and when the melt viscosity is more than 1000 cps, the offset resistance and the low-temperature fixing ability may not be improved sufficiently.

The content of the release agent in the toner may be properly selected depending on the application; preferably, the content is 0% by mass to 40% by mass, and more preferably 3% by mass to 30% by mass. When the content is more than 40% by mass, the toner flowability may be deteriorated.

The charge control agent may be properly selected depending on the application; preferably, the charge control agent is preferably colorless or white so as to be free from affecting the color tone. Examples of charge control agent include triphenylmethane dyes, molybdic acid chelate pigments, rhodamine dyes, alkoxy amines, quaternary ammonium salts such as fluoride-modified quaternary ammonium salts, alkylamide, phosphoric monomer or compound thereof, tungsten monomer or compounds thereof, fluoride activators, salicylic acid metallic salts, metallic salts of salicylic acid derivative, and the like. These may be used alone or in combination.

The charge control agent may be of commercially available ones. Specific examples thereof include Bontron P-51 of a quaternary ammonium salt, Bontron E-82 of an oxynaphthoic acid metal complex, Bontron E-84 of a salicylic acid metal complex and Bontron E-89 of a phenol condensate (Orient Chemical Industries, Ltd.); TP-302 and TP-415 of a quaternary ammonium salt molybdenum metal complex (by Hodogaya Chemical Co.); Copy Charge PSY VP2038 of a quaternary ammonium salt, Copy Blue PR of a triphenylmethane derivative and Copy Charge NEG VP2036 and Copy Charge NX VP434 of a quaternary ammonium salt (by Hoechst Ltd.); LRA-901, and LR-147 of a boron metal complex (by Japan Carlit Co., Ltd.); quinacridone, azo pigment, and other high-molecular mass compounds having functional group of sulfonic acid, carboxyl, quaternary ammonium salt, or the like.

The charge control agent may be dissolved and/or dispersed in the toner material after kneading with the masterbatch. The charge control agent may also be added directly at dissolving or dispersing into the organic solvent together with the toner material. In addition, the charge control agent may be added onto the surface of the toner particles after producing the toner particles.

The content of the charge control agent depends on binder resins, external additives, and dispersion processes, preferably, the content of charge control agent is 0.1 part by mass to 10 parts by mass, and more preferably 0.2 part by mass to 5 parts by mass based on 100 parts by mass of the binder resin. When the content is less than 0.1 parts by mass, the charge may be uncontrollable; when the content is more than 10 parts by mass, charging ability of the toner becomes excessively significant, which lessens the effect of charge control agent itself and increases electrostatic attraction force with a developing roller, leading to decrease of developer flowability or image density degradation.

External Additive

The external additive may be properly selected from conventional ones depending on the application; examples thereof include silica fine particles, metal salts of fatty acids such as zinc stearate and aluminum stearate; metal oxides such as titanium oxide, alumina, tin oxide and antimony oxide, hydrophobized products thereof, and fluoropolymers. Among these, particularly preferable are silica particles, titanium oxide particles, and hydrophobized titanium oxide particles.

The silica fine particles may be those commercially available; examples thereof include HDK H2000, HDK H2000/4, HDK H2050EP, HVK21 and HDK H1303 (by Hoechst Co.); R972, R974, RX200, RY200, R202, R805 and R812 (Nippon Aerosil Co.).

The titanium oxide fine particles may be those commercially available; examples thereof include P-25 (by Nippon Aerosil Co.); STT-30, STT-65C-S (by Titan Kogyo K. K.); TAF-140 (by Fuji Titanium Industry Co.); MT-150W, MT-500B, MT-600B and MT-150A (by Tayca Co.).

The hydrophobized titanium oxide fine particles may be those commercially available; examples thereof include T-805 (by Nippon Aerosil Co.); STT-30A and STT-65S-S (by Titan Kogyo K.K.); TAF-500T and TAF-1500T (by Fuji Titanium Industry Co.); MT-100S and MT-100T (by Tayca Co.); IT-S (Ishihara Sangyo Kaisha Ltd.).

The hydrophobized oxide fine particles such as of silica, titanium oxide or alumina fine particles may be produced through treating hydrophilic particles with silane coupling agents such as methyl trimethoxy silane, methyl triethoxy silane or octyl trimethoxy silane.

Examples of the hydrophobilizing agents include silane coupling agents such as trialkyl halogenated silanes, alkyl trihalogenated silanes, and hexaalkyl disilazane; sililating agents, silane coupling agents having a fluorinated alkyl group, organotitanate coupling agents, aluminum-containing coupling agents, silicone oils, and silicone vanish.

In addition, inorganic fine particles, treated with silicone oil while heating as required, are appropriately utilized.

Examples of inorganic fine particles include silica, alumina, titanium oxide, barium titanate, magnesium titanate, calcium titanate, strontium titanate, iron oxide, copper oxide, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide and silicon nitride. Among these, silica and titanium dioxide are especially preferable.

Examples of silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether modified silicone oil, phenol-modified silicone oil, carboxyl-modified silicone oil, mercaptol-modified silicone oil, acryl-modified silicone oil, methacryl-modified silicone oil, and alpha-methylstyrene-modified silicone oil.

The average particle diameter of primary particles of the inorganic fine particles is preferably 1 to 100 nm or less, and preferably 3 nm to 70 nm. When the average primary particle diameter is less than 3 nm, the inorganic fine particles may be embedded into the toner, and the function of the inorganic fine particles may not be effective; and when the average primary particle diameter is more than 100 nm, the inorganic fine particles may non-uniformly damage the surface of a photoconductor. As for the external additives, inorganic fine particles or hydrophobized inorganic fine particles may be used together. The average particle size of hydrophobized primary particles is preferably 1 nm to 100 nm, more preferably 5 nm to 70 nm. It is more preferred that the external additive contains two or more types of hydrophobilized inorganic fine particles having an average particle diameter of 20 nm or less at least one type of inorganic fine particles having an average particle diameter of 30 nm or more. In addition, the specific surface area of the inorganic fine particles is preferably 20 to 500 $m^2/g$ measured by BET method.

The amount of the external additive is preferably 0.1 to 5% by mass based on the toner, more preferably 0.3 to 3% by mass.

Some types of resin fine particles may be added as the external additive; examples thereof include such polymer particles as of polystyrenes prepared by soap-free emulsion polymerization, suspension polymerization, or dispersion polymerization; copolymers of (meth)acrylate; condensation polymers like silicone, benzoguanamine, and nylon; and thermosetting resins. Addition of these resin fine particles may improve charging ability of toner, decrease the amount of reversely charged toner, or to suppress background smear. The amount of the resin fine particles is preferably 0.01 to 5% by mass based on the toner, more preferably 0.1 to 2% by mass.

Other Ingredients

The other ingredients may be properly selected depending on the application; the other ingredients are exemplified by flowability improver, cleaning improver, magnetic material, metal soap, and the like.

The flowability improver is an agent that improves the hydrophobic property of resin particles through surface treatment and is capable of preventing reduction of the flowability and/or charging ability of resin particles even under high humidity environment; examples thereof include silane coupling agents, sililating agents, silane coupling agents having a fluorinated alkyl group, organotitanate coupling agents, aluminum-based coupling agents, silicone oils, and modified silicone oils.

The cleaning improver is added to the toner to remove developers remaining on photoconductors and/or on primary transferring members after a transferring step; examples thereof include metal salts such as zinc stearate, calcium stearate, and stearic acid; polymer particles prepared by soap-free emulsion polymerization such as of polystyrene fine particles. The polymer particles are preferably of narrower particle size distribution, and the volume-average particle diameter is preferably 0.01 to 1 μm.

The magnetic material may be properly selected from conventional ones depending on the application; examples thereof include iron powder, magnetites, and ferrites. Among them, white materials are preferable in view of color tone.

Method for Producing Toner

The method for producing the toner may be properly selected from conventional methods in the art, for example, such processes are available as kneading and pulverizing processes, polymerization processes, dissolving and suspending processes, and spraying and granulating processes.

Kneading and Pulverizing Process

In the kneading and pulverizing process, a toner material containing at least a binder resin and a colorant is melted and kneaded, then the resulting kneaded material is pulverized and classified, thereby to produce parent particles of the toner.

In order to prepare the kneaded material, toner raw materials are mixed, and the mixture is melted and kneaded in a melting kneader. Uniaxial or two-axial-continuous kneaders or roll mill kneaders of batch type are usable as the melting kneader, for example. KTK type two-axis extruder (by Kobe Steel, Ltd.), TEM type two-axis extruder (by Toshiba Machine Co., Ltd.), two-axis extruder (by KCK; PCM type), two-axis extruder (by Ikegai, Ltd.), and Co-kneader (by Buss Co.) are usable, for example. These melting kneaders are appropriately operated under free from cutting or disconnect of molecular chains of binder resins. Specifically, the melt-kneading temperature is appropriately selected considering softening temperatures of binder resins so as to avoid excessive cutting at higher temperatures as well as insufficient dispersion at lower temperatures.

In the pulverization, the kneaded material obtained by the kneading process is pulverized. Specifically, it is preferable in the pulverization that the kneaded material is crushed and then finely pulverized. The preferable pulverizing processes are ones where the kneaded material is made collided with a collision plate in a jet stream, particles are made collided with each other, or the kneaded product is pulverized in a gap between a mechanically rotating roller and a stater.

The pulverized product is then is classified and size-controlled into a predetermined particle diameter. The classification may be performed by removing fine particles using, for example, cyclones, decanters, centrifugal separators, or the like.

Following the pulverization and classification of particles, the pulverized product is classified in an airflow using centrifugal force to produce toner base particles having predetermined particle diameters.

Subsequently, an external additive is added to the toner base particles. The toner base particles and the external additive are mixed and stirred using a mixer, and then the external additive is coated to the surface of toner base particles during pulverizing. At this time, it is important that the external additives such as the inorganic particles and the resin fine particles are uniformly and strongly adhered to the toner base particles in terms of durability.

Polymerization Method

The toner production method by the polymerization is exemplified by that toner materials containing at least a modified polyester resin able to form a urea or urethane bond and a colorant are dissolved and/or dispersed in an organic solvent. Then, the dissolved and/or dispersed solution is dispersed in an aqueous medium and subjected to polyaddition reaction. The solvent of the dispersion is removed, and the residue is washed, to thereby obtain the toner.

Examples of the modified polyester resin which may be able to form urea bonding or urethane bonding include a polyester prepolymer having an isocyanate group, which is resulted from a carboxylic acid group and a hydrogen group in the polyester end is reacted with a polyisocyanate compound (PIC). The modified polyester resin is obtained through cross-linking and/or elongation reaction of molecular chains by the reaction between a polyester prepolymer having an isocyanate group and amines. The modified polyester resin can make the hot-offset property better with maintaining the low-temperature fixing property.

Examples of the polyisocyanate (PIC) include aliphatic polyisocyanates such as tetramethylene diisocyanate, hexamethylene diisocyanate, and 2,6-diisocyanato methyl caproate; alicyclic polyisocyanates such as isophorone diisocyanate, and cyclohexyl methane diisocyanate; aromatic diisocyanates such as tolylene diisocyanate and diphenylmethane diisocyanate; aromatic-aliphatic diisocyanates such as $\alpha,\alpha,\alpha',\alpha'$-tetramethylxylene diisocyanate; isocyanurates; polyisocyanates blocked with phenol derivatives, oxime, or caprolactam. These may be used alone or in combination.

The ratio of the polyisocyanate (PIC) is, defined as an equivalent ratio [NCO]/[OH] of isocyanate [NCO] to hydroxyl group [OH] of the polyester having a hydroxyl group, preferably 5/1 to 1/1, more preferably 4/1 to 1.2/1, and still more preferably 2.5/1 to 1.5/1.

The number of isocyanate group included in one molecule of polyester prepolymer having an isocyanate group (A) is usually one or more, preferably 1.5 to 3 on an average, and more preferably 1.8 to 2.5 on an average.

Examples of the amines (B) to be reacted with a polyester prepolymer (A) include diamine compounds (B1), polyamine compounds with three or more valences (B2), amino alcohols (B3), amino mercaptans (B4), amino acids (B5) and components in which an amino group of B1 to B5 is blocked (B6).

Examples of the diamine compound (B1) include aromatic diamines such as phenylene diamine, diethyltoluene diamine, and 4,4'-diaminodiphenylmethane; alicyclic diamines such as 4,4'-diamino-3,3'-dimethyldicyclohexylmethane, diamine cyclohexane and isophorone diamine; and aliphatic diamines such as ethylene diamine, tetramethylene diamine, and hexamethylene diamine.

Examples of the polyamine compounds with three or more valences (B2) include diethylenetriamine and triethylenetetramine. Examples of the amino alcohol (B3) include ethanolamine and hydroxyethylaniline. Examples of the amino mercaptan (B4) include aminomethyl mercaptan and aminopropyl mercaptan. Examples of the amino acid (B5) include aminopropionic acid and aminocaproic acid.

Examples of the component in which an amino group of B1 to B5 is blocked (B6) include ketimine compounds obtained from the amines B1 to B5 and ketones such as acetone, methyl ethyl ketone and methyl isobutyl ketone; and an oxazolidine compound. Among these amines (B), B1 and a mixture of B1 with a small amount of B2 are preferable.

The ratio of the amines (B) is, defined as an equivalent ratio [NCO]/[$NH_x$] of an isocyanate [NCO] in the polyester prepolymer having an isocyanate group (A) to an amino group [$NH_x$] in the amines (B), preferably 1/2 to 2/1, more preferably 1.5/1 to 1/1.5, and still more preferably 1.2/1 to 1/1.2.

With the toner production method of the above polymerization, a spherical shaped toner having a small particle diameter may be prepared at lower-cost with less environmental load.

The coloration of the toner may be properly selected depending on the application; for example, the coloration may be at least one selected from black, cyan, magenta, and yellow. Each color toner is obtained by appropriately selecting the colorant, and it is preferably a color toner.

The weight average particle diameter of the toner may be properly selected depending on the application, and may be measured, for example, as follows:

Weight Average Particle Diameter of Toner

Measuring instrument: Coulter Multisizer II (by Beckman Coulter Co.)

Aperture diameter: 100 μm

Software: Coulter Multisizer Aqucomp version 1.19 (by Beckman Coulter Co.)

Dispersion liquid: 5% by mass electrolyte of Emulgen 109P (polyoxyethylene laurylether, HLB=13.6, by Kao Co.)

Dispersion condition: 10 mg of a test sample is added to 5 ml of the dispersion liquid, the mixture is dispersed by an ultrasonic-dispersing device, followed by adding 25 ml of the electrolyte and dispersing further for one minute using the ultrasonic-dispersing device.

Measuring condition: 100 ml of the dispersion liquid and a small amount of the dispersion liquid are added to a beaker, then about 30000 particles are measured at a concentration capable of measuring for 20 seconds, thereby the weight average particle diameter is determined from the particle diameter distribution.

Developer

The developer according to the present invention contains the toner of the present invention and appropriately selected additional ingredients such as a carrier. The developer may be either of one-component or two-component; when it is applied to high-speed printers that support increasing information processing rates of recent years, two-component developers are preferable in view of achieving excellent shelf life.

In the case of one-component developers containing the toners of the present invention, the variations in the toner particle diameter are minimized even after consumption or addition of toner, and toner filming to a developing roller and toner adhesion to members such as blade to reduce layer thickness of the toner are prevented. Thus, it is possible to provide excellent and stable developing properties and images even after a long usage of the developing unit, i.e. after long time agitation of developer. Meanwhile, in the case of two-component developers containing the toners of the present invention, even after many cycles of consumption and addition of toner, the variations in the toner particle diameter are minimized and, even after a long-time agitation of the developer in the developing unit, excellent and stable developing properties may be obtained.

Carrier

The carrier may be properly selected depending on the application, preferably, is one having a core material and a resin layer coating the core material.

The material for the core may be properly selected from conventional ones; preferable examples thereof include materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 to 120 emu/g) are preferable. In addition, weak magnetizing materials such as copper-zinc (Cu—Zn)-based materials (30 to 80 emu/g) are preferable from the standpoint for achieving higher-grade images by reducing the contact pressure against the photoconductor having standing toner particles. These materials may be used singly or in combination.

The particle diameter of the core material, in terms of volume-average particle diameter, is preferably 10 μm to 150 μm, more preferably 40 μm to 100 μm.

In cases where the average particle diameter (volume-average particle diameter ($D_{50}$)) is less than 10 μm, fine particles make up a large proportion of the carrier particle distribution, causing carrier scattering due to reduced magnetization per particle in some cases, on the other hand, and in cases where it exceeds 150 μm, the specific surface area of the particle decreases, causing toner scatterings and reducing the reproducibility of images, particularly the reproducibility of solid images in full-color images due to many solid images in full-color images.

Materials for the resin layer may be properly selected from conventional ones depending on the intended purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and non-fluoride monomers, and silicone resins. These resins may be used singly or in combination.

The silicone resin may be properly selected from conventional ones depending on the intended purpose. Examples thereof include straight silicone resins comprising only an organosiloxane bond, and silicone resins which are modified with alkyd resins, polyester resins, epoxy resins, acrylic resins, and urethane resins.

As for the silicone resin, commercially available ones may be used. Examples of the straight silicone resins include KR271, KR255, and KR152 (by Shin-Etsu Chemical Co.); and SR2400, SR2406, and SR2410 (by Toray Dow Corning Co.).

Examples of the modified silicone resins include KR206 which is modified with an alkyd resin, KR5208 which is modified with an acrylic resin, ES1001N which is modified with an epoxy resin, KR305 which is modified with a urethane resin, manufactured by Shin-Etsu Chemical Co., Ltd.; and SR2115 which is modified with an epoxy resin, and SR2110 which is modified with an alkyd resin (by Toray Dow Corning Co.).

Each of these silicone resins may be used alone or may be used in combination with a component capable of cross-linking reaction, a component capable of controlling the charged amount or the like.

Electroconductive powder may be incorporated into the resin layer as required. Examples of the electroconductive powder are metal powder, carbon black, titanium oxide, tin oxide, zinc oxide, and the like. It is preferable that an average particle diameter of these electroconductive powders is 1 μm or less. When the average particle diameter is more than 1 μm, control of electric resistance may be difficult.

The resin layer may be formed by dissolving a resin such as a silicon resin in a solvent to prepare a solution and applying the solution uniformly on a surface of the core material by way of conventional processes. The application process may be dipping, spraying, or brushing processes.

The solvent may be selected appropriately depending on the application; examples thereof include toluene, xylene, methylethylketone, methylisobutylketone, cellosorb, butyl acetate, and the like.

The baking process may be by external or internal heating; the baking process is exemplified by those using fixed electric furnaces, fluid electric furnaces, rotary electric furnaces, burner furnaces, those using microwaves, and the like.

The amount of the resin in the carrier is preferably 0.01 to 5.0% by mass. When the amount of the resin is less than 0.01% by mass, the resin layer may be formed non-uniformly on the surface of the core material, and when the amount of the resin is more than 5.0% by mass, the resin layer becomes excessively thick, and there tends to arise a carrier granulation, thus uniform carrier particles may not be prepared.

When the developer is a two-component developer, the carrier content in the two-component developer may be properly selected depending on the application; for example, the content is preferably 90 to 98% by mass, more preferably 93 to 97% by mass.

The mixing ratio of the carrier and the toner in the two-component developer is typically 1.0 to 10.0 parts by mass of the toner based on 100 parts by mass of the carrier.

The developing unit may be of dry type or wet type, and may be a monochrome developing or multi-color developing unit. For example, such a member is preferable that comprises a stirrer that charges the toner or developer by friction stirring, and a rotatable magnet roller.

In the developing unit, for example, the toner and the carrier are mixed and stirred; the toner is thereby charged by friction and sustained in a condition of standing rice ears, and forms a magnetic brush on the surface of the rotating magnet roller. Since the magnet roller is arranged near the photoconductor, part of the toner in the magnetic brush formed on the surface of this magnet roller moves to the surface of the photoconductor due to the force of electrical attraction. As a result, this toner develops a latent electrostatic image, and a visible toner image is formed on the surface of the photoconductor.

The developer housed in the developing unit is the developer containing the toner; the developer may be one-component or two-component developer.

One Component Developing Unit

One component developing devices are preferably employed for the one component developing unit that has a developer bearing member to which toner is supplied and a layer-thickness controlling member that provides a thin layer of toner on the developer bearing member.

Figure 5:
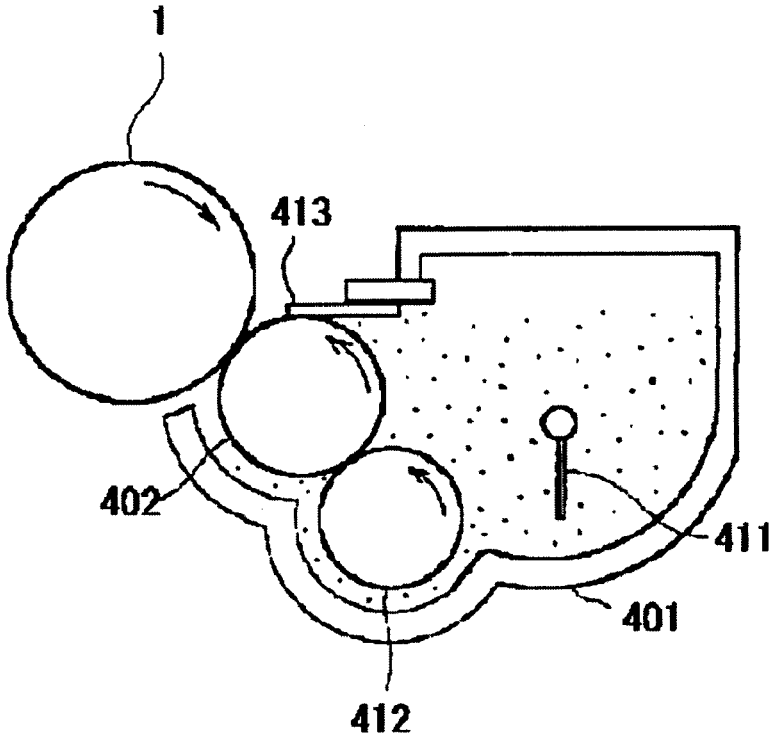
FIG. 5 is a schematic view that exemplarily shows a one-component developing unit applied to an inventive image forming apparatus.

FIG. 5 is a schematic view that exemplarily shows a one-component developing unit. In the one-component developing unit, one component developer of toner is employed, a toner layer is formed on a developing roller 402 of a developer bearing member, the toner layer on the developing roller 402 is conveyed while contacting with a photoconductor drum 1 of a latent electrostatic image bearing member, thereby latent electrostatic images are developed on the photoconductor drum 1.

As shown in FIG. 5, the toner in the casing 401 is stirred by rotating action of the agitator 411, and supplied mechanically to the supplying roller 412 of a toner supplying member. The supplying roller 412 is formed from flexible foamed polyurethane etc., and has a configuration with a cell diameter of 50 to 500 μm to easily sustain toners. The supplying roller has a relatively low JIS-A hardness of 10° to 30°, and may contact uniformly with the developing roller 402.

The supplying roller 412 and the developing roller 402 are rotated in a same direction, i.e. the both surfaces of the both rollers rotate oppositely at the facing portion. The ratio of liner velocity is preferably 0.5 to 1.5 between the supplying roller and the developing roller. In addition, the supplying roller 412 may be rotated in the reverse direction with that of the developing roller 402, i.e. the both surfaces of the both rollers may rotate reversely at the facing portion. In this embodiment, the supplying roller 412 rotated in the same direction as the developing roller 402 and the ratio of liner velocity is adjusted to 0.9. The biting level of the supplying roller 412 onto the developing roller 402 is adjusted to 0.5 to 1.5 mm. When the effective width of the unit is 240 mm (longitudinal length of A4 size) in this embodiment, the torque is required in a range of 14.7 to 24.5 N·cm.

The developing roller 402 is formed from a surface layer of a rubber material on an electroconductive substrate, the diameter is 10 to 30 mm, and the surface roughness Rz is adjusted to 1 to 4 μm by way of properly roughening the surface. The level of the surface roughness Rz is preferably 13% to 80% of the average particle diameter of the toner, thereby the toner may be conveyed without embedding into the surface of the developing roller 402. It is preferable in particular that the surface roughness Rz is 20% to 30% of the average particle diameter of the toner so as not to unduly sustain the toner.

The rubber material may be exemplified by silicone rubber, butadiene runner, NBR rubber, hydrin rubber, and EPDM rubber. It is also preferred that a coating layer is disposed on the surface of the developing roller 402 in order to stabilize quality with time. The material of the coating layer is exemplified by silicone material and Teflon® material. The silicone material is superior in charging property of toner; the Teflon® material is superior in releasing ability. An electroconductive material such as carbon black may also be appropriately included in order to afford electric conductivity. The thickness of the coating layer is preferably 5 to 50 μm. The level outside this range may suffer from cracking etc.

The toner, on or inside the supplying roller 412, having a certain polarity (negative polarity in this embodiment) is sustained on the developing roller 402, when inserted between the supplying roller 412 and the developing roller 402 while rotating, by action of electrostatic force due to negative charge caused by a frictional electrification effect and a conveying effect due to surface roughness of the developing roller 402. In this stage, however, the toner layer is considerably excessive rather than uniform on the developing roller 402 (1 to 3 mg/cm$^2$). Therefore, a regulating blade 413 as a layer thickness-controlling member is made contact with the developing roller 402, thereby forming a toner-thin layer with a uniform layer thickness on the developing roller 402. The regulating blade 413 has a tip pointing the downstream of the rotating direction of the developing roller 402 and the central portion of the regulating blade 413 contacts with the developing roller 402 in a so-called body touching manner. The contacting direction may be reversed, or the touching manner may be at the edge.

It is preferred that the material of the regulating blade 413 is metal such as SUS304 and the thickness is 0.1 to 0.15 mm. Materials other than metal may be available, such as rubber materials like polyurethane runner and relatively hard resin materials such as silicone resin. Various materials may be made into low-resistance by way of incorporating carbon black etc., thus an electric field may be applied between the regulating blade 413 and the developing roller 402 through connecting a bias electric source.

The regulating blade 413 as the layer thickness-controlling member preferably has a free edge length of 10 to 15 mm from the holder. In cases where the free edge length is above 15 mm, the developing unit is unduly large to make compact the image forming apparatus, and in cases where the free edge length is below 10 mm, vibration tends to generate when the regulating blade 413 contacts with the surface of the developing roller 402, thus abnormal images may appear such as nonuniformity as step-by-step in traverse direction.

The pressure of the regulating blade 413 for urging to contact is preferably 0.049 to 2.45 N/cm. The contacting pressure of above 2.45 N/cm tends to decrease the toner amount deposited on the developing roller 402 and increase the charging level of the toner, thus possibly decreasing the developing amount and the image density, and the contacting pressure of below 0.49 N/cm may allow to pass the toner mass through the regulating blade without forming a uniform thin layer, resulting possibly in significantly poor image quality. In this embodiment, the developing roller 402 as a JIS-A hardness of 300 and the regulating blade 413 is a SUS plate of 0.1 mm thick with a contacting pressure of 60 gf/cm, thereby an intended deposited amount of the toner may be brought about on the developing roller.

It is also preferred that the contacting angle of the regulating blade 413 is 10° to 45° against the tangent line of the developing roller in a direction that the tip faces the downstream of the developing roller 402. The unnecessary portion for forming a toner-thin layer interposed between the regulating blade 413 and developing roller 402 is peeled from the developing roller 402 and a thin layer is formed with a uniform thickness of intended 0.4 to 0.8 mg/cm$^2$. At this stage, the toner charge is finally −10 to −30 μC/g, then the toner is used for developing a latent electrostatic image on the photoconductor drum 1.

As such, in accordance with the one-component developing apparatus in this embodiment, the distance between the surface of the photoconductor drum 1 and the surface of the developing roller 402 can be narrowed still further compared to conventional two-component developing units, thereby increasing the developing ability and making possible to develop with lower voltages.

Two-Component Developing Unit

The two-component developing unit is preferably one having a magnetic field-generating unit fixed therein and a rotatable developer bearing member that carries on its surface a two-component developer formed of a magnetic carrier and toner.

Figure 6:
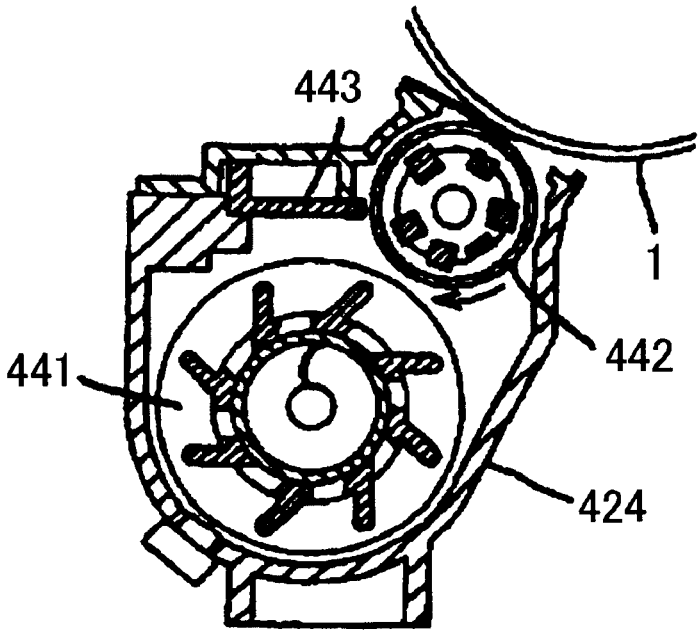
FIG. 6 is a schematic view that exemplarily shows a two-component developing unit applied to an inventive image forming apparatus.

FIG. 6 is a schematic view that exemplarily shows a two-component developing unit that uses a two-component developer formed of a magnetic carrier and toner. In this two-component developing unit of FIG. 6, a developer is stirred and transported by a screw 441 and sent to a developing sleeve 442. The two-component developer sent to the developing sleeve 442 is regulated by a doctor blade 443 and the supplied amount of the developer is controlled by a doctor gap, which is a space between the doctor blade 443 and the developing sleeve 442. When the doctor gap is too small, the amount of developer is insufficient, leading to insufficient image density, and when the doctor gap is too large, the developer is excessively supplied in amount, causing a problem of carrier attachment on the photoconductor drum 1. Therefore, the developing sleeve 442 is equipped with a magnet that forms a magnetic field so as to hold the developer vertically on the peripheral surface, and the developer is held vertically in a form of chains on the developing sleeve 442 along the magnetic field lines that are radiated from the magnet in the normal line direction.

The developing sleeve 442 and the photoconductor drum 1 are arranged so as to be adjacent to each other with a certain space (development gap) in between and a developing region is formed where the developing sleeve 442 and the photoconductor drum 1 are facing each other. The developing sleeve 442 is made of non-magnetic substance such as aluminum, brass, stainless steel, and electroconductive resin in a form of cylinder, and it is rotated by a rotary drive mechanism (not shown). The magnetic brush is transported to the developing region by the rotation of the developing sleeve 442. A developing voltage is applied to the developing sleeve 442 by means of a power source for development (not shown), the toner on the magnetic brush is separated from the carrier by means of development field formed between the developing sleeve 442 and the photoconductor drum 1, and is developed on the latent electrostatic image on the photoconductor drum 1. It is also possible for the developing voltage to be overlapped with alternating current.

The development gap can be set to approximately 5 to 30 times as much as the particle diameter of the developer, and when the particle diameter of the developer is 50 μm, the development gap can be set to 0.5 to 1.5 mm. When the development gap is wider than the above, it is difficult to obtain desired image density.

It is also preferable that the doctor gap is approximately equivalent or somewhat larger than the development gap. The drum diameter or drum linear density of the photoconductor drum 1 and the sleeve diameter or sleeve linear density of the developing sleeve 442 are determined depending on the copying speed or size of the apparatus, etc. The ratio of the sleeve linear velocity to the drum linear velocity is preferably 1.1 or more for obtaining required image density. It is also possible to install a sensor in a position after developing and control the process condition by detecting the amount of toner attachment from optical reflectance.

Transferring Step and Transferring Unit

In the transferring step, a visible image is transferred onto a recording medium by use of a transferring unit. The transferring unit is classified into a transferring unit where a visible image on a latent electrostatic image bearing member is directly transferred onto a recording medium, and a secondary transferring unit where a visible image is firstly transferred onto an intermediate transferring member and then the visible image is secondarily transferred onto the recording medium.

The visible-image transfer may be carried out, for example, by charging the photoconductor using a transferring charger, which may be performed by the transferring unit. In a preferable aspect, the transferring unit contains the first transferring unit that transfers the visible image to the intermediate transferring member to form a compounded transfer image, and the second transferring unit that transfers the compounded transfer image to the recording medium.

The intermediate transferring member may be properly selected from conventional transferring members, for example, transfer belts and transfer rollers are preferable.

The stationary friction coefficient of the intermediate transferring member is preferably 0.1 to 0.6 and more preferably 0.3 to 0.5. The volume resistance of intermediate transferring member is preferably more than several Ω·cm and less than $10^3$ Ω·cm. The volume resistance within the range of several Ω·cm to $10^3$ Ω·cm may prevent charging of the intermediate transferring member itself, and the charge from the charging unit is unlikely to remain on the intermediate transferring member, therefore, transfer nonuniformity at the secondary transferring may be prevented and the application of transfer bias at the secondary transferring becomes relatively easy.

The materials of the intermediate transferring member may be properly selected from conventional ones depending on the application. The materials are, for example, (1) materials with high Young's modulus (tension elasticity) used as a single layer belt such as polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's modulus are small in their deformation against stress during image formation and are particularly advantageous in that registration error is less likely to occur during color image formation. (2) A double or triple layer belt using the belt having high Young's modulus as a base layer is available, where being added with a surface layer and an optional intermediate layer around the peripheral side of the base layer. The double or triple layer belt has a capability of preventing dropout in a lined image that is caused by hardness of the single layer belt. (3) An elastic belt with relatively low Young's modulus is available that incorporates a rubber or an elastomer. This belt is advantageous in that there is almost no print defect of unclear center portion in a line image due to its softness. Additionally, by making width of the belt wider than drive roller or tension roller and thereby using the elasticity of edge portions that extend over rollers, it can prevent meandering of the belt. It is also cost effective for not requiring ribs or units to prevent meandering. Among these, the elastic belt (3) is preferable in particular.

The elastic belt deforms corresponding to the surface roughness of toner layers and the recording medium having low smoothness in the transfer section. In other words, since elastic belts deform complying with local roughness and an appropriate adhesiveness can be obtained without excessively increasing the transfer pressure against toner layers, it is possible to obtain transfer images having excellent uniformity with no letter void even with a recording medium of low flatness.

The resin of the elastic belts may be selected depending on the application; examples thereof include polycarbonate resins, fluorine resins such as ETFE and PVDF; polystyrene resins, chloropolystyrene resins, poly-α-methylstyrene resins, styrene-butadiene copolymers, styrene-vinyl chloride copolymer, styrene-vinyl acetate copolymer, styrene-maleic acid copolymer, styrene-acrylate copolymers such as styrene-methyl acrylate copolymers, styrene-ethyl acrylate copolymers, styrene-butyl acrylate copolymers, styrene-octyl acrylate copolymers, and styrene-phenyl acrylate copolymers; styrene-methacrylate copolymers such as styrene-methyl methacrylate copolymers, styrene-ethyl methacrylate copolymers and styrene-phenyl methacrylate copolymer; styrene-α-chloromethyl acrylate copolymers, styrene-acrylonitrile acrylate copolymers, methyl methacrylate resins, butyl methacrylate resins, ethyl acrylate resins, butyl acrylate resins, modified acrylic resins such as silicone-modified acrylic resins, vinyl chloride resin-modified acrylic resins and acrylic urethane resin; vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinylbutylal resins, polyamide resins and modified polyphenylene oxide resins.

The rubber of the elastic belts may be properly selected depending on the application; examples thereof include natural rubber, butyl rubber, fluorine-based rubber, acryl rubber, EPDM rubber, NBR rubber, acrylonitrile-butadiene-styrene rubber, natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubber, syndiotactic 1,2-polybutadiene, epichlorohydrin-based rubber, silicone rubber, fluorine rubber, polysulfide rubber, polynorbornene rubber, and hydrogenated nitrile rubber.

The elastomers used for the elastic may be properly selected depending on the application; examples thereof include polystyrene thermoplastic elastomers, polyolefin thermoplastic elastomers, polyvinyl chloride thermoplastic elastomers, polyurethane thermoplastic elastomers, polyamide thermoplastic elastomers, polyurea thermoplastic elastomers, polyester thermoplastic elastomers, fluorocarbon thermoplastic elastomers, and the like. These may be used alone or in combination.

The electroconductive agents for adjusting resistance may be properly selected depending on the application; examples thereof include carbon black, graphite, metal powders such as aluminum and nickel; electroconductive metal oxides such as tin oxide, titanium oxide, antimony oxide, indium oxide, potassium titanate, antimony tin oxide (ATO), and indium tin oxide (ITO). The electroconductive metal oxides may be coated with insulating particles such as barium sulfate, magnesium silicate, calcium carbonate, and the like.

The materials of the surface layer is required to prevent contamination of the photoconductor due to elastic material as well as to reduce the surface friction of the transfer belt so that toner adhesion is lessened while improving the cleaning ability and the secondary transfer property. The surface layer preferably contains one type or two or more types of polyurethane resin, polyester resin, epoxy resin, and the like and materials that reduce surface energy and enhance lubrication, powders or particles such as fluorine resin, fluorine compound, carbon fluoride, titanium dioxide, silicon carbide, and the like. In addition, it is possible to use a material such as fluorine rubber that is treated with heat so that a fluorine-rich layer is formed on the surface and the surface energy is reduced.

Examples of methods to produce the elastic belts include, but not limited to, (1) centrifugal forming in which material is poured into a rotating cylindrical mold to form a belt, (2) spray application in which a liquid paint is sprayed to form a film, (3) dipping method in which a cylindrical mold is dipped into a solution of material and then pulled out, (4) injection mold method in which material is injected into inner and outer mold, (5) a method in which a compound is applied onto a cylindrical mold and the compound is vulcanized and grounded.

Examples of methods to prevent elongation of the elastic belt include (1) a method in which materials that prevent elongation are added to a core layer and (2) a method in which a rubber layer is formed on the core layer which is less stretchable.

Examples of the materials constructing the core layer that prevent elongation include natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials that are in a form of a weave or thread may be used.

The method for forming the core layer may be properly selected depending on the application; examples thereof include (1) a method in which a weave that is woven in a cylindrical shape is placed on a mold or the like and a coating layer is formed on top of it, (2) a method in which a cylindrical weave is dipped in a liquid rubber or the like so that coating layer(s) is formed on one side or on both sides of the core layer and (3) a method in which a thread is twisted helically around a mold or the like in an arbitrary pitch, and then a coating layer is formed thereon.

As the coated layer comes to thicker, elongation and contraction of the surface comes to more significant, therefore, excessive thickness such as above 1 mm is undesirable.

The transfer unit, i.e. the primary transfer unit and the secondary transfer unit, preferably contains a transfer equipment that is configured to charge so as to separate the visible image formed on the latent electrostatic image bearing member and transfer the visible image onto a recording medium.

Examples of the transfer equipment are corona transfer equipments utilizing corona discharge, transfer belts, transfer rollers, pressure-transfer rollers, adhesion-transfer equipments, and the like.

The typical recording medium is a regular paper, and may be selected properly as long as capable of receiving transferred, unfixed image after developing; and PET bases for OHP may also be used.

Transferring Unit of Tandem Type

The tandem image forming apparatus has at least image forming elements arranged in plural numbers including a latent electrostatic image bearing member, a charging unit, a developing unit, and a transfer unit. The tandem image forming apparatus can form full-color images at higher speeds because having four image forming elements for yellow, magenta, cyan and black, forms each visible image in parallel by means of four image forming elements and superimposes one another on a recording medium or intermediate transfer member.

Figure 7:
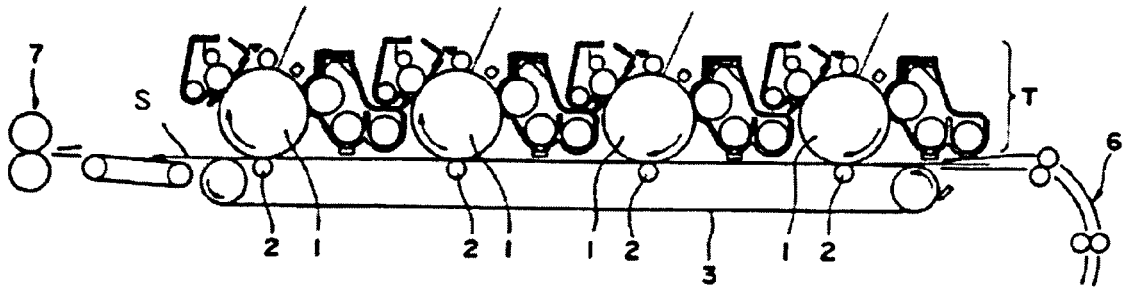
FIG. 7 is a schematic view that exemplarily shows an inventive tandem-type image forming apparatus in a direct transfer system.
Figure 8:
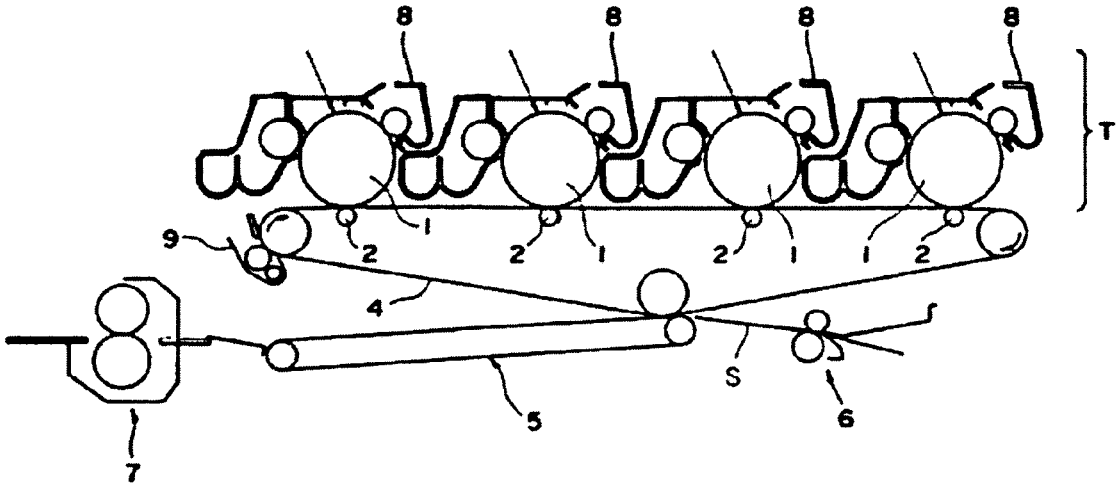
FIG. 8 is a schematic view that exemplarily shows an inventive tandem-type image forming apparatus in an indirect transfer system.

There are two types of tandem information forming apparatus: (1) direct transfer type and (2) indirect transfer type. In direct transfer type, visible images formed on the photoconductor 1 are transferred sequentially by the transfer unit 2 to a recording medium S of which the surface is being transported so as to pass through the transfer position, which is facing each photoconductor 1 of multiple image forming elements as shown in FIG. 7. In indirect transfer type, visible images on each photoconductor 1 of multiple image forming elements are temporarily transferred sequentially by the primary transfer unit 2 to the intermediate transfer member 4 and then all the images on the intermediate transfer member 4 are transferred together to the recording medium S by the secondary transfer unit 5 as shown in FIG. 8.

The direct transfer type (1), compared to the indirect transfer type (2), has a drawback of glowing in size in a transporting direction of the recording medium because the paper feeding unit 6 must be placed on the upper side of the tandem image forming part T where the photoconductor 1 is aligned, whereas the fixing unit 7 must be placed on the lower side of the apparatus. On the other hand, in the indirect transfer type (2), the secondary transfer site may be installed relatively freely, and the paper feeding unit 6 and the fixing unit 7 may be placed together with the tandem image forming part T making it possible to be downsized.

To avoid size-glowing in the transporting direction of the recording medium in the direct transfer type (1), the fixing unit 7 must be placed close to the tandem image forming part T. However, it is impossible to place the fixing unit 7 in a way that gives enough space for the recording medium S to bend, and the fixing unit 7 may affect the image forming on the upper side by the impact generated from the leading end of the recording medium S as it approaches the fixing unit 7 (this becomes distinguishable with a thick sheet), or by the difference between the transport speed of the recording medium when it passes through the fixing unit 7 and when it is transported by the transfer/transport belt. The indirect transfer type, on the other hand, allows the fixing unit 7 to be placed in a way that gives recording medium S an enough space to bend and the fixing unit 7 has almost no effect on the image forming.

For above reasons, the indirect transfer type of the tandem image forming apparatus is particularly interested recently. And this type of color image forming apparatus as shown in FIG. 8, prepares for the next image forming by removing the residual toner on the photoconductor 1 by the photoconductor cleaning unit 8 to clean the surface of the photoconductor 1 after the primary transfer. It also prepares for the next image forming by removing the residual toner on the intermediate transfer member 4 by the intermediate transfer member cleaning unit 9 to clean the surface of the intermediate transfer member 4 after the secondary transfer.

Fixing Step and Fixing Unit

In the fixing step, the visible image on the recording medium is fixed by use of the fixing unit. The fixing unit may be properly selected depending on the application; for example, fixing devices with a fixing member and a heat source are appropriately used.

Examples of the fixing members include a combination of an endless belt and a roller, and a combination of a roller and a roller. In view of shorter warm-up period and energy saving, a combination of an endless belt and a roller or induction heating is preferably employed.

The fixing member is exemplified by conventional heating and pressurizing units, i.e. a combination of a heating unit and a pressure. The heating and pressurizing is exemplified by a combination of a heating roller, a pressure roller, and an endless belt, or a heating roller and a pressure roller.

In the case where the fixing member is an endless-shaped belt, preferably, the endless-shaped belt is made of materials having a small heat capacity, and includes one in which, for example, there is provided on a base an offset preventing layer. Materials forming the base include, for example, nickel and polyimide. Materials forming the offset preventing layer include, for example, silicone rubbers, and fluorine-based resins.

In the case where the fixing member is a roller, preferably, a core metal of this roller is made of a non-elastic member in order to prevent the deformation or deflection due to a high pressure. These non-elastic members may be suitably selected depending on the purpose. For example, the non-elastic members preferably include high thermal conductivity materials such as aluminum, iron, stainless steel, and brass. Moreover, the roller is preferably covered with an offset preventing layer at the surface thereof. Materials forming this offset preventing layer may be suitably selected depending on the purpose without particular limitation, and preferably include, for example, RTV silicone rubber, tetrafluoroethylene-perfluoroalkyl vinylether (PFA), and polytetrafluoroethylene (PTFE).

In the fixing step, the toner image is transferred onto the recording medium, the recording medium having an image is passed between the nip to fix the image onto the recording medium or the image is transferred and also fixed simultaneously at the nip.

In addition, the fixing step may be carried out for each toner at every transferring onto the recording medium or the all toners are overlapped and then fixed simultaneously.

The nip is formed by contacting at least two fixing members. The nip pressure may be properly selected depending on the application; preferably, the pressure is no less than 5 $N/cm^2$, more preferably 7 to 100 $N/cm^2$, still more preferably 10 to 60 $N/cm^2$. Excessively higher nip pressure tends to impair the roller durability, and the nip pressure of below 5 $N/cm^2$ may bring about insufficient fixing ability.

The fixing temperature of the toner, i.e. the surface temperature of the fixing member heated by the heating unit, may be properly selected depending on the application; preferably, the temperature is 120° C. to 170° C., more preferably 120° C. to 160° C. The temperature below 120° C. may result in insufficient fixing, and the temperature above 170° C. is undesirable for energy saving.

The fixing units are classified into (1) internal heating, i.e. the fixing unit is equipped with at least one of rollers and belts, the heating energy is supplied to the surface to which no toner contacts, and the image transferred onto the recording medium is fixed by heat and pressure, (2) external heating, i.e. the fixing unit is equipped with at least one of rollers and belts, the heating energy is supplied to the surface on which the toner is disposed, and the image transferred onto the recording medium is fixed by heat and pressure; these combination may be possible.

The fixing unit of the internal heating (1) described above may be a fixing unit that is equipped with a heating unit therein such as heaters and halogen lamps.

Fixing Unit of External Heating

The fixing unit of the external heating (2) described above may be a fixing unit of which the surface is heated at least partly by a heating unit such as electromagnetic induction-heating units. The electromagnetic induction-heating units may be those generating a magnetic field or heating by electromagnetic induction.

The electromagnetic induction-heating units may preferably be constructed from an induction coil accessible to the fixing member such as heating rollers, a shielding layer for the induction coil, and an insulative layer disposed to the shielding layer oppositely to the induction coil. The heating roller is preferably of magnetic material or heat pipes.

It is preferred that the induction coil is disposed to surround the half-cylinder of the heating roller at the side opposite to the site where the heating roller and the fixing member contact.

Fixing Unit of Internal Heating

Figure 9:
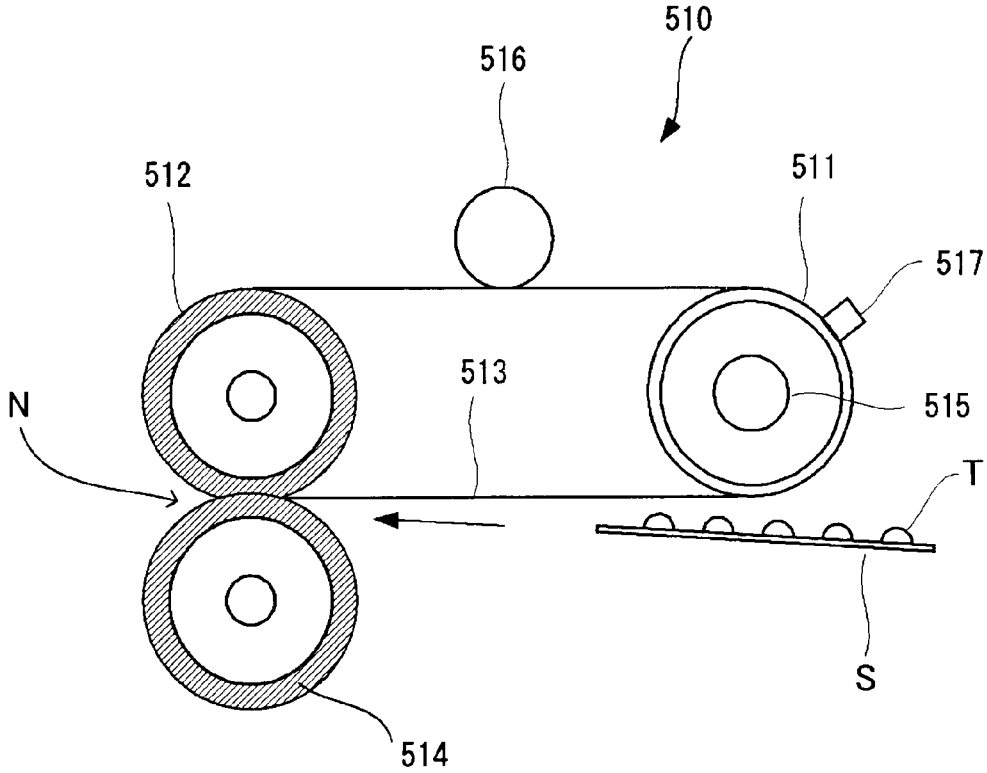
FIG. 9 is a schematic view that exemplarily shows a belt-type fixing unit applied to an inventive image forming apparatus.

FIG. 9 exemplarily shows a belt-type fixing unit of internal heating. The belt-type fixing unit 510 comprises a heating roller 511, a fixing roller 512, a fixing belt 513, and a pressure roller 514.

The fixing belt 513 is looped around the heating roller 511 and the fixing roller 512, which being rotatably mounted, and is heated at a predetermined temperature by the heating roller 511. The heating roller 511 has a heat source 515 therein, and is configured to freely control the temperature thereof by means of a thermal sensor 517 disposed adjacent to the heating roller 511. The fixing roller 512 is rotatably mounted inside of the fixing belt 513 so as to contact with the inner side of the fixing belt 513. The pressure roller 514 is rotatably mounted outside of the fixing belt 513 so as to contact with the outer side of the fixing belt 513. Moreover, the surface hardness of the fixing belt 513 as the image-contact fixing member is lower than the surface hardness of the pressure roller 514 as the non-image-contact member. In the nip N formed between the fixing roller 512 and the pressure roller 514, an intermediate region of the recording medium S introducing edge and the ejecting edge, is located toward the side of the fixing roller 512 compared with the introducing edge and the ejecting edge.

In the belt-fixing device 510 shown in FIG. 9, a toner image T to be fixed is transferred to the heating roller 511. The toner image T on the recording medium S is heated and fused by the heating roller 511 heated at a predetermined temperature by means of the heat source 515, and the fixing belt 513. In this condition, the recording medium S is inserted into the nip N formed between the fixing roller 512 and the pressure roller 514. The recording medium S inserted in the nip N is contacted with a surface of the fixing belt 513 which rotates along with the rotation of the fixing roller 512 and the pressure roller 514, and is pressed at the time passed through the nip N, thereby fixing the toner image T onto the recording medium S.

The recording medium S on which the toner image T is fixed is sequentially passed through between the fixing roller 512 and the pressure roller 514, separated from the fixing belt 513, and transferred to a tray (not shown). In this process, the recording medium S is ejected towards the side of the pressure roller 514 as the non-image-contact fixing member, and thus the recording member is prevented from wrapping around the fixing belt 513. The fixing belt 513 is then cleaned by means of a cleaning roller 516.

Figure 10:
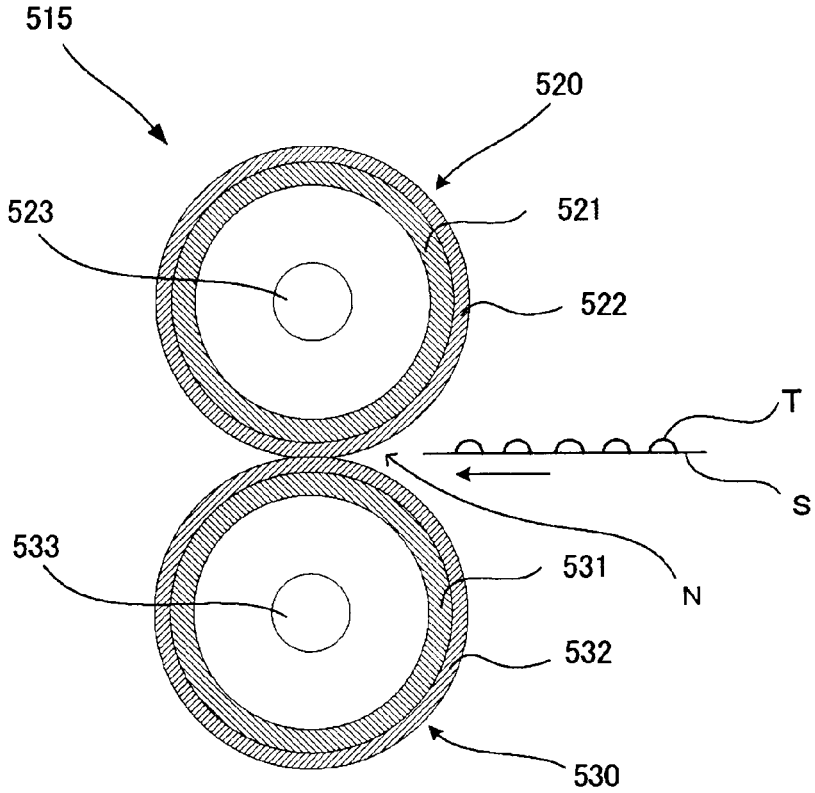
FIG. 10 is a schematic view that exemplarily shows a heat-roller type fixing unit applied to an inventive image forming apparatus.

The fixing device 515 of heat-roll type shown in FIG. 10 comprises a heating roller 520 as the fixing member and a pressure roller 530 disposed to contact therewith.

The heating roller 520 comprises a hollow metal cylinder 521, an offset inhibition layer 522 coated on the surface of the metal cylinder 521, and a heating lamp 523 disposed in the metal cylinder 521. The pressure roller 530 comprises a metal cylinder 531, and an offset inhibition layer 532 coated on the surface of the metal cylinder 531. Alternatively, the metal cylinder 531 of the pressure roller 530 is hollow and equipped with a heating lamp 533 therein.

The heating roller 520 and the pressure roller 530 are rotatably mounted so as to contact against each other by means of a spring (not shown) to form a nip N. The offset inhibition layer 522 of the heating roller 520 as the image-contact fixing member has a lower surface hardness than the surface hardness of the offset inhibition layer 532 of the pressure roller 530 as the non-image-contact fixing member. In the nip N formed between the heating roller 520 and the pressure roller 530, an intermediate region of the recording medium S introducing edge and the ejecting edge, is located towards the heating roller 520 compared with the introducing edge and the ejecting edge.

In the image-fixing device 510 of heat-roll type shown in FIG. 10, a toner image T to be fixed is transferred to the nip formed between the heating roller 520 and the pressure roller 530. The toner image T on the recording medium S is heated and fused by the heating roller 520 heated at a predetermined temperature by means of the heating lamp 523. At the same time, the recording medium S is passed through the nip N, the recording medium S is pressed by a pressure from the pressure roller 530, and thus the toner image T is fixed into the recording medium S.

The recording medium S, on which the toner image T being fixed, is sequentially passed through between the heating roller 520 and the pressure roller 530, and transferred to a tray (not shown). In this process, the recording medium S is ejected towards the side of the pressure roller 530 as the non-image-contact fixing member, and thus the recording member S is prevented from wrapping around the pressure roller 530. The pressure roller 530 is then cleaned by means of a cleaning roller (not shown).

Fixing Unit of External Heating Type

Figure 11:
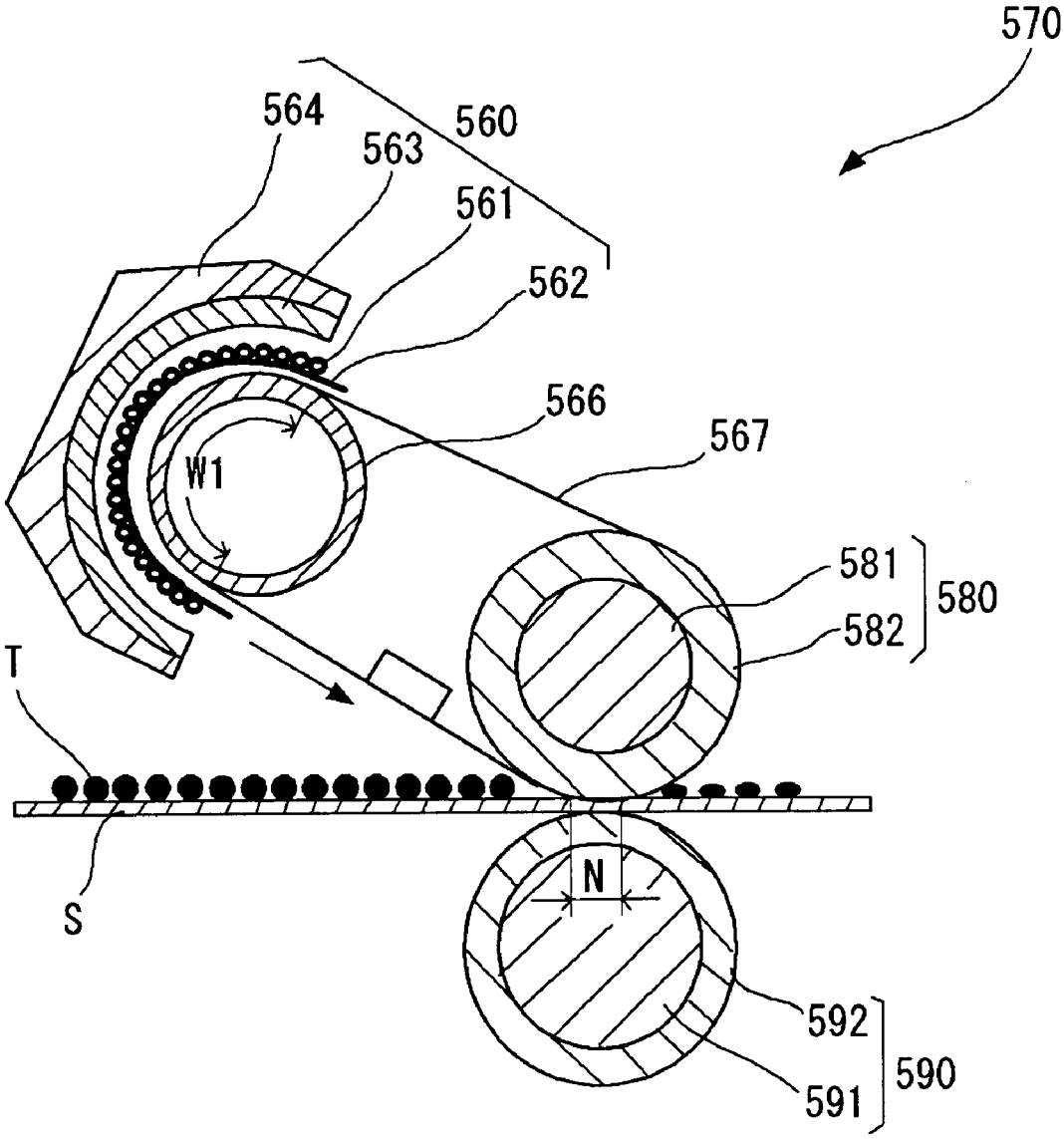
FIG. 11 is a schematic view that exemplarily shows a fixing unit of electromagnetic induction-heating type applied to an inventive image forming apparatus.

FIG. 11 exemplarily shows a fixing device 570 of electromagnetic induction-heating type. The fixing device 570 comprises a heating roller 566, a fixing roller 580, a fixing belt 567, a pressure roller 590, and an electromagnetic induction heating unit 560.

The fixing belt 567 is looped around the heating roller 566 and the fixing roller 580 disposed rotatably inside the fixing belt, and is heated at a predetermined temperature by the heating roller 566.

The heating roller 566 comprises a magnetic metal member formed of iron, cobalt, nickel, or alloy thereof, in formed of hollow cylinder; for example, the outer diameter is 20 mm to 40 mm, and a thickness is 0.3 mm to 1.0 mm, thus the heating roller 320 has a configuration of low thermal capacity and rapid thermal conductivity.

The fixing roller 580 comprises a metal core 581 formed of metal such as a stainless steel or the like, and an elastic layer 582 coated on the surface of the metal core 581. An elastic layer is formed of a thermal resistive silicone rubber in the form of solid or foam. The fixing roller 580 is rotatably mounted inside the fixing belt 567 to contact with the inner side of the fixing belt 567. In order to form a predetermined width of a nip N between the pressure roller 590 and the fixing roller 580 by the pressure from the pressure roller 590, the fixing roller 580 is configured to have an outer diameter of 20 mm to 40 mm, which is larger than that of the heating roller 566. The elastic layer 582 has a thickness of 4 mm to 6 mm so that the thermal capacity of the heating roller 566 becomes smaller than the thermal capacity of the fixing roller 580, thereby shortening the time required for warming up the heating roller 566.

The pressure roller 590 comprises a metal core 591 formed of a metal having a high thermal conductivity such as copper, aluminum, or the like, and an elastic layer 592 coated on the surface of the metal core 591. The elastic layer 592 has thermal resistance and high toner releasing-ability. The pressure roller 590 is rotatably mounted outside the fixing belt 567 so as to contact against the fixing roller 580 via the fixing belt 567. Apart from the above-listed metals, SUS may be used to form the metal core 591.

An electromagnetic induction heating unit 560 is disposed adjacent to the heating roller 566 and along the axis direction of the heating roller 566. The electromagnetic induction heating unit 560 comprises an exciting coil 561 as a magnetic field generating unit; and a coil guide plate 562 to which the exciting coil 561 is rolled up. The coil guide place 562 is disposed adjacent to the outer circumferential surface of the heating roller 566, and has a half cylinder shape. The exciting coil 561 is one long exciting coil that is alternately rolled up along the coil guide plate 562 in the axial direction of the heating roller 566. The oscillation circuit of the exciting coil 561 is connected to a frequency-variable driving power source (not shown). At the outside of the exciting coil 561, an exciting coil core 563 of a ferromagnetic element such as ferrite and of half cylinder shape is fixed to an exciting coil core supporting member 564 and is closely disposed to the exciting coil 561.

In the image-fixing device 570 shown in FIG. 11, once the exciting coil 561 of the electromagnetic induction heating unit 560 is electrified, alternating magnetic field is formed around the electromagnetic-induction heating unit 560, thereby uniformly and efficiently preheating the heating roller 566, which being adjacent to and surrounded by the exciting coil 561, by the excitation of overcurrent. A recording medium S having a toner image T to be fixed is transferred to a nip N formed between the fixing roller 580 and the pressure roller 590. The heating roller 566 is heated at a predetermined temperature by means of the electromagnetic induction heating unit 560. The fixing belt 567 is heated at the contact region W1 with the heating roller 566 by means of the heating roller 566. The toner image T on the recording medium S is heated and fused by the fixing belt 567. In this condition, the recording medium S is inserted into the nip N formed between the fixing roller 580 and the pressure roller 590. The recording medium S is then contacted with the surface of the fixing belt 580 which rotates along the rotation of the fixing roller 580 and the pressure roller 590.

The recording medium S on which the toner image T is fixed is sequentially passed through between the fixing roller 580 and the pressure roller 590, separated from the fixing belt 567, and transferred to a tray (not shown). In this process, the recording medium S is ejected towards the side of the pressure roller 590 as the non-image-contact fixing member, and thus the recording member S is prevented from wrapping around the fixing belt 567. The fixing belt 567 is then cleaned by means of a cleaning roller (not shown).

Figure 12:
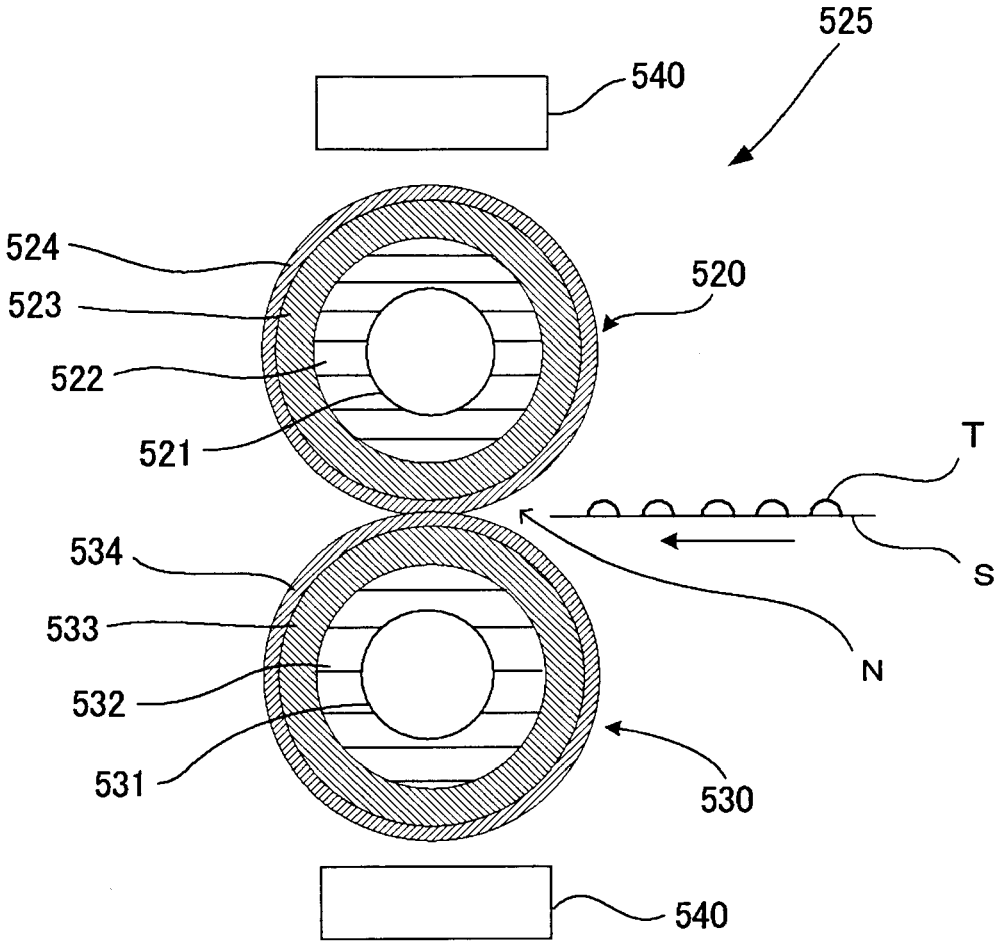
FIG. 12 is a schematic view that exemplarily shows another fixing unit of electromagnetic induction-heating type applied to an inventive image forming apparatus.

The roll-fixing device 525 of electromagnetic type shown FIG. 12 is a fixing unit that comprises a fixing roller 520, a pressure roller 530 contacting therewith, a fixing roller 520, and an electromagnetic induction heat source 540 for heating externally the pressure roller.

The fixing roller 520 has a metal core 521 on which a heat-insulative elastic layer 522, a heat-generating layer 523, and a release layer 524 are coated in this order. The pressure roller 530 has a metal core 531 on which a heat-insulative elastic layer 532, a heat-generating layer 533, and a release layer 534 are coated in this order. The release layers 524 and 534 are formed of tetrafluoroethylene perfluoroalkylvinylether (PFA).

The fixing roller 520 and the pressure roller 530 are urged to contact by a spring (not shown), thereby forming a nip N in a rotatable and compressed condition.

The electromagnetic induction heat sources 540 are disposed near the fixing roller 520 and the pressure roller 530 to heat the heat generating layers 523 and 533 by electromagnetic induction.

In the fixing unit shown in FIG. 12, the fixing roller 520 and the pressure roller 530 are uniformly and efficiently preheated by the electromagnetic induction heat sources 540. Two-dimensional higher pressures may be easily achieved at the nip N due to the combination of rollers.

Cleaning Step and Cleaning Unit

In the cleaning step, the residual toner on the photoconductor is removed, which may be favorably carried out by a cleaning unit.

In cases where the developing unit has a developer bearing member that contact with the surface of the photoconductor and develops latent electrostatic images formed on the photoconductor as well as collects the residual toner on the photoconductor, then the cleaning may be conducted without the cleaning unit in a cleaning-less manner.

The cleaning unit may be properly selected from conventional cleaners; examples thereof include magnetic brush cleaners, electrostatic static brush cleaners, magnetic roller cleaners, blade cleaners, brush cleaners, and web cleaners. Among these, cleaning blades are preferable in view of higher toner-removing ability, compact size, and lower cost.

The material of the cleaning rubber blades may be urethane rubber, silicone rubber, fluorinated rubber, chloroprene rubber, and butadiene rubber. Among these, urethane rubber is preferable in particular.

Figure 13:
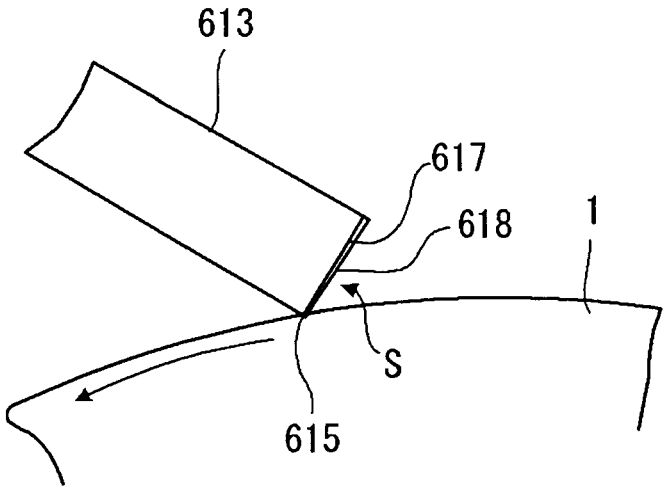
FIG. 13 is a schematic view that exemplarily shows a cleaning blade applied to an inventive image forming apparatus.

FIG. 13 is an enlarged view that explains around the contacting site 615 between a cleaning blade 613 and the photoconductor. The cleaning blade 613 has a toner-blocking face 617 in a relation with the photoconductor drum 1. In this embodiment, the toner-blocking face 617 broadens from the contacting portion 615 toward the upstream of the rotating direction of the photoconductor drum 1 to form an acute angle in the space S.

A coating 618 is provided at the toner-blocking face 617, as shown in FIG. 13, as a higher friction portion with higher friction coefficients. The coating 618 is formed of a material with a higher friction coefficient than that of the cleaning blade 613. The higher friction material is exemplified by diamond-like carbon (DLC), but not limited to The coating 618 is provided on the toner-blocking face 617 that does not contact with the surface of the photoconductor drum 1.

The cleaning unit may comprise a toner-collecting blade that collect the residual toner scraped by the cleaning blade and a toner-collecting coil that conveys the residual toner collected by the toner-collecting blade (not shown).

Image Forming Apparatus of Cleaning-Less Type

Figure 14:
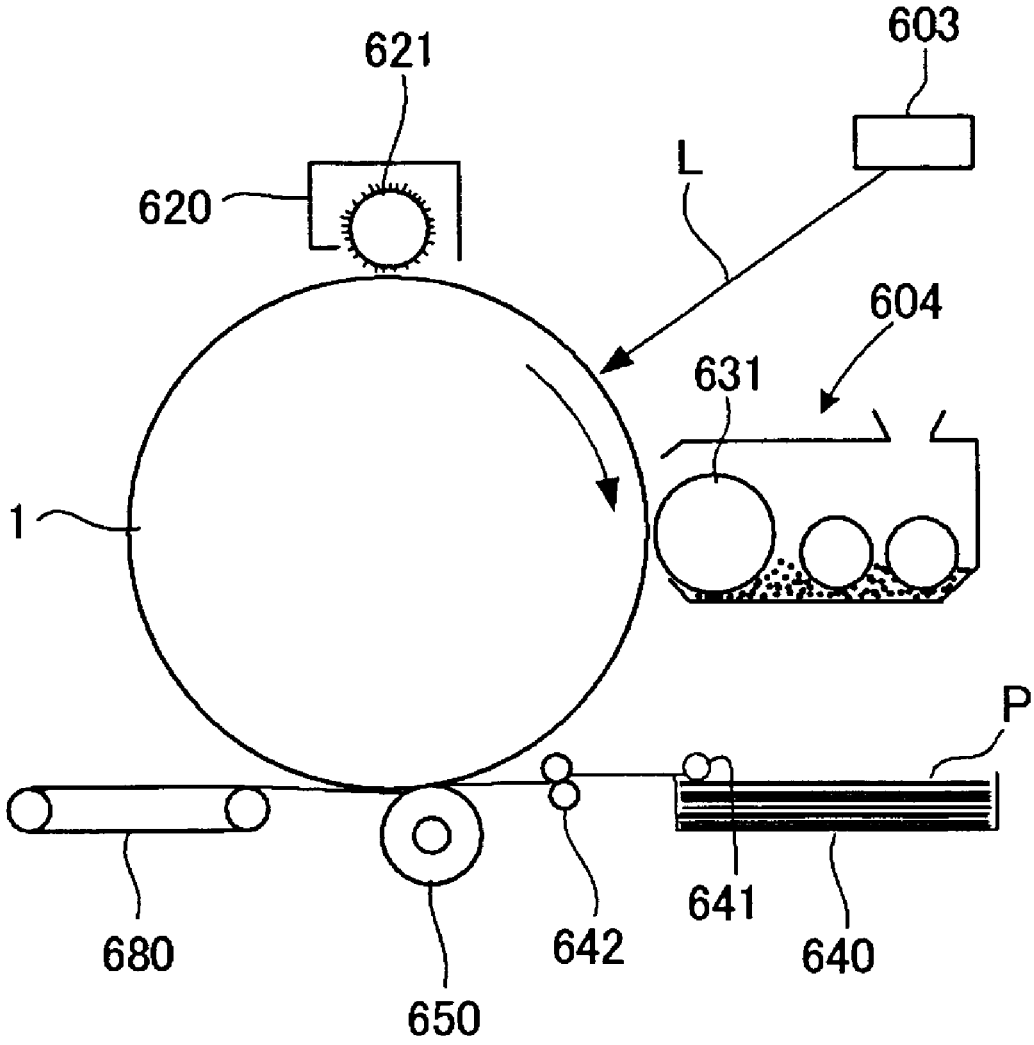
FIG. 14 is a schematic view that exemplarily shows an inventive image forming apparatus of cleaning-less type.

FIG. 14 is a schematic view that exemplarily shows an image forming apparatus of cleaning-less type where its developing unit acts also as a cleaning unit.

The image forming apparatus comprises, as shown in FIG. 14, a photoconductor drum 1, a brush charging unit 620, an exposing unit 603, a developing unit 604, a paper-feeding caste 640, a roller-transfer unit 650, and a recording medium P.

In the image forming apparatus of cleaning-less type, the residual toner on the photoconductor drum 1 comes to a contact-charging device 620, which contacting with the photoconductor drum 1 by action of successively rotating photoconductor drum 1, where the toner is temporarily collected by a magnetic brush (not shown) of a brush charging member that contact with the photoconductor drum, then the toner is ejected again onto the surface of the photoconductor drum 1, and then is finally collected by the developer bearing member 631 along with the developer into the developing unit 604, and the photoconductor drum 1 is repeatedly subjected to image formation.

The "developing unit 604 acts also as a cleaning unit" means a process where some residual toner on the photoconductor drum 1 after the transferring is collected by use of a developing bias, i.e. the potential difference between DC voltage applied to the developer bearing member 631 and the surface voltage of the photoconductor drum.

In the image forming apparatus where the developing unit acts also as a cleaning unit, the residual toner is collected into the developing unit 604 and reused in the following steps, therefore, such effects may be achieved as elimination of waste toner, maintenance free, and cleaner-less system, thus leading to higher space efficiency and significant downsize of image forming apparatuses.

Other Step and Other Device

In the discharging step, the electrophotographic photoconductor is discharged by applying a discharging bias, and the step may be favorably performed by a discharging device.

The discharging device may be properly selected from conventional discharging devices as long as the discharging bias is applied to the electrophotographic photoconductor; examples thereof include discharge lamps.

In the recycling step, toners removed in the cleaning step are recycled into the developing unit, which may be appropriately carried out by recycling devices. The recycling unit may be, for example, conventional conveying devices.

In the controlling step, the respective steps described above are controlled, which may be appropriately carried out by controlling units. The controlling units may be properly selected as long as capable of controlling the units described above; examples thereof include equipments or instruments such as sequencers and computers.

One embodiment of the image forming method of the present invention by means of the image forming apparatus will be explained with reference to FIG. 15. The image forming apparatus 100 shown in FIG. 15 comprises a photoconductor drum 10 of a latent electrostatic image bearing member, a charging roller 20 as a charging unit, an exposure device 30 as an exposing unit, a developing device 40 as a developing unit, an intermediate transferring member 50, a cleaning device 60 as a cleaning unit, and a charge removing lamp 70 as a charge removing unit.

The intermediate transferring member 50 is an endless belt, and is designed to loop around three rollers 51 disposed therein and to rotate in the direction shown by the arrow by means of the rollers 51. One or more of the three rollers 51 also functions as a transfer bias roller capable of applying a certain transfer bias or a primary bias to the intermediate transferring member 50. A cleaning blade 90 is provided adjacent to the intermediate transferring member 50. There is provided a transferring roller 80 next to the intermediate transferring member 50 as the transferring unit capable of applying a transfer bias so as to transfer a developed image (toner image) to a recording medium 95, a recording medium (secondary transferring). Moreover, there is provided a corona charger 58 around the intermediate transferring member 50 for applying charges to the toner image transferred on the intermediate transferring medium 50. The corona charger 58 is arranged between the contact region of the photoconductor 10 and the intermediate transferring medium 50 and the contact region of the intermediate transferring medium 50 and the recording medium 95.

The developing device 40 comprises a developing belt 41 as a developer bearing member, a black developing unit 45K, yellow developing unit 45Y, magenta developing unit 45M and cyan developing unit 45C, the developing units being positioned around the developing belt 41. The black developing unit 45K comprises a developer container 42K, a developer supplying roller 43K, and a developing roller 44K. The yellow developing unit 45Y comprises a developer container 42Y, a developer supplying roller 43Y, and a developing roller 44Y. The magenta developing unit 45M comprises a developer container 42M, a developer supplying roller 43M, and a developing roller 44M. The cyan developing unit 45C comprises a developer container 42C, a developer supplying roller 43C, and a developing roller 44C. The developing belt 41 is an endless belt looped around a plurality of belt rollers so as to be rotatable. A part of the developing belt 41 is in contact with the photoconductor 10.

Figure 15:
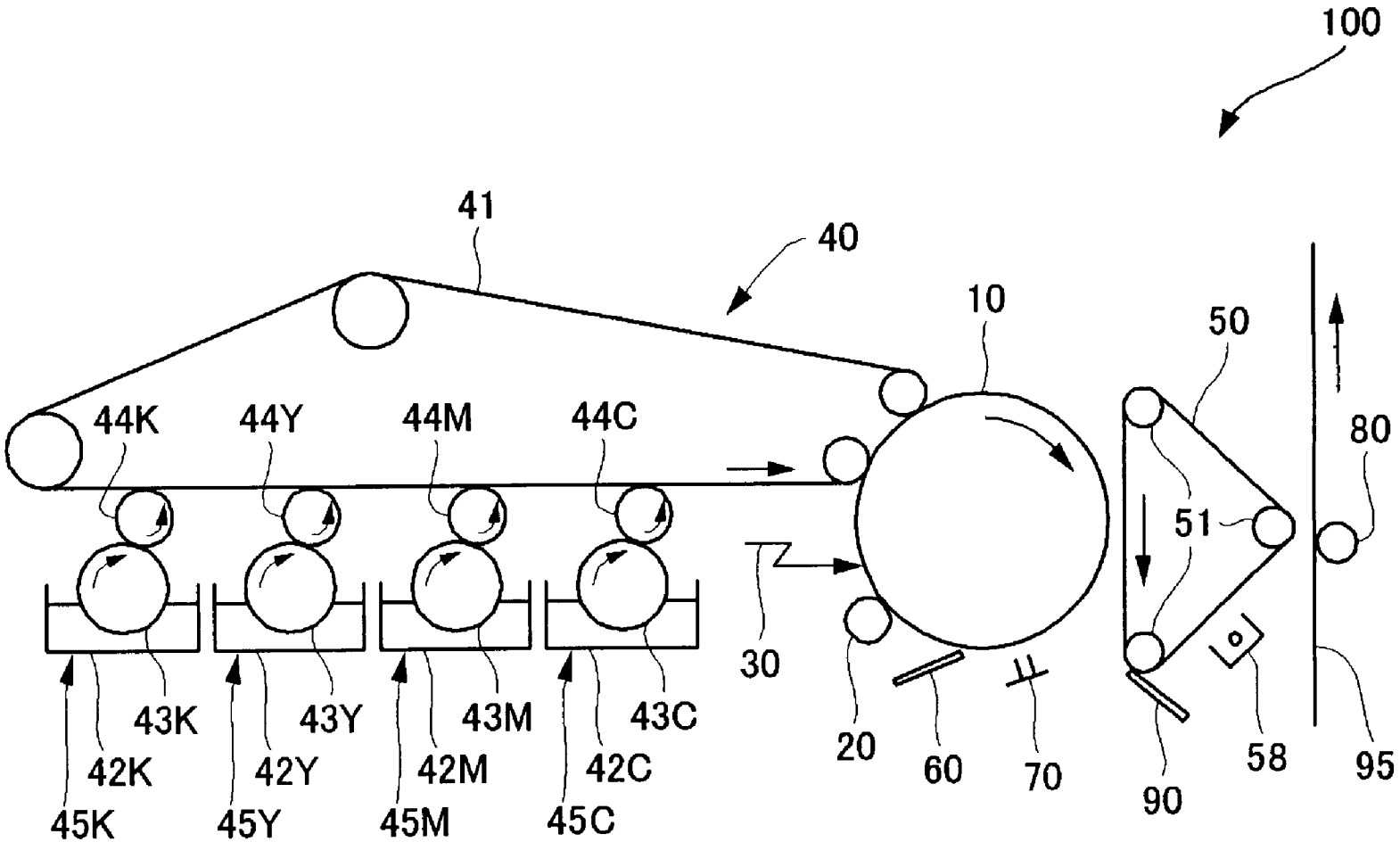
FIG. 15 is a schematic view that exemplarily shows an inventive image forming apparatus.

In the image forming apparatus 100 shown in FIG. 15, the photoconductor drum 10 is uniformly charged by means of, for example, the charging roller 20. An exposure device (not shown) then applies light 30 to the photoconductor drum 10 so as to form a latent electrostatic image. The latent electrostatic image formed on the photoconductor drum 10 is provided with toner from the developing device 40 to form a visible image. The roller 51 applies a bias to the toner image to transfer the visible image onto the intermediate transferring medium 50 (primary transferring), and further applies a bias to transfer the toner image from the intermediate transferring medium 50 to the recording medium 95 (secondary transferring). In this way a transferred image is formed on the recording medium 95. Thereafter, toner particles remained on the photoconductor drum 10 are removed by means of the cleaning device 60, and charges of the photoconductor drum 10 are removed by means of the charge removing lamp 70 on a temporary basis.

Figure 16:
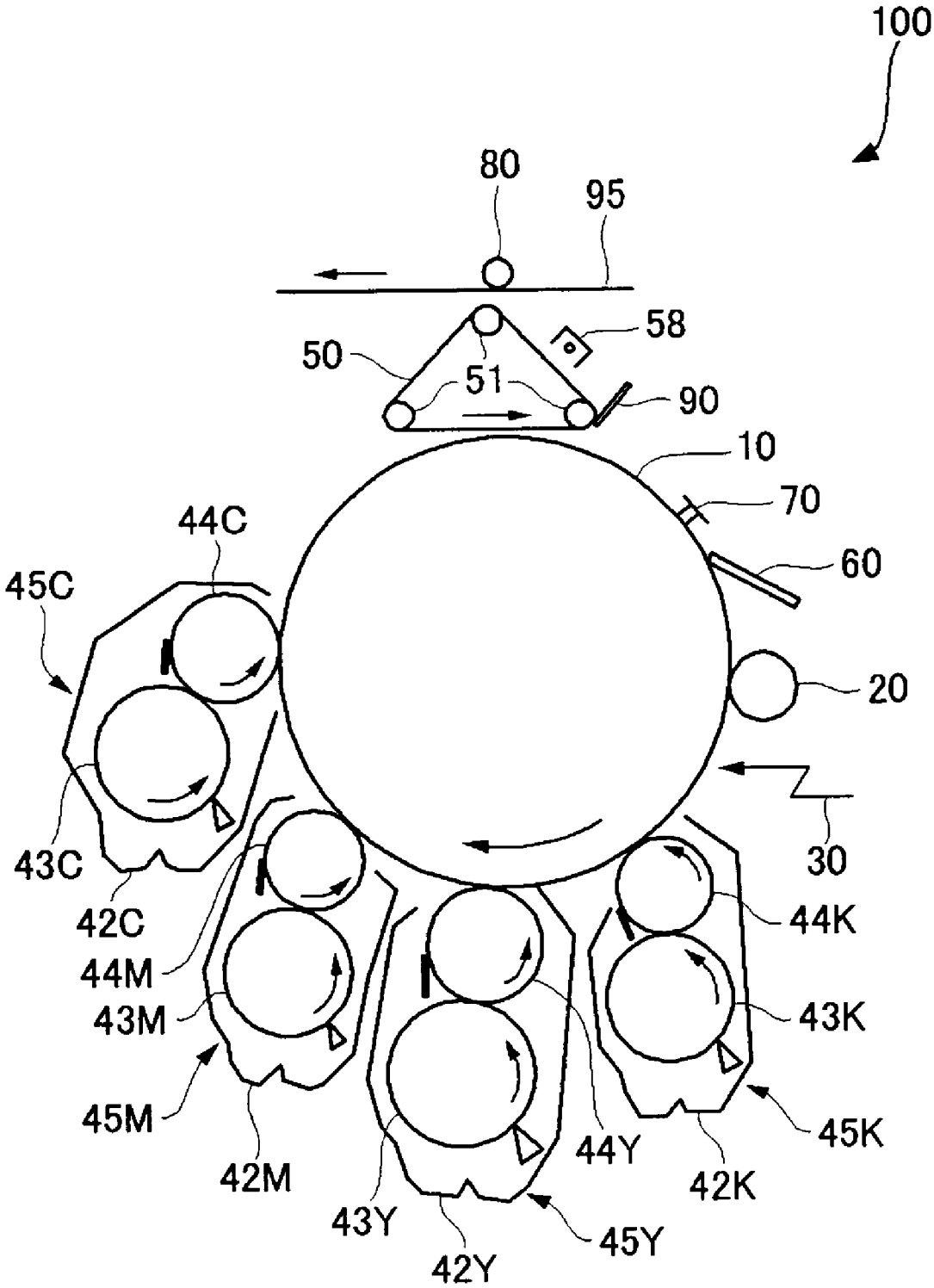
FIG. 16 is a schematic view that exemplarily shows another inventive image forming apparatus.

Another embodiment of the image forming method of the present invention by means of the image forming apparatus will be explained with reference to FIG. 16. The image forming apparatus 100 shown in FIG. 16 has an identical configuration and working effects to those of the image forming apparatus 100 shown in FIG. 15 except that this image forming apparatus 100 does not comprise the developing belt 41 and that the black developing unit 45K, yellow developing unit 45Y, magenta developing unit 45M and cyan developing unit 45C are disposed around the periphery of the photoconductor 10. The reference members identical to those in FIG. 16 are denoted by the same reference numerals as those of FIG. 15.

Tandem Image Forming Apparatus and Image Forming Method

Figure 17:
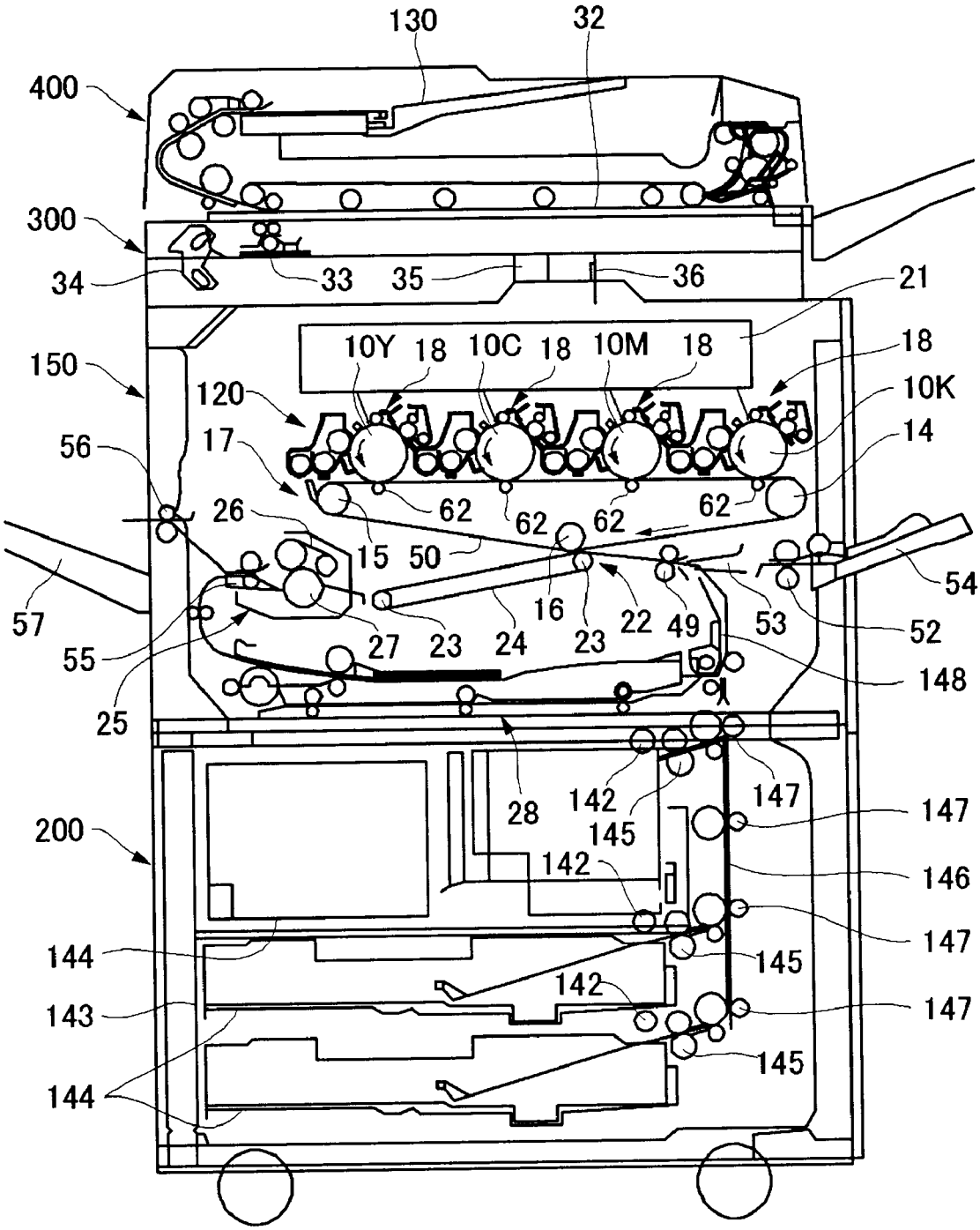
FIG. 17 is a schematic view that exemplarily shows an inventive tandem-type image forming apparatus.

Another embodiment of the image forming method of the present invention by means of the image forming apparatus will be described with reference to FIG. 17. The image forming apparatus 100 shown in FIG. 17 is a tandem color image-forming apparatus. The tandem image forming apparatus comprises a copy machine main body 150, a feeder table 200, a scanner 300, and an automatic document feeder (ADF) 400.

The copy machine main body 150 has an endless-belt intermediate transferring member 50 in the center. The intermediate transferring member 50 is looped around support rollers 14, 15 and 16 and is configured to rotate in a clockwise direction in FIG. 5. A cleaning device 17 for the intermediate transferring member is provided in the vicinity of the support roller 15. The cleaning device 17 removes toner particles remained on the intermediate transferring member 50. On the intermediate transferring member 50 looped around the support rollers 14 and 15, four color-image forming devices 18 of yellow, cyan, magenta, and black are arranged, constituting a tandem developing unit 120. An exposing unit 21 is arranged adjacent to the tandem developing unit 120. A secondary transferring unit 22 is arranged across the intermediate transferring member 50 from the tandem developing unit 120. The secondary transferring unit 22 comprises a secondary transferring belt 24, an endless belt, which is looped around a pair of rollers 23. A paper sheet on the secondary transferring belt 24 is allowed to contact the intermediate transferring member 50. An image fixing device 25 is arranged in the vicinity of the secondary transferring unit 22. The image fixing device 25 comprises a fixing belt 26, an endless belt, and a pressurizing roller 27 which is pressed by the fixing belt 26.

In the tandem image forming apparatus, a sheet reverser 28 is arranged adjacent to both the secondary transferring unit 22 and the image fixing device 25. The sheet reverser 28 turns over a transferred sheet to form images on the both sides of the sheet of recording medium.

Next, full-color image formation (color copying) using the tandem developing unit 120 will be described. At first, a source document is placed on a document tray 130 of the automatic document feeder 400. Alternatively, the automatic document feeder 400 is opened, the source document is placed on a contact glass 32 of a scanner 300, and the automatic document feeder 400 is closed.

When a start switch (not shown) is pushed, the source document placed on the automatic document feeder 400 is transferred onto the contact glass 32, and the scanner is then driven to operate first and second carriages 33 and 34. In a case where the source document is originally placed on the contact glass 32, the scanner 300 is immediately driven after pushing of the start switch. Light is applied from a light source to the document by means of the first carriage 33, and light reflected from the document is further reflected by the mirror of the second carriage 34. The reflected light passes through an image-forming lens 35, and a read sensor 36 receives it. In this way the color document (color image) is scanned, producing 4 types of color information of black, yellow, magenta, and cyan.

Figure 18:
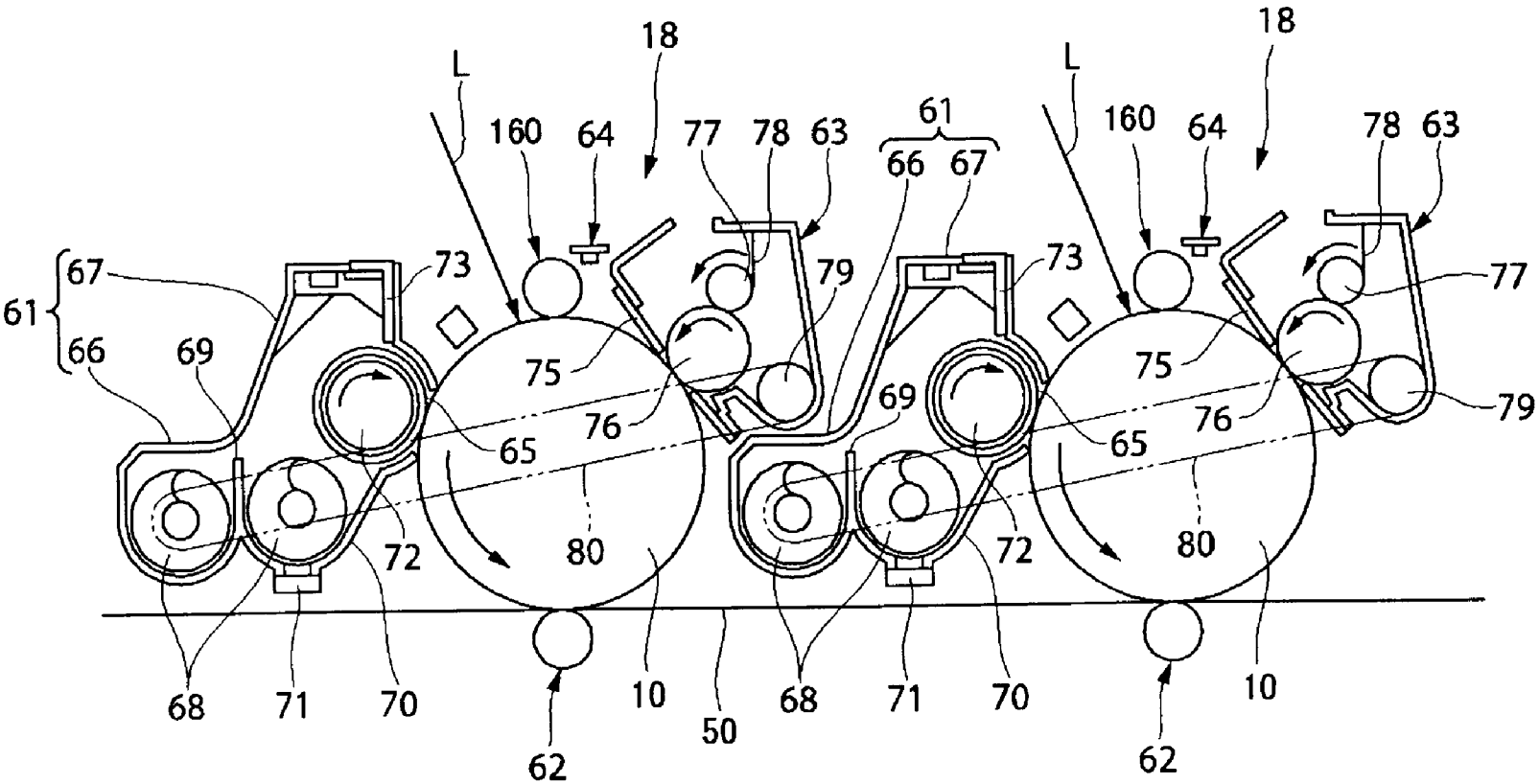
FIG. 18 is an enlarged view of the image forming elements shown in FIG. 17.

Each piece of color information (black, yellow, magenta, and cyan) is transmitted to the image forming unit 18 (black image forming unit, yellow image forming unit, magenta image forming unit, or cyan image forming unit) of the tandem developing unit 120, and toner images of each color are formed in the image-forming units 18. As shown in FIG. 18, each of the image-forming units 18 (black image-forming unit, yellow image forming unit, magenta image forming unit, and cyan image forming unit) of the tandem developing unit 120 comprises: a latent electrostatic image bearing member 10 (latent electrostatic image bearing member for black 10K, latent electrostatic image bearing member for yellow 10Y, latent electrostatic image bearing member for magenta 10M, or latent electrostatic image bearing member for cyan 10C); a charging device 60 for uniformly charging the latent electrostatic image bearing member; an exposing unit for forming a latent electrostatic image corresponding to the color image on the latent electrostatic image bearing member by exposing it to light (denoted by "L" in FIG. 18) on the basis of the corresponding color image information; a developing device 61 for developing the latent electrostatic image using the corresponding color toner (black toner, yellow toner, magenta toner, or cyan toner) to form a toner image; a transfer charger 62 for transferring the toner image to the intermediate transferring member 50; a cleaning device 63; and a charge removing device 64. Thus, images of different colors (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred onto the intermediate transferring member 50 which rotates by means of support rollers 14, 15 and 16 (primary transferring). These toner images are overlaid on the intermediate transferring member 50 to form a composite color image (color transferred image).

On the other hand, one of feed rollers 142 of the feed table 200 is selected and rotated, whereby a sheet of recording medium is ejected from one of multiple feed cassettes 144 in the paper bank 143 and are separated one by one by a separation roller 145. Thereafter, the sheet is fed to a feed path 146, transferred by a transfer roller 147 into a feed path 148 inside the copying machine main body 150, and are bumped against a resist roller 49 to stop. Alternatively, one of the feed rollers 142 is rotated to eject the recording medium placed on a manual feed tray. The sheets are then separated one by one by means of a separation roller 52, fed into a manual feed path 53, and similarly, bumped against the resist roller 49 to stop. The resist roller 49 is generally earthed, but it may be biased for removing paper dusts on the sheet. The resist roller 49 is rotated synchronously with the movement of the composite color image on the intermediate transferring member 50 to transfer the recording medium into between the intermediate transferring member 50 and the secondary transferring unit 22, and the composite color image is transferred onto the sheet by means of the secondary transferring unit 22 (secondary transferring). In this way the color image is formed on the sheet. After image transferring, toner particles remained on the intermediate transferring member 50 are cleaned by means of the cleaning device 17.

The sheet of recording medium having the transferred color image is conveyed by the secondary transferring unit 22 into the image fixing device 25, where the composite color image (color transferred image) is fixed to the sheet (recording sheet) by heat and pressure. Thereafter, the sheet changes its direction by action of a switch hook 55, ejected by an ejecting roller 56, and stacked on an output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

Toner Container

The toner container contains the toner and/or the developer of the present invention in the container. The container may be properly selected from conventional ones; preferable examples of the container include one having a toner container body and a cap.

The toner container body is not particularly limited in size, shape, structure, and material and can be appropriately selected in accordance with a purpose. The shape is preferably a cylinder. It is particularly preferable that a spiral ridge is formed on the inner surface; thereby the content or the toner moves toward the discharging end when rotated and the spiral part partly or entirely serves as a bellows.

The material of the toner container body is not particularly limited and preferably offers dimensional accuracy. For example, resins are preferable. Among them, polyester resin, polyethylene resin, polypropylene resin, polystyrene resin, polyvinyl chloride resin, polyacrylic acid, polycarbonate resin, ABS resin, polyacetal resin are preferable.

The toner container is easy to preserve and ship, is handy, and is preferably used with the process cartridge and image forming apparatus of the present invention, which are described later, by detachably mounting therein for supplying toner.

Process Cartridge

The process cartridge contains a latent electrostatic image bearing member that is configured to bear a latent electrostatic image thereon, and a developing unit which is configured to develop the latent electrostatic image on the latent electrostatic image bearing member with a developer to form a visible image. The process cartridge further contains other units such as charging units, transfer units, cleaning units and discharging units as necessary.

The toner comprises a binder resin and a colorant, and the binder resin comprises a polyester resin that is prepared by condensation polymerization between an alcohol component that contains an aliphatic polyvalent alcohol and a carboxylic acid component that contains (meth)acrylic acid-modified rosin.

The polyester resin may be substantially the same as those explained in the image forming apparatuses and image forming methods described above.

The developing unit has a developer storage for storing the aforementioned toner and/or developer of the present invention and a developer bearing member which is configured to hold and transfer the toner and/or developer stored in the developer storage and may further have a layer thickness control member for controlling the thickness of a toner layer formed on the developer bearing member. Specifically, one-component developing units or two-component developing units described above may be preferably employed.

The charging unit, transfer unit, cleaning unit and discharging unit may be substantially the same as those explained in image forming apparatuses.

The process cartridge may be detachably mounted in a variety of electrophotographic apparatuses, facsimiles and printers and preferably detachably mounted in the image forming apparatus of the present invention.

Figure 19:
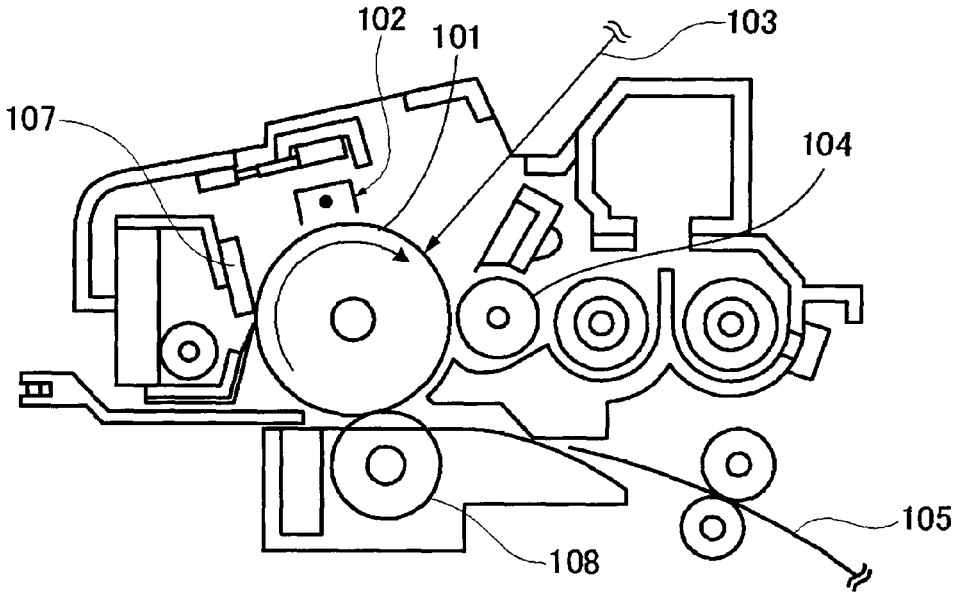
FIG. 19 is a schematic view that exemplarily shows an inventive process cartridge.

The process cartridge comprises, for example as shown in FIG. 19, a built-in photoconductor 101, charging unit 102, developing unit 104, and cleaning unit 107 and, where necessary, further contains other members. In FIG. 19, light irradiation 103 by means of an exposure unit and recording medium 105 are also shown.

The image forming process by means of the process cartridge as shown in FIG. 19 will be explained. A latent electrostatic image corresponding to an exposed image is formed on the photoconductor 101 which is being rotated in an arrow direction by charging using the charging unit 102 and exposing using exposure 103 of exposure unit (not shown). The latent electrostatic image is developed using the toner by means of the developing unit 104, the toner image is then transferred to the recording medium 105 by means of the transfer unit 108 and printed out. The surface of the photoconductor after image transfer is cleaned by means of the cleaning unit 107 and further discharged by means of a discharging unit (not shown) and the above operations are repeated again.

EXAMPLES

The present invention will be explained in terms of Examples, to which the present invention will be defined in no way. In the following descriptions, all percentages and parts are expressed by mass unless indicated otherwise.

In Examples and Comparative Examples, softening temperature of polyester resin, glass transition temperature Tg of polyester resin, softening temperature of rosin, acid value of polyester resin or rosin, hydroxyl value of polyester resin, content of low molecular-weight components having a molecular weight of no more than 500, SP value of rosin, and modification degree of rosin by (meth)acrylic acid were measured in the following ways.

Measurement of Softening Temperature of Polyester Resin

Using a flow tester (CFT-500D, by Shimadzu Co.), 1 g of a polyester binder resin as a sample is extruded from a nozzle of 1 mm diameter and 1 mm long under 1.96 MPa load from a plunger while heating at heat-up rate 6° C./min; and the descent level of the plunger is plotted against the temperature. The temperature, at which half of the polyester binder resin has flowed out, is determined as the softening temperature.

Measurement of Glass Transition Temperature Tg of Polyester Resin

Using a differential scanning calorimeter (DSC210, by Seiko Instrument Inc.), 0.01 to 0.02 g of a polyester binder resin as a sample is weighed on an aluminum pan, which is then heated to 200° C., thereafter the sample is cooled to 0° C. at cool-down rate 10° C./min followed by heating up at a rate of 10° C./min. The glass transition temperature is determined at the temperature of the point where two lines intersect, i.e. between the extending line of the base line below the endothermal maximum peak temperature and the tangent line at the maximum gradient from the rising point to the peak point.

Softening Temperature of Rosin (i) Preparation of Sample 10 g of rosin is melted on a hot plate at 170° C. for 2 hours. Then the rosin is allowed to cool under open condition of temperature 25° C. and relative humidity 50% for 1 hour, then milled for 10 seconds by use of a coffee mill (National MK-61M) to prepare a sample.

(ii) Measurement

Using a flow tester (CFT-500D, by Shimadzu Co.), 1 g of the sample is extruded from a nozzle of 1 mm diameter and 1 mm long under 1.96 MPa load from a plunger while heating at heat-up rate 6° C./min; the descent level of the plunger is plotted against the temperature. The temperature, at which half of the polyester binder resin has flowed out, is determined as the softening temperature.

Acid Value of Polyester Resin or Rosin

Acid value is determined in accordance with JIS K0070, except that the solvent is changed from the mixture of methanol and ether defined in JIS K0070 into a mixture of acetone and toluene (acetone/toluene=1/1 by volume).

Hydroxyl Value of Polyester Resin

Hydroxyl value of polyester resin is determined in accordance with JIS K0070.

Content of Low Molecular-Weight Components

A molecular weight distribution is measured using a gel permeation chromatography (GPC). Initially, 10 mL of tetrahydrofuran is added to 30 mg of a polyester binder resin, the mixture is stirred by a ball mill for one hour to prepare a solution, which is then filtered through a fluorocarbon resin filter FP-200 (pore size 2 μm, by Sumitomo Electric Industries Ltd.) to remove insoluble matters, thereby to prepare a sample solution.

Then, tetrahydrofuran is flowed at 1 mL/min as an eluting solvent into an analytical column in a constant-temperature bath at 40° C. to condition the column, followed by injecting 100 μL of the sample solution. The column is GMHLX+G3000HXL (by Tosoh Co.). The analytical curve is prepared using several types of monodisperse polystyrene as standard samples ($2.63\times10^3$, $2.06\times10^4$, $1.02\times10^5$, by Tosoh Co.; $2.10\times10^3$, $7.00\times10^3$, $5.04\times10^4$, by JL Sciences Inc.).

The content (%) of low molecular-weight components having a molecular weight of no more than 500 is calculated from the corresponding area within the entire chart area obtained using a refractive index (RI) detector.

SP Value of Rosin

A sample of melted rosin 2.1 g is flowed into a certain ring followed by allowing to cool to room temperature, then is determined in accordance with JIS B7410 under the following conditions:

Test device: automatic softening point meter of annulus ring type (ASP-MGK2, by Meitec Co.)

Heat-up rate: 5° C./min

Heating up temperature: 40° C.

Solvent: glycerin

Example A in First Aspect of Present Invention

Modification Degree of Rosin by (Meth)Acrylic Acid

The modification degree of rosin by (meth)acrylic acid, i.e. (meth)acrylic acid-modification degree, (referred to as "MD by AA") is calculated from the Formula (1A):

$$MD\ \text{by}\ AA = \frac{X_1 - Y}{X_2 - Y} \times 100$$

In the Formula (1A), $X_1$ represents an SP value of (meth) acrylic acid-modified rosin to be calculated for the modification degree; $X_2$ represents a saturated SP value of (meth) acrylic acid-modified rosin obtained by reaction between one mole of (meth)acrylic acid and one mole of rosin; Y is an SP value of rosin. The saturated SP value means the value of rosin obtained through the reaction between the (meth)acrylic acid and the rosin, in which the reaction is continued till the SP value of the resulting (meth)acrylic acid-modified rosin comes to a saturated value. When the acid value of rosin is "x" (mg KOH/g), "x" mg of potassium hydroxide (molecular weight: 56.1) is allowed to react with 1 g of the rosin, thus the molecular weight of the rosin can be calculated by 56100÷x.

Synthetic Example 1

Purification of Rosin 1000 g of tall rosin was added into a flask of 2000 mL equipped with a fractionating column, a reflux condenser, and a trap, and was distilled under a reduced pressure of 1 kPa, thereby distillate at 195° C. to 250° C. was mainly collected. Hereinafter, tall rosin to be purified is referred to as unpurified rosin, and rosin from which main distilling components having been removed is referred to as purified rosin.

20 g of rosin was milled for 5 seconds by use of a coffee mill (National MK-61M), and passed through a mesh of opening 1 mm, then the resulting powder was weighed in an amount of 0.5 g into a vial (20 mL) for headspace. Headspace gas was sampled and impurities within unpurified or purified rosin were analyzed by a headspace GC-MS method as follows. The results are shown in Table 1A.

Measuring Condition in Headspace GC-MS Method (A) Headspace Sampler (HP7694, by Agilent Co.)

Sample temperature: 200° C.
Loop temperature: 200° C.
Transfer line temperature: 200° C.
Heating time of equilibrium sample: 30 minutes
Pressure gas in vial: helium (He)
Pressure time at vial: 0.3 minute
Loop filling time: 0.03 minute
Equilibrium time at loop: 0.3 minute
Injecting time: 1 minute (B) Gas Chromatography (GC) (HP6890, by Agilent Co.)

Analytical column: DB-1 (60 m-320 μm-5 μm)
Carrier gas: helium (He)
Flow rate: 1 mL/min
Injection temperature: 210° C.
Column head pressure: 34.2 kPa
Injection mode: split
Split ratio: 10:1
Oven temperature: 45° C. (3 minutes)-10° C./min-280° C. (15 minutes)

(C) Mass Spectrometry (MS) (HP5973, by Agilent Co.)

Ionization method: electron impulse (EI)
Interface temperature: 280° C.
Ion source temperature: 230° C.
Quadrupole temperature: 150° C.
Detection mode: Scan 29 to 350 m/sec

TABLE 1A

| | hexanoic acid | pentanoic acid | benzaldehyde | n-hexanal | 2-pentyl-furan | SP value ° C. | Softening Tem. ° C. | Acid Value (mgKOH/g) | Molecular weight |
|---|---|---|---|---|---|---|---|---|---|
| Unpurified Rosin | $0.9 \times 10^7$ | $0.6 \times 10^7$ | $0.6 \times 10^7$ | $1.8 \times 10^7$ | $1.1 \times 10^7$ | 77.0 | 74.3 | 169 | 332 |
| Purified Rosin | $0.4 \times 10^7$ | $0.2 \times 10^7$ | $0.2 \times 10^7$ | $1.4 \times 10^7$ | $0.7 \times 10^7$ | 76.8 | 75.1 | 166 | 338 |

Saturated SP Value

Saturated SP value of acrylic acid-modified rosin prepared from unpurified rosin was measured as follows. 332 g (1 mole) of unpurified rosin (SP value: 77.0° C.) and 72 g (1 mole) of acrylic acid were added into a flask of 1000 mL equipped with a fractionating column, a reflux condenser, and a trap, and the reactant was heated up from 160° C. to 230° C. over 8 hours. After checking that SP value represents no rise at 230° C., unreacted acrylic acid and volatile substances were distilled away under a reduced pressure of 5.3 kPa thereby to prepare an acrylic acid-modified rosin. The SP value of the resulting acrylic acid-modified rosin, i.e. the saturated SP value of the acrylic acid-modified rosin prepared from the unpurified rosin was 110.1° C.

Saturated SP Value

Saturated SP value of acrylic acid-modified rosin prepared from purified rosin was measured as follows. 338 g (1 mole) of unpurified rosin (SP value: 76.8° C.) and 72 g (1 mole) of acrylic acid were added into a flask of 1000 mL equipped with a fractionating column, a reflux condenser, and a trap, and the reactant was heated up from 160° C. to 230° C. over 8 hours. After checking that SP value represents no rise at 230° C., unreacted acrylic acid and volatile substances were distilled away under a reduced pressure of 5.3 kPa thereby to prepare an acrylic acid-modified rosin. The SP value of the resulting acrylic acid-modified rosin, i.e. the saturated SP value of the acrylic acid-modified rosin prepared from the purified rosin was 110.4° C.

Synthesis Example 2

Synthesis of Acrylic Acid-Modified Rosin A 6084 g (18 moles) of purified rosin (SP value: 76.8° C.) and 907.9 g (12.6 moles) of acrylic acid were added into a flask of 10 L equipped with a fractionating column, a reflux condenser, and a trap, and the reactant was heated up from 160° C. to 220° C. over 8 hours. The reactant was allowed to react at 220° C. for 2 hours followed by distilling under a reduced pressure of 5.3 kPa thereby to prepare an acrylic acid-modified rosin A. The resulting acrylic acid-modified rosin A had an SP value of 110.4° C. and an acrylic acid-modification degree of 100.

Synthesis Example 3

Synthesis of Acrylic Acid-Modified Rosin B 6084 g (18 moles) of purified rosin (SP value: 76.8° C.) and 648.5 g (9.0 moles) of acrylic acid were added into a flask of 10 L equipped with a fractionating column, a reflux condenser, and a trap, and the reactant was heated up from 160° C. to 220° C. over 8 hours. The reactant was allowed to react at 220° C. for 2 hours followed by distilling under a reduced pressure of 5.3 kPa thereby to prepare an acrylic acid-modified rosin B. The resulting acrylic acid-modified rosin A had an SP value of 99.1° C. and an acrylic acid-modification degree of 66.4.

Synthesis Example 4

Synthesis of Acrylic Acid-Modified Rosin C 6084 g (18 moles) of purified rosin (SP value: 76.8° C.) and 259.4 g (3.6 moles) of acrylic acid were added into a flask of 10 L equipped with a fractionating column, a reflux condenser, and a trap, and the reactant was heated up from 160° C. to 220° C. over 8 hours. The reactant was allowed to react at 220° C. for 2 hours followed by distilling under a reduced pressure of 5.3 kPa thereby to prepare an acrylic acid-modified rosin C. The resulting acrylic acid-modified rosin A had an SP value of 91.9° C. and an acrylic acid-modification degree of 44.9.

Synthesis Example 5

Synthesis of Acrylic Acid-Modified Rosin D 5976 g (18 moles) of unpurified rosin (SP value: 77.0° C.) and 907.6 g (12 moles) of acrylic acid were added into a flask of 10 L equipped with a fractionating column, a reflux condenser, and a trap, and the reactant was heated up from 160° C. to 220° C. over 8 hours. The reactant was then allowed to react at 250° C. for 2 hours followed by distilling under a reduced pressure of 5.3 kPa thereby to prepare an acrylic acid-modified rosin D. The resulting acrylic acid-modified rosin D had an SP value of 110.1° C. and an acrylic acid-modification degree of 100.

Synthetic Examples 6 to 10 and 12 to 13

Synthesis of Polyester Binder Resins 1 to 5 and 7 to 8

The alcohol components, carboxylic acid components other than anhydrous trimellitic acid, and esterification catalysts shown in Table 2A were added into a four-necked 5 L flask, equipped with a distillation tube, flowing 98° C. warm water, mounted upward a condenser flowing water at room temperature, a nitrogen inlet, a water outlet, a stirrer, and a thermocouple, then the mixture was subjected to condensation polymerization at 160° C. for 2 hours under nitrogen atmosphere, then the reactant was heated to 210° C. over 6 hours, followed by allowing to react for 1 hour under 66 kPa. After cooling the reactant to 200° C., anhydrous trimellitic acid was added, then the mixture was allowed to react for 1 hour under normal pressure 101.3 kPa followed by rising to 210° C. and continued to react under 40 kPa till the reactant took an intended softening temperature; thereby, polyester binder resins 1 to 5 and 7 to 8 were synthesized.

Synthetic Example 11

Synthesis of Polyester Binder Resin 6

The alcohol components other than glycerin, carboxylic acid components other than anhydrous trimellitic acid, and esterification catalysts shown in Table 2A were added into a four-necked 5 L flask, equipped with a distillation tube, flowing 98° C. warm water, mounted upward a condenser flowing water at room temperature, a nitrogen inlet, a water outlet, a stirrer, and a thermocouple, then the mixture was subjected to condensation polymerization at 160° C. for 2 hours under nitrogen atmosphere, then the reactant was heated to 210° C. over 6 hours, followed by allowing to react for 1 hour under 66 kPa. After cooling the reactant to 180° C., glycerin was added into the flask, and the reactant was heated to 200° C. at a rate of 5° C./30 min. Then the reactant was allowed to react at 200° C. under normal pressure 101.3 kPa for 1 hour and under 66 kPa for 1 hour. Thereafter anhydrous trimellitic acid was added, then the mixture was allowed to react for 11 hours under normal pressure 101.3 kPa followed by rising to 210° C. and continued to react under 40 kPa till the reactant took an intended softening temperature; thereby, polyester binder resin 6 was synthesized.

Production Example 1

Production of Master Batch 1

The pigments shown below, polyester binder resin 1, and pure water were mixed in a ratio of 1:1:0.5 by mass, and kneaded by a twin roll at 70° C.; then the roll temperature was risen to 120° C. to evaporate water, thereby to produce master batch 1 of cyan toner master batch 1 (TB-C1), magenta toner master batch 1 (TB-M1), yellow toner master batch 1 (TB-Y1), and black toner master batch 1 (TB-K1).

Formulation of Cyan Toner Master Batch 1 (TB-C1)

| | |
|---|---|
| Polyester binder resin 1 | 100 parts |
| Cyan pigment (C.I. Pigment Blue 15:3) | 100 parts |
| Pure water | 50 parts |

Formulation of Magenta Toner Master Batch 1 (TB-M1)

| | |
|---|---|
| Polyester binder resin 1 | 100 parts |
| Magenta pigment (C.I. Pigment Red 122) | 100 parts |
| Pure water | 50 parts |

TABLE 2A

| | Synthesis Example | | | | | | | |
|---|---|---|---|---|---|---|---|---|
| | 6 | 7 | 8 | 9 | 10 | 11 | 12 | 13 |
| polyester binder resin No. | 1 | 2 | 3 | 4 | 5 | 6 | 7 | 8 |
| alcohol component | | | | | | | | |
| 1,2-propanediol | 889 g | 889 g | 889 g | 1254 g | 740 g | 889 g | 721 g | 1064 g |
| 1,3-propanediol | 258 g | 258 g | 258 g | — | — | 258 g | — | — |
| 1,4-butanediol | — | — | — | — | 252 g | — | — | — |
| BPA-PO* | — | — | — | — | — | — | 882 g | — |
| glycerin | 166 g | 166 g | 166 g | — | 135 g | 166 g | — | — |
| carboxylic acid component | | | | | | | | |
| terephthalic acid | 2108 g | 2108 g | 2108 g | 2054 g | 1809 g | 2108 g | 1195 g | 1720 g |
| anhydrous trimellitic acid | 307 g | 307 g | 307 g | 380 g | 100 g | 307 g | 277 g | 54 g |
| unpurified rosin** | — | — | — | — | — | — | — | 1027 g |
| acrylic acid-modified rosin A | 764 g | — | — | 252 g | 878 g | — | 932 g | — |
| acrylic acid-modified rosin B | — | 764 g | — | — | — | — | — | — |
| acrylic acid-modified rosin C | — | — | 764 g | — | — | — | — | — |
| acrylic acid-modified rosin D | — | — | — | — | — | 776 g | — | — |
| esterification catalyst | | | | | | | | |
| dibutyl tin oxide | — | — | — | 15 g | — | — | 20 g | — |
| dioctanoic acid tin (II) salt | 20 g | 20 g | 20 g | — | — | 20 g | — | 20 g |
| TIB*** | — | — | — | — | 25 g | — | — | — |
| content of rosin in carboxylic acid component (% by mass) | 24.0 | 24.0 | 24.0 | 9.4 | 31.5 | 24.3 | 38.8 | 36.7 |
| properties of polyester | | | | | | | | |
| acid value (mgKOH/g) | 24.8 | 23.6 | 15.8 | 56.1 | 51.2 | 24.2 | 27.8 | 27.8 |
| hydroxyl value (mgKOH/g) | 17.8 | 15.9 | 10.5 | 39.6 | 22.5 | 17.4 | 20.3 | 20.3 |
| softening temp. (° C.) | 118.5 | 116.6 | 114.6 | 102.9 | 120.5 | 115.6 | 112.2 | 105.1 |
| glass transition temp. (° C.) | 67.9 | 67.1 | 64.2 | 59.4 | 59.4 | 66.3 | 62.5 | 54.5 |
| content of low molecular weight components**** | 5.5 | 7.8 | 9.8 | 7.6 | 7.1 | 7.8 | 8.2 | 14.4 |

*BPA-PO: polyoxypropylene(2.2)-2,2-bis(4-hydroxypheny)propane (divalent aromatic alcohol)

**unmodofied rosin

***TIB: titanium isopropylate bistriethanolaminate

****molecular weight: 500 or less

Formulation of Yellow Toner Master Batch 1 (TB-Y1)

| | |
|---|---|
| Polyester binder resin 1 | 100 parts |
| Yellow pigment (C.I. Pigment Yellow 180) | 100 parts |
| Pure water | 50 parts |

Formulation of Black Toner Master Batch 1 (TB-K1)

| | |
|---|---|
| Polyester binder resin 1 | 100 parts |
| Black pigment (carbon black) | 100 parts |
| Pure water | 50 parts |

Production Examples 2 to 8

Production of Master Batches 2 to 8

The master batches 2 to 8 of cyan toner master batches 2 to 8 (TB-C2 to TB-C8), yellow toner master batches 2 to 8 (TB-Y2 to TB-Y8), magenta toner master batches 2 to 8 (TB-M2 to TB-M8), and black toner master batches 2 to 8 (TB-K2 to TB-K8) shown in Table 3A were produced in the same manner as Production Example 1 except that the polyester binder resin 1 was changed into the polyester binder resins 2 to 8.

TABLE 3A

| | | | binder resin formulation | | pigment formulation | | pure |
|---|---|---|---|---|---|---|---|
| | | | binder resin | amount (part) | pigment | amount (part) | water (part) |
| master batch 1 | cyan | TB-C1 | binder resin 1 | 100 | C.I. Pigment blue 15:3 | 100 | 50 |
| | magenta | TB-M1 | | 100 | C.I. Pigment red 122 | 100 | 50 |
| | yellow | TB-Y1 | | 100 | C.I. Pigment yellow 180 | 100 | 50 |
| | black | TB-K1 | | 100 | carbon black | 100 | 50 |
| master batch 2 | cyan | TB-C2 | binder resin 2 | 100 | C.I. Pigment blue 15:3 | 100 | 50 |
| | magenta | TB-M2 | | 100 | C.I. Pigment red 122 | 100 | 50 |
| | yellow | TB-Y2 | | 100 | C.I. Pigment yellow 180 | 100 | 50 |
| | black | TB-K2 | | 100 | carbon black | 100 | 50 |
| master batch 3 | cyan | TB-C3 | binder resin 3 | 100 | C.I. Pigment blue 15:3 | 100 | 50 |
| | magenta | TB-M3 | | 100 | C.I. Pigment red 122 | 100 | 50 |
| | yellow | TB-Y3 | | 100 | C.I. Pigment yellow 180 | 100 | 50 |
| | black | TB-K3 | | 100 | carbon black | 100 | 50 |
| master batch 4 | cyan | TB-C4 | binder resin 4 | 100 | C.I. Pigment blue 15:3 | 100 | 50 |
| | magenta | TB-M4 | | 100 | C.I. Pigment red 122 | 100 | 50 |
| | yellow | TB-Y4 | | 100 | C.I. Pigment yellow 180 | 100 | 50 |
| | black | TB-K4 | | 100 | carbon black | 100 | 50 |
| master batch 5 | cyan | TB-C5 | binder resin 5 | 100 | C.I. Pigment blue 15:3 | 100 | 50 |
| | magenta | TB-M5 | | 100 | C.I. Pigment red 122 | 100 | 50 |
| | yellow | TB-Y5 | | 100 | C.I. Pigment yellow 180 | 100 | 50 |
| | black | TB-K5 | | 100 | carbon black | 100 | 50 |
| master batch 6 | cyan | TB-C6 | binder resin 6 | 100 | C.I. Pigment blue 15:3 | 100 | 50 |
| | magenta | TB-M6 | | 100 | C.I. Pigment red 122 | 100 | 50 |
| | yellow | TB-Y6 | | 100 | C.I. Pigment yellow 180 | 100 | 50 |
| | black | TB-K6 | | 100 | carbon black | 100 | 50 |
| master batch 7 | cyan | TB-C7 | binder resin 7 | 100 | C.I. Pigment blue 15:3 | 100 | 50 |
| | magenta | TB-M7 | | 100 | C.I. Pigment red 122 | 100 | 50 |
| | yellow | TB-Y7 | | 100 | C.I. Pigment yellow 180 | 100 | 50 |
| | black | TB-K7 | | 100 | carbon black | 100 | 50 |
| master batch 8 | cyan | TB-C8 | binder resin 8 | 100 | C.I. Pigment blue 15:3 | 100 | 50 |
| | magenta | TB-M8 | | 100 | C.I. Pigment red 122 | 100 | 50 |
| | yellow | TB-Y8 | | 100 | C.I. Pigment yellow 180 | 100 | 50 |
| | black | TB-K8 | | 100 | carbon black | 100 | 50 |

Production Example 9

Production of Toner 1

Toner 1 of cyan toner 1, magenta toner 1, yellow toner 1, and black toner 1 were produced as follows.

Production of Cyan Toner 1

The ingredients of cyan toner formulation 1 shown below were pre-mixed by Henschel mixer (FM10B, by Mitsui Mining Co.), then kneaded by a two-axis kneader (PCM-30, by Ikegai, Ltd.). Then the mixture was finely milled by a Jet Mill (Labo Jet, by Japan Pneumatic Mfg. Co.) and classified by an air classifier (MDS-I, by Japan Pneumatic Mfg. Co.) thereby to produce toner base particles having a weight average particle diameter of 7 μm.

To 100 parts by mass of the toner base particles, 1.0 part by mass of colloidal silica (H-2000, by Clariant Co.) was mixed by a sample mill to produce cyan toner 1.

Cyan Toner Formulation 1

| | |
|---|---|
| Polyester binder resin 1 | 100 parts |
| Cyan toner master batch (TB-C1) | 20 parts |
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production of Magenta Toner 1

Magenta toner 1 was produced in the same manner as cyan toner 1 except that cyan toner formulation 1 was changed into magenta toner formulation 1 shown below.

Magenta Toner Formulation 1

| | |
|---|---|
| Polyester binder resin 1 | 100 parts |
| Magenta toner master batch (TB-M1) | 18 parts |
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production of Yellow Toner 1

Yellow toner 1 was produced in the same manner as cyan toner 1 except that cyan toner formulation 1 was changed into yellow toner formulation 1 shown below.

Yellow Toner Formulation 1

| | |
|---|---|
| Polyester binder resin 1 | 100 parts |
| Yellow toner master batch (TB-Y1) | 20 parts |

-continued

| | |
|---|---|
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production of Black Toner 1

Black toner 1 was produced in the same manner as cyan toner 1 except that cyan toner formulation 1 was changed into black toner formulation 1 shown below.

Black Toner Formulation 1

| | |
|---|---|
| Polyester binder resin 1 | 100 parts |
| Black toner master batch (TB-K1) | 16 parts |
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production Examples 10 to 16

Toners 2 to 8 of cyan toners 2 to 8, yellow toners 2 to 8, magenta toners 2 to 8, and black toners 2 to 8 were produced in the same manner as Production Example 9, except that polyester binder resin 1 was changed into polyester binder resins 2 to 8 and master batch 1 was changed into master batches 2 to 8.

TABLE 4A

| | | binder resin formulation | | master batch formulation | | charge control agent formulation | | wax formulation | |
|---|---|---|---|---|---|---|---|---|---|
| | | binder resin | amount (part) | master batch | amount (part) | charge control agent | amount (part) | wax | amount (part) |
| toner 1 | cyan | binder resin 1 | 100 | TB-C1 | 20 | E-84 | 1 | ester | 5 |
| | magenta | | 100 | TB-M1 | 18 | | 1 | wax | 5 |
| | yellow | | 100 | TB-Y1 | 20 | | 1 | | 5 |
| | black | | 100 | TB-K1 | 16 | | 1 | | 5 |
| toner 2 | cyan | binder resin 2 | 100 | TB-C2 | 20 | E-84 | 1 | ester | 5 |
| | magenta | | 100 | TB-M2 | 18 | | 1 | wax | 5 |
| | yellow | | 100 | TB-Y2 | 20 | | 1 | | 5 |
| | black | | 100 | TB-K2 | 16 | | 1 | | 5 |
| toner 3 | cyan | binder resin 3 | 100 | TB-C3 | 20 | E-84 | 1 | ester | 5 |
| | magenta | | 100 | TB-M3 | 18 | | 1 | wax | 5 |
| | yellow | | 100 | TB-Y3 | 20 | | 1 | | 5 |
| | black | | 100 | TB-K3 | 16 | | 1 | | 5 |
| toner 4 | cyan | binder resin 4 | 100 | TB-C4 | 20 | E-84 | 1 | ester | 5 |
| | magenta | | 100 | TB-M4 | 18 | | 1 | wax | 5 |
| | yellow | | 100 | TB-Y4 | 20 | | 1 | | 5 |
| | black | | 100 | TB-K4 | 16 | | 1 | | 5 |
| toner 5 | cyan | binder resin 5 | 100 | TB-C5 | 20 | E-84 | 1 | ester | 5 |
| | magenta | | 100 | TB-M5 | 18 | | 1 | wax | 5 |
| | yellow | | 100 | TB-Y5 | 20 | | 1 | | 5 |
| | black | | 100 | TB-K5 | 16 | | 1 | | 5 |
| toner 6 | cyan | binder resin 6 | 100 | TB-C6 | 20 | E-84 | 1 | ester | 5 |
| | magenta | | 100 | TB-M6 | 18 | | 1 | wax | 5 |
| | yellow | | 100 | TB-Y6 | 20 | | 1 | | 5 |
| | black | | 100 | TB-K6 | 16 | | 1 | | 5 |
| toner 7 | cyan | binder resin 7 | 100 | TB-C7 | 20 | E-84 | 1 | ester | 5 |
| | magenta | | 100 | TB-M7 | 18 | | 1 | wax | 5 |
| | yellow | | 100 | TB-Y7 | 20 | | 1 | | 5 |
| | black | | 100 | TB-K7 | 16 | | 1 | | 5 |
| toner 8 | cyan | binder resin 8 | 100 | TB-C8 | 20 | E-84 | 1 | ester | 5 |
| | magenta | | 100 | TB-M8 | 18 | | 1 | wax | 5 |
| | yellow | | 100 | TB-Y8 | 20 | | 1 | | 5 |
| | black | | 100 | TB-K8 | 16 | | 1 | | 5 |

Evaluation of Toner Properties

The resulting toners 1 to 8 were evaluated with respect to storage stability and odor in the following ways. The results are shown in Table 5A.

Evaluation of Storage Stability

A toner is filled into two open-cylindrical containers of 5 cm diameter and 2 cm high in a weight of 4 g respectively. One container is allowed to stand at temperature 40° C. and relative humidity 60%, and another container is allowed to stand at temperature 55° C. and relative humidity 60%, for 72 hours. After this period, the containers with a toner are shaken mildly, then the existence of toner agglomeration is visually observed and the storage stability is evaluated in accordance with the following criteria.

Evaluation Criteria

A: no toner agglomeration under both conditions of 40° C. and 55° C.

B: no toner agglomeration under 40° C., but some agglomerated granules under 55° C.

C: some agglomerated granules under 40° C., and significant agglomeration under 55° C.

D: significant agglomeration under both conditions of 40° C. and 55° C.

Evaluation of Odor

A toner is weighed into an aluminum cup in an amount of 20 g, which is placed on a hot plate at 150° C. for 30 minutes, then the odor from the toner is evaluated in accordance with the following criteria.

Evaluation Criteria

A: no odor

B: almost no odor

C: some odor, but practically no problem

D: significant odor

Examples A1 to A 7 and Comparative Example A1

Image Formation and Evaluation

Figure 20:
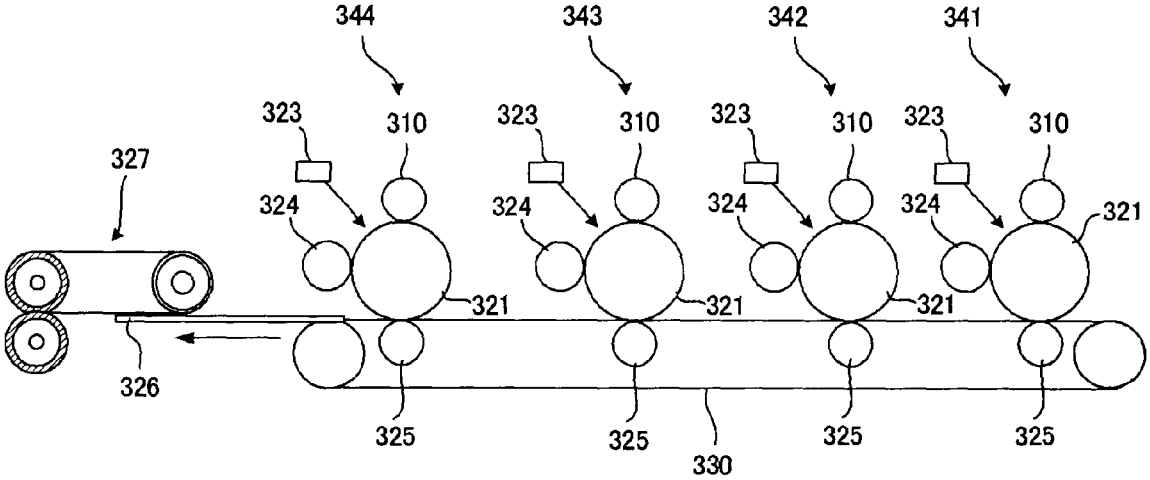
FIG. 20 is a schematic view that shows Image Forming Apparatus (A) utilized in Example.

The resulting toners 1 to 8 were filled into image forming apparatus A shown in FIG. 20 and images were formed, then various properties were evaluated. The results are shown in Table 5A.

Image Forming Apparatus A

Image forming apparatus shown in FIG. 20 is a tandem image forming apparatus of direct transfer type that employs contact charging, one-component developing, direct transfer, cleaner-less, and internal-heating belt fixing.

The image forming apparatus A shown in FIG. 20 is equipped with charging rollers of contact type as charging units 310 as shown in FIG. 1. Developing units 324 are a one-component developing unit as shown in FIG. 5 that is cleaner-less with respect to collecting residual toners. The fixing unit 327 is a belt-type fixing device as shown in FIG. 9 that is equipped with a halogen lamp to heat the heating roller. Conveying belt 330 is also shown in FIG. 20.

The image forming element 341 of image forming apparatus A shown in FIG. 20 is equipped with charging unit 310, exposing unit 323, developing unit 324, and transfer unit 325 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto a recording medium 326 by the transfer unit 325, then the residual toner on the photoconductor drum 321 is collected by the developing unit 324. Similarly, visible images of magenta, cyan, and black toners are overlapped onto the recording medium by the image forming elements 342, 343, and 344, then a color image formed on the recording medium 326 is fixed by the fixing unit 327.

Fixing Ability

Lower-Limit Fixing Temperature

Using the image forming apparatus A, a solid image of 1.0±0.05 mg/cm$^2$ is printed on a regular paper and a thick paper (type 6200, by Ricoh Co., copy paper No. 135, by NBS Ricoh Co.) while varying the temperature of the fixing unit to evaluate the lower limit fixing temperature, which is defined as the temperature at which the residual rate of image density is no more than 70% after rubbing the fixed image by a pad.

Evaluation Criteria

A: lower limit fixing temperature<135° C.

B: 135° C.≦lower limit fixing temperature<145° C.

C: 145° C.≦lower limit fixing temperature<155° C.

D: 155° C.≦lower limit fixing temperature

Hot Offset Generating Temperature

Using the image forming apparatus A, a solid image of 1.0±0.05 mg/cm$^2$ is printed on a regular paper (type 6200, by Ricoh Co.) while varying the temperature of the fixing unit to evaluate the hot offset generating temperature, which is defined as the temperature of the fixing roll at which the hot offset generates.

Evaluation Criteria

A: 190° C.≦hot offset generating temperature

B: 180° C.≦hot offset generating temperature<190° C.

C: 170° C.≦hot offset generating temperature<180° C.

D: hot offset generating temperature<170° C.

Image Quality

The image quality is evaluated with respect to tone uniformity, background smear, image density, and haze of output images. The images are visually observed and evaluated into three steps below.

Evaluation Criteria

A: no problem and excellent image

B: problems being slightly observed in tone, image density, and background smear, but substantially non-problem under usual temperatures and humidities C: problems being significantly observed in tone uniformity, image density, and background smear Stability with Time Using the image forming apparatus A, a solid image is printed on 6000 paper (by Ricoh Co.) before and after running printing 50,000 sheets of image chart with 35% image area. The image quality is evaluated by comparing before and after the running printing in accordance with the following criteria in three steps.

Evaluation Criteria

A: substantially no difference between before and after the running printing, image quality being appropriately maintained B: some difference being recognizable, but substantially allowable C: significant difference being recognizable, and non-allowable Overall Judgment The evaluation results described above are totally judged in accordance with the criteria below.

A: excellent

B: practically allowable level

C: practically non-allowable level

TABLE 5A

| | toner No. | strage stability | odor | image forming apparatus | fixing ability LLFT | fixing ability HOGT | image quality | stability with time | overall judgement |
|---|---|---|---|---|---|---|---|---|---|
| Ex. A1 | toner 1 | A | A | A | A | A | A | A | A |
| Ex. A2 | toner 2 | B | A | A | A | A | A | A | A |
| Ex. A3 | toner 3 | C | A | A | A | A | A | A | A |
| Ex. A4 | toner 4 | A | A | A | B | C | B | B | A |
| Ex. A5 | toner 5 | A | A | A | A | B | A | A | A |
| Ex. A6 | toner 6 | B | C | A | A | A | A | A | A |
| Ex. A7 | toner 7 | B | A | A | A | C | A | A | A |
| Com. Ex. A1 | toner 8 | D | D | A | B | C | B | C | C |

LLFT: lower-limit fixing temperature

HOGT: hot offset generating temperature

Examples A8 to A14 and Comparative Example A2

Preparation of Carrier

A coating material of the composition shown below was dispersed for 10 minutes using a stirrer to prepare a coating liquid. The coating liquid was poured into a coating device where 5000 parts of a core material (Cu—Zn ferrite particles, weight average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier.

Composition of Coating Material

| | |
|---|---|
| Toluene | 450 parts |
| Silicone resin (SR2400)*1) | 450 parts |
| Amino silane (SH6020)*2) | 10 parts |
| Carbon black | 10 parts |

*1)non-volatile content: 50%, by Toray Dow Corning Silicone Co.

*2)by Toray Dow Corning Silicone Co.

Preparation of Two-Component Developer

5% of each of the resulting toners 1 to 8 and 95% of the carrier prepared as described above were stirred using Turbler mixer (T2F, by Willy A. Bachofen AG Maschinenfabrik) for 5 minutes to prepare two-component developers 1 to 8.

Image Formation and Evaluation

The resulting two-component developers 1 to 8 were filled into image forming apparatus B shown in FIG. 21 and images were formed, then temporal stability was evaluated as follows, and also lower-limit fixing temperature, image quality, and overall judgment were evaluated in the same manner as Examples A1 to A7 and Comparative Example A1. The results are shown in Table 6A.

Image Forming Apparatus B

Figure 21:
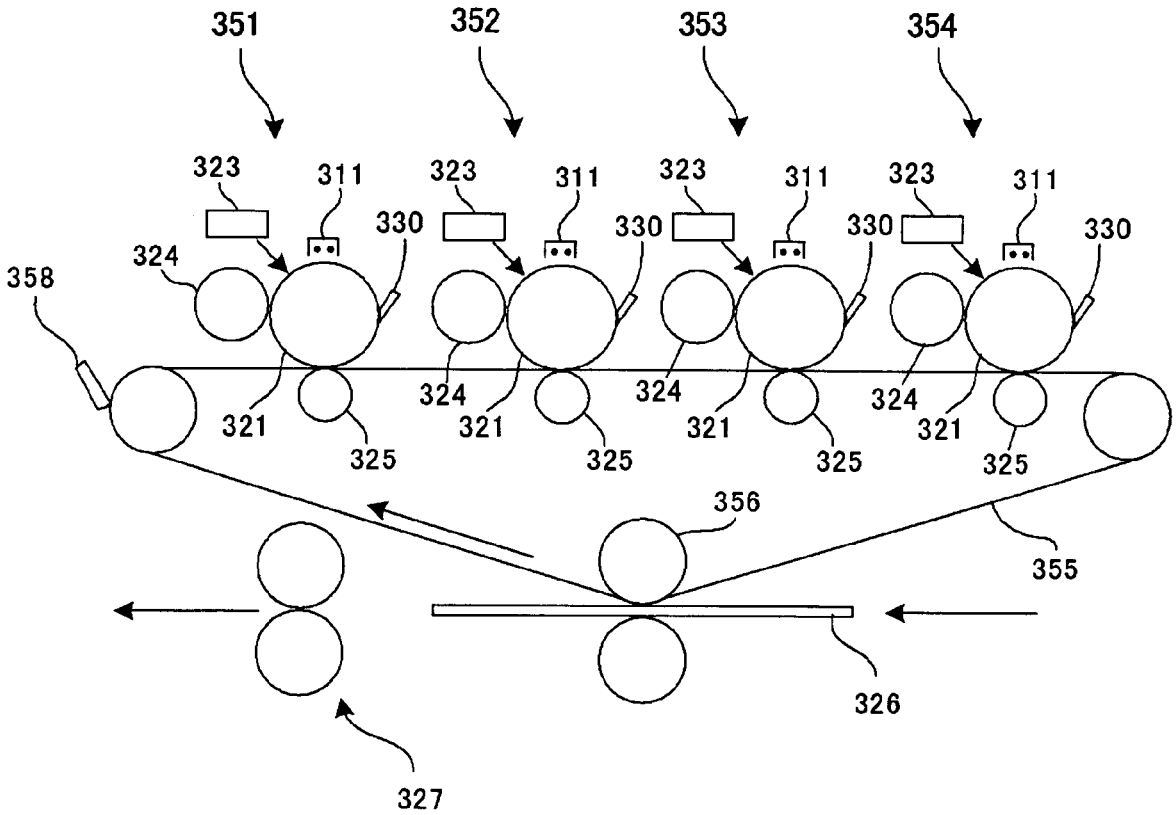
FIG. 21 is a schematic view that shows Image Forming Apparatus (B) utilized in Example.

Image forming apparatus B shown in FIG. 21 is a tandem image forming apparatus of indirect transfer type that employs non-contact charging, two-component developing, secondary transfer, blade cleaning, and external-heating roller fixing.

The image forming apparatus B shown in FIG. 21 is equipped with corona chargers of non-contact type as charging units 311 as shown in FIG. 3. Developing units 324 are a two-component developing unit as shown in FIG. 6. The cleaning units 330 have a cleaning blade as shown in FIG. 10. The fixing unit 327 is a roller-type fixing device of electromagnetic induction heating as shown in FIG. 12.

The image forming element 351 of image forming apparatus B shown in FIG. 21 is equipped with charging unit 311, exposing unit 323, developing unit 324, primary transfer unit 325, and cleaning unit 330 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto an intermediate transfer belt 355 by the primary transfer unit 325, then the residual yellow toner on the photoconductor drum 321 is removed by the cleaning unit 330. Similarly, visible images of magenta, cyan, and black toners are formed onto the recording medium by the image forming elements 352, 353, and 354, then a color image formed on the intermediate transfer belt 355 is fixed onto a recording medium 326 by a transfer device 356, then the residual toner on the intermediate transfer belt 355 is removed by an intermediate transfer belt cleaning unit 358. The color image formed on the recording medium 326 is fixed by the fixing unit 327.

Stability with Time

Using the image forming apparatus B, a solid image is printed on 6000 paper (by Ricoh Co.) before and after running printing 100,000 sheets of image chart with 35% image area. The image quality is evaluated by comparing before and after the running printing in the same manner as Examples 1 to 7 and Comparative Example 1.

Evaluation Criteria

A: substantially no difference between before and after the running printing, image quality being appropriately maintained B: some difference being recognizable, but substantially allowable C: significant difference being recognizable, and non-allowable

TABLE 6A

| | two-component developer No. | image forming apparatus | fixing ability LLFT | fixing ability HOGT | image quality | stability with time | overall judgement |
|---|---|---|---|---|---|---|---|
| Ex. A8 | 1 | B | A | A | A | A | A |
| Ex. A9 | 2 | B | A | A | A | A | A |
| Ex. A10 | 3 | B | A | A | A | A | A |
| Ex. A11 | 4 | B | B | C | B | B | A |
| Ex. A12 | 5 | B | A | B | A | A | A |
| Ex. A13 | 6 | B | A | A | A | A | A |
| Ex. A14 | 7 | B | A | C | A | A | A |
| Com. Ex. A2 | 8 | B | B | C | B | C | C |

LLFT: lower limit fixing temperature
HOGT: hot offset generating temperature

The results of Tables 5A and 6A demonstrate that the toners or two-component developers of Examples A1 to A14, comprising a polyester resin that is prepared by condensation polymerization between an alcohol component that contains an aliphatic polyvalent alcohol and a carboxylic acid component that contains (meth)acrylic acid-modified rosin as a binder resin of the toner, may exhibit excellent fixing ability and provide high quality images far from tone change with time, and with substantially no occurrences of abnormal images such as density-drop and background smear, compared with those of Comparative Examples A1 and A2 containing no (meth)acrylic acid-modified rosin.

Example B in Second Aspect of Present Invention

Modification Degree of Rosin by Fumaric Acid

The modification degree of rosin by fumaric acid, i.e. fumaric acid-modification degree, (referred to as "MD by FA") is calculated from the Formula (1B):

$$MD \text{ by } FA = \frac{X_1 - Y}{X_2 - Y} \times 100$$

In the Formula (1B), $X_1$ represents an SP value of fumaric acid-modified rosin to be calculated for the modification degree; $X_2$ represents a saturated SP value of fumaric acid-modified rosin obtained by reaction between one mole of fumaric acid and 0.7 mole of rosin; Y is an SP value of rosin. The SP value of $X_2$ is of fumaric acid-modified rosin that is prepared in a way that 1 mole of fumaric acid, 0.7 mole of rosin, and 0.4 g of t-butyl catechol are mixed, the mixture is heated from 160° C. to 200° C. over 2 hours and allowed to react at 200° C. for 2 hours, then the reactant is distilled under a reduced pressure of 5.3 kPa. When the acid value of rosin is "x" (mg KOH/g), "x" mg of potassium hydroxide (molecular weight: 56.1) is allowed to react with 1 g of the rosin, thus the molecular weight of the rosin can be calculated by 56100÷x.

Synthetic Example 1

Purification of Rosin 1000 g of tall rosin (glass transition temperature Tg: 37.2° C.) was added into a flask of 2000 mL equipped with a fractionating column, a reflux condenser, and a trap, and was distilled under a reduced pressure of 1 kPa, thereby distillate of 195° C. to 250° C. was mainly collected. Hereinafter, tall rosin to be purified is referred to as unpurified rosin, and rosin from which main distilling components having been removed is referred to as purified rosin (Tg: 39.2° C.).

20 g of rosin was milled for 5 seconds by use of a coffee mill (National MK-61M), and passed through a mesh of opening 1 mm, then the resulting powder was weighed in an amount of 0.5 g into a vial (20 mL) for headspace. Headspace gas was sampled and impurities within unpurified or purified rosin were analyzed by a headspace GC-MS method as follows. The results are shown in Table 2B.

Measuring Condition in Headspace GC-MS Method (A) Headspace Sampler (HP7694, by Agilent Co.)
Sample temperature: 200° C.
Loop temperature: 200° C.
Transfer line temperature: 200° C.
Heating time of equilibrium sample: 30 minutes
Pressure gas in vial: helium (He)
Pressure time at vial: 0.3 minute
Loop filling time: 0.03 minute
Equilibrium time at loop: 0.3 minute
Injecting time: 1 minute (B) Gas Chromatography (GC) (HP6890, by Agilent Co.)
Analytical column: DB-1 (60 m-320 μm-5 μm)
Carrier gas: helium (He)
Flow rate: 1 mL/min
Injection temperature: 210° C.
Column head pressure: 34.2 kPa
Injection mode: split
Split ratio: 10:1
Oven temperature: 45° C. (3 minutes)-10° C./min-280° C. (15 minutes)

(C) Mass Spectrometry (MS) (HP5973, by Agilent Co.)
Ionization method: electron impulse (EI)
Interface temperature: 280° C.
Ion source temperature: 230° C.
Quadrupole temperature: 150° C.
Detection mode: Scan 29 to 350 m/sec

TABLE 1B

| | hexanoic acid | pentanoic acid | benzaldehyde | n-hexanal | 2-pentyl-furan | SP value ° C. | Softening Tem. ° C. | Acid Value (mgKOH/g) | Molecular weight |
|---|---|---|---|---|---|---|---|---|---|
| Unpurified Rosin | $0.9 \times 10^7$ | $0.6 \times 10^7$ | $0.6 \times 10^7$ | $1.8 \times 10^7$ | $1.1 \times 10^7$ | 77.0 | 74.3 | 169 | 332 |
| Purified Rosin | $0.4 \times 10^7$ | $0.2 \times 10^7$ | $0.2 \times 10^7$ | $1.4 \times 10^7$ | $0.7 \times 10^7$ | 76.8 | 75.1 | 166 | 338 |

Saturated SP Value

Saturated SP value for $X_2$ value of acrylic acid-modified rosin prepared from unpurified rosin was measured as follows. 332 g (1 mole) of unpurified rosin (SP value: 77.0° C.), 81 g (0.7 mole) of fumaric acid, and 0.4 g of t-butylcatechol were added into a flask of 1000 mL equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to remove unreacted fumaric acid and volatile substances to prepare fumaric acid-modified rosin. The SP value of the resulting fumaric acid-modified rosin, i.e. the SP value of the fumaric acid-modified rosin prepared from the unpurified rosin was 130.6° C.

Saturated SP Value

Saturated SP value for $X_2$ value of acrylic acid-modified rosin prepared from unpurified rosin was measured as follows. 338 g (1 mole) of unpurified rosin (SP value: 76.8° C.), 81 g (0.7 mole) of fumaric acid, and 0.4 g of t-butylcatechol were added into a flask of 1000 mL equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to remove unreacted fumaric acid and volatile substances to prepare fumaric acid-modified rosin. The SP value of the resulting fumaric acid-modified rosin, i.e. the SP value of the fumaric acid-modified rosin prepared from the unpurified rosin was 130.9° C.

Synthesis Example 2

Synthesis of Fumaric Acid-Modified Rosin A 5408 g (16 mole) of purified rosin (SP value: 76.8° C.), 928 g (8 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin A. The resulting fumaric acid-modified rosin A had an SP value of 130.8° C., a glass transition temperature Tg of 74.4° C., and a fumaric acid-modification degree of 100.

Synthesis Example 3

Synthesis of Fumaric Acid-Modified Rosin B 5408 g (16 mole) of purified rosin (SP value: 76.8° C.), 557 g (4.8 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin B. The resulting fumaric acid-modified rosin B had an SP value of 115.7° C., a glass transition temperature Tg of 53.9° C., and a fumaric acid-modification degree of 72.

Synthesis Example 4

Synthesis of Fumaric Acid-Modified Rosin C 5408 g (16 mole) of purified rosin (SP value: 76.8° C.), 278 g (2.4 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin C. The resulting fumaric acid-modified rosin C had an SP value of 98.4° C., a glass transition temperature Tg of 48.3° C., and a fumaric acid-modification degree of Synthesis Example 5

Synthesis of Fumaric Acid-Modified Rosin D 5312 g (16 mole) of unpurified rosin (SP value: 77.0° C.), 928 g (8 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin D. The resulting fumaric acid-modified rosin D had an SP value of 130.4° C., a glass transition temperature Tg of 72.1° C., and a fumaric acid-modification degree of 100.

Synthetic Examples 6 to 10 and 12 to 14

Synthesis of Polyester Binder Resins 1 to 5 and 7 to 9

The alcohol components, carboxylic acid components other than anhydrous trimellitic acid, and esterification catalysts shown in Table 2B were added into a four-necked 5 L flask, equipped with a nitrogen inlet, a water outlet, a stirrer, and a thermocouple, then the mixture was subjected to condensation polymerization at 230° C. for 10 hours under nitrogen atmosphere, followed by allowing to react at 230° C. for 1 hour under 8 kPa. After cooling the reactant to 220° C., anhydrous trimellitic acid shown in Table 2B was added, then the mixture was allowed to react for 1 hour under normal pressure 101.3 kPa followed by continuing to react at 220° C. under 20 kPa till the reactant took an intended softening temperature; thereby, polyester binder resins 1 to 5 and 7 to 9 were synthesized.

Synthetic Example 11

Synthesis of Polyester Binder Resin 6

The alcohol components, carboxylic acid components other than fumaric acid, and esterification catalysts shown in Table 2B were added into a four-necked 5 L flask, equipped with a nitrogen inlet, a water outlet, a stirrer, and a thermocouple, then the mixture was subjected to condensation polymerization at 230° C. for 10 hours under nitrogen atmosphere, followed by allowing to react at 230° C. for 1 hour under 8 kPa. After cooling the reactant to 180° C., fumaric acid shown in Table 2B was added, then the mixture was heated to 210° C. over 5 hours then allowed to react at 210° C. under 10 kPa till the reactant took an intended softening temperature; thereby, polyester binder resin 6 was synthesized.

TABLE 2B

| | Synthesis Example | | | | | | | | |
|---|---|---|---|---|---|---|---|---|---|
| | 6 | 7 | 8 | 9 | 10 | 11 | 12 | 13 | 14 |
| polyester binder resin No. | 1 | 2 | 3 | 4 | 5 | 6 | 7 | 8 | 9 |
| alcohol component | | | | | | | | | |
| BPA-PO* | 2450 g | 2450 g | 2450 g | 2100 g | 1960 g | 2800 g | 2450 g | 2450 g | 2450 g |
| BPA-EO** | 975 g | 975 g | 975 g | 1300 g | 780 g | 650 g | 975 g | 975 g | 975 g |
| carboxylic acid component | | | | | | | | | |
| terephthalic acid | 966 g | 966 g | 966 g | 1162 g | 531 g | 664 g | 830 g | 830 g | 830 g |
| anhydrous trimellitic acid | 288 g | 288 g | 288 g | 288 g | 230 g | — | 288 g | 288 g | 288 g |
| fumaric acid | — | — | — | — | — | 464 g | — | — | — |
| unpurified rosin** | — | — | — | — | — | — | — | — | 672 g |
| fumaric acid-modified rosin A | 672 g | — | — | 336 g | 1613 g | 672 g | 672 g | — | — |
| acrylic acid-modified rosin B | — | 672 g | — | — | — | — | — | — | — |
| acrylic acid-modified rosin C | — | — | 672 g | — | — | — | — | — | — |
| acrylic acid-modified rosin D | — | — | — | — | — | — | — | 672 g | — |
| esterification catalyst | | | | | | | | | |
| dibutyl tin oxide | — | — | — | — | — | — | 26 g | — | — |
| dioctanoic acid tin (II) salt | 26 g | 26 g | 26 g | 26 g | 26 g | — | — | 26 g | 26 g |
| TIB**** | — | — | — | — | — | 26 g | — | — | — |
| content of rosin in carboxylic acid component (% by mass) | 34.4 | 34.4 | 34.4 | 18.8 | 67.9 | 37.3 | 37.5 | 37.5 | 37.5 |
| properties of polyester | | | | | | | | | |
| acid value (mgKOH/g) | 32.7 | 30.1 | 26.7 | 18.9 | 29.8 | 15.3 | 5.4 | 30.4 | 28.1 |
| hydroxyl value (mgKOH/g) | 15.0 | 10.0 | 8.0 | 18.0 | 18.0 | 15.7 | 36.6 | 12.8 | 31.0 |
| softening temp. (° C.) | 124.3 | 122.3 | 118.5 | 143.5 | 105.9 | 108.5 | 123.6 | 119.8 | 110.4 |
| glass transition temp. (° C.) | 69.4 | 66.5 | 61.0 | 72.0 | 58.2 | 56.8 | 66.8 | 62.4 | 55.1 |
| content of low molecular weight components***** | 4.8 | 6.5 | 7.8 | 6.0 | 9.2 | 6.9 | 8.0 | 10.2 | 16.9 |

*BPA-PO: polyoxypropylene(2.2)-2,2-bis(4-hydroxyphenyl)propane

**BPA-EO: polyoxyethylene(2.2)-2,2-bis(4-hydroxyphenyl)propane

***unmodofied rosin

****TIB: titanium isopropylate bistriethanolaminate

*****molecular weight: 500 or less

Production Example 1

Production of Master Batch 1

The pigments shown below, polyester binder resin 1, and pure water were mixed in a ratio of 1:1:0.5 by mass, and kneaded by a twin roll at 70° C.; then the roll temperature was risen to 120° C. to evaporate water, thereby to produce master batch 1 of cyan toner master batch 1 (TB-C1), magenta toner master batch 1 (TB-M1), yellow toner master batch 1 (TB-Y1), and black toner master batch 1 (TB-K1).

Formulation of Cyan Toner Master Batch 1 (TB-C1)

| | |
|---|---|
| Polyester binder resin 1 | 100 parts |
| Cyan pigment (C.I. Pigment Blue 15:3) | 100 parts |
| Pure water | 50 parts |

Formulation of Magenta Toner Master Batch 1 (TB-M1)

| | |
|---|---|
| Polyester binder resin 1 | 100 parts |
| Magenta pigment (C.I. Pigment Red 122) | 100 parts |
| Pure water | 50 parts |

Formulation of Yellow Toner Master Batch 1 (TB-Y1)

| | |
|---|---|
| Polyester binder resin 1 | 100 parts |
| Yellow pigment (C.I. Pigment Yellow 180) | 100 parts |
| Pure water | 50 parts |

Formulation of Black Toner Master Batch 1 (TB-K1)

| | |
|---|---|
| Polyester binder resin 1 | 100 parts |
| Black pigment (carbon black) | 100 parts |
| Pure water | 50 parts |

Production Examples 2 to 9

Production of Master Batches 2 to 9

The master batches 2 to 9 of cyan toner master batches 2 to 9 (TB-C2 to TB-C9), yellow toner master batches 2 to 9 (TB-Y2 to TB-Y9), magenta toner master batches 2 to 9 (TB-M2 to TB-M9), and black toner master batches 2 to 9 (TB-K2 to TB-K9) shown in Table 3B were produced in the same manner as Production Example 1 except that the polyester binder resin 1 was changed into the polyester binder resins 2 to 9.

Production Example 10

Production of Toner 1

Toner 1 of cyan toner 1, magenta toner 1, yellow toner 1, and black toner 1 were produced as follows.

Production of Cyan Toner 1

The ingredients of cyan toner formulation 1 shown below were pre-mixed by Henschel mixer (FM10B, by Mitsui Mining Co.), then kneaded by a two-axis kneader (PCM-30, by Ikegai, Ltd.). Then the mixture was finely milled by a Jet Mill (Labo Jet, by Japan Pneumatic Mfg. Co.) and classified by an air classifier (MDS-I, by Japan Pneumatic Mfg. Co.) thereby to produce toner base particles having a weight average particle diameter of 7 μm.

To 100 parts by mass of the toner base particles, 1.0 part by mass of colloidal silica (H-2000, by Clariant Co.) was mixed by a sample mill to produce cyan toner 1.

TABLE 3B

| | | | binder resin formulation | | pigment formulation | | pure |
|---|---|---|---|---|---|---|---|
| | | | binder resin | amount (part) | pigment | amount (part) | water (part) |
| master | cyan | TB-C1 | binder resin 1 | 100 | C.I. Pigment blue 15:3 | 100 | 50 |
| batch 1 | magenta | TB-M1 | | 100 | C.I. Pigment red 122 | 100 | 50 |
| | yellow | TB-Y1 | | 100 | C.I. Pigment yellow 180 | 100 | 50 |
| | black | TB-K1 | | 100 | carbon black | 100 | 50 |
| master | cyan | TB-C2 | binder resin 2 | 100 | C.I. Pigment blue 15:3 | 100 | 50 |
| batch 2 | magenta | TB-M2 | | 100 | C.I. Pigment red 122 | 100 | 50 |
| | yellow | TB-Y2 | | 100 | C.I. Pigment yellow 180 | 100 | 50 |
| | black | TB-K2 | | 100 | carbon black | 100 | 50 |
| master | cyan | TB-C3 | binder resin 3 | 100 | C.I. Pigment blue 15:3 | 100 | 50 |
| batch 3 | magenta | TB-M3 | | 100 | C.I. Pigment red 122 | 100 | 50 |
| | yellow | TB-Y3 | | 100 | C.I. Pigment yellow 180 | 100 | 50 |
| | black | TB-K3 | | 100 | carbon black | 100 | 50 |
| master | cyan | TB-C4 | binder resin 4 | 100 | C.I. Pigment blue 15:3 | 100 | 50 |
| batch 4 | magenta | TB-M4 | | 100 | C.I. Pigment red 122 | 100 | 50 |
| | yellow | TB-Y4 | | 100 | C.I. Pigment yellow 180 | 100 | 50 |
| | black | TB-K4 | | 100 | carbon black | 100 | 50 |
| master | cyan | TB-C5 | binder resin 5 | 100 | C.I. Pigment blue 15:3 | 100 | 50 |
| batch 5 | magenta | TB-M5 | | 100 | C.I. Pigment red 122 | 100 | 50 |
| | yellow | TB-Y5 | | 100 | C.I. Pigment yellow 180 | 100 | 50 |
| | black | TB-K5 | | 100 | carbon black | 100 | 50 |
| master | cyan | TB-C6 | binder resin 6 | 100 | C.I. Pigment blue 15:3 | 100 | 50 |
| batch 6 | magenta | TB-M6 | | 100 | C.I. Pigment red 122 | 100 | 50 |
| | yellow | TB-Y6 | | 100 | C.I. Pigment yellow 180 | 100 | 50 |
| | black | TB-K6 | | 100 | carbon black | 100 | 50 |
| master | cyan | TB-C7 | binder resin 7 | 100 | C.I. Pigment blue 15:3 | 100 | 50 |
| batch 7 | magenta | TB-M7 | | 100 | C.I. Pigment red 122 | 100 | 50 |
| | yellow | TB-Y7 | | 100 | C.I. Pigment yellow 180 | 100 | 50 |
| | black | TB-K7 | | 100 | carbon black | 100 | 50 |
| master | cyan | TB-C8 | binder resin 8 | 100 | C.I. Pigment blue 15:3 | 100 | 50 |
| batch 8 | magenta | TB-M8 | | 100 | C.I. Pigment red 122 | 100 | 50 |
| | yellow | TB-Y8 | | 100 | C.I. Pigment yellow 180 | 100 | 50 |
| | black | TB-K8 | | 100 | carbon black | 100 | 50 |
| master | cyan | TB-C9 | binder resin 9 | 100 | C.I. Pigment blue 15:3 | 100 | 50 |
| batch 9 | magenta | TB-M9 | | 100 | C.I. Pigment red 122 | 100 | 50 |
| | yellow | TB-Y9 | | 100 | C.I. Pigment yellow 180 | 100 | 50 |
| | black | TB-K9 | | 100 | carbon black | 100 | 50 |

Cyan Toner Formulation 1

| | |
|---|---|
| Polyester binder resin 1 | 100 parts |
| Cyan toner master batch (TB-C1) | 20 parts |
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production of Magenta Toner 1

Magenta toner 1 was produced in the same manner as cyan toner 1 except that cyan toner formulation 1 was changed into magenta toner formulation 1 shown below.

Magenta Toner Formulation 1

| | |
|---|---|
| Polyester binder resin 1 | 100 parts |
| Magenta toner master batch (TB-M1) | 18 parts |
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production of Yellow Toner 1

Yellow toner 1 was produced in the same manner as cyan toner 1 except that cyan toner formulation 1 was changed into yellow toner formulation 1 shown below.

Yellow Toner Formulation 1

| | |
|---|---|
| Polyester binder resin 1 | 100 parts |
| Yellow toner master batch (TB-Y1) | 20 parts |
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production of Black Toner 1

Black toner 1 was produced in the same manner as cyan toner 1 except that cyan toner formulation 1 was changed into black toner formulation 1 shown below.

Black Toner Formulation 1

| | |
|---|---|
| Polyester binder resin 1 | 100 parts |
| Black toner master batch (TB-K1) | 16 parts |
| Charge control agent (E-84)*1) | 1 part |
| Ester wax*2) | 5 parts |

*1)by Orient Chemical Industries, Ltd.

*2)acid value: 5 mgKOH/g, weight average molecular weight: 1600

Production Examples 11 to 18

Production of Toners 2 to 9

Toners 2 to 9 of cyan toners 2 to 9, yellow toners 2 to 9, magenta toners 2 to 9, and black toners 2 to 9 shown in Table 4B were produced in the same manner as Production Example 10, except that polyester binder resin 1 was changed into polyester binder resins 2 to 9 and master batch 1 was changed into master batches 2 to 9.

TABLE 4B

| | | binder resin formulation | | master batch formulation | | charge control agent formulation | | wax formulation | |
|---|---|---|---|---|---|---|---|---|---|
| | | binder resin | amount (part) | master batch | amount (part) | charge control agent | amount (part) | wax | amount (part) |
| toner 1 | cyan | binder resin 1 | 100 | TB-C1 | 20 | E-84 | 1 | ester | 5 |
| | magenta | | 100 | TB-M1 | 18 | | 1 | wax | 5 |
| | yellow | | 100 | TB-Y1 | 20 | | 1 | | 5 |
| | black | | 100 | TB-K1 | 16 | | 1 | | 5 |
| toner 2 | cyan | binder resin 2 | 100 | TB-C2 | 20 | E-84 | 1 | ester | 5 |
| | magenta | | 100 | TB-M2 | 18 | | 1 | wax | 5 |
| | yellow | | 100 | TB-Y2 | 20 | | 1 | | 5 |
| | black | | 100 | TB-K2 | 16 | | 1 | | 5 |
| toner 3 | cyan | binder resin 3 | 100 | TB-C3 | 20 | E-84 | 1 | ester | 5 |
| | magenta | | 100 | TB-M3 | 18 | | 1 | wax | 5 |
| | yellow | | 100 | TB-Y3 | 20 | | 1 | | 5 |
| | black | | 100 | TB-K3 | 16 | | 1 | | 5 |
| toner 4 | cyan | binder resin 4 | 100 | TB-C4 | 20 | E-84 | 1 | ester | 5 |
| | magenta | | 100 | TB-M4 | 18 | | 1 | wax | 5 |
| | yellow | | 100 | TB-Y4 | 20 | | 1 | | 5 |
| | black | | 100 | TB-K4 | 16 | | 1 | | 5 |
| toner 5 | cyan | binder resin 5 | 100 | TB-C5 | 20 | E-84 | 1 | ester | 5 |
| | magenta | | 100 | TB-M5 | 18 | | 1 | wax | 5 |
| | yellow | | 100 | TB-Y5 | 20 | | 1 | | 5 |
| | black | | 100 | TB-K5 | 16 | | 1 | | 5 |
| toner 6 | cyan | binder resin 6 | 100 | TB-C6 | 20 | E-84 | 1 | ester | 5 |
| | magenta | | 100 | TB-M6 | 18 | | 1 | wax | 5 |
| | yellow | | 100 | TB-Y6 | 20 | | 1 | | 5 |
| | black | | 100 | TB-K6 | 16 | | 1 | | 5 |
| toner 7 | cyan | binder resin 7 | 100 | TB-C7 | 20 | E-84 | 1 | ester | 5 |
| | magenta | | 100 | TB-M7 | 18 | | 1 | wax | 5 |
| | yellow | | 100 | TB-Y7 | 20 | | 1 | | 5 |
| | black | | 100 | TB-K7 | 16 | | 1 | | 5 |

TABLE 4B-continued

| | | binder resin formulation | | master batch formulation | | charge control agent formulation | | wax formulation | |
|---|---|---|---|---|---|---|---|---|---|
| | | binder resin | amount (part) | master batch | amount (part) | charge control agent | amount (part) | wax | amount (part) |
| toner 8 | cyan | binder resin 8 | 100 | TB-C8 | 20 | E-84 | 1 | ester | 5 |
| | magenta | | 100 | TB-M8 | 18 | | 1 | wax | 5 |
| | yellow | | 100 | TB-Y8 | 20 | | 1 | | 5 |
| | black | | 100 | TB-K8 | 16 | | 1 | | 5 |
| toner 9 | cyan | binder resin 9 | 100 | TB-C9 | 20 | E-84 | 1 | ester | 5 |
| | magenta | | 100 | TB-M9 | 18 | | 1 | wax | 5 |
| | yellow | | 100 | TB-Y9 | 20 | | 1 | | 5 |
| | black | | 100 | TB-K9 | 16 | | 1 | | 5 |

Evaluation of Toner Properties

The resulting toners 1 to 9 were evaluated with respect to storage stability and odor in the following ways. The results are shown in Table 5B.

Evaluation of Storage Stability

A toner is filled into two open-cylindrical containers of 5 cm diameter and 2 cm high in a weight of 4 g respectively. One container is allowed to stand at temperature 40° C. and relative humidity 60%, and another container is allowed to stand at temperature 55° C. and relative humidity 60%, for 72 hours. After this period, the containers with a toner are shaken mildly, then the existence of toner agglomeration is visually observed and the storage stability is evaluated in accordance with the following criteria.

Evaluation Criteria

A: no toner agglomeration under both conditions of 40° C. and 55° C.

B: no toner agglomeration under 40° C., but some agglomerated granules under 55° C.

C: some agglomerated granules under 40° C., and significant agglomeration under 55° C.

D: significant agglomeration under both conditions of 40° C. and 55° C.

Evaluation of Odor

A toner is weighed into an aluminum cup in an amount of 20 g, which is placed on a hot plate at 150° C. for 30 minutes, then the odor from the toner is evaluated in accordance with the following criteria.

Evaluation Criteria

A: no odor

B: almost no odor

C: some odor, but practically no problem

D: significant odor

Examples B1 to B8 and Comparative Example B1

Image Formation and Evaluation

The resulting toners 1 to 9 were filled into image forming apparatus A shown in FIG. 20 and images were formed, then various properties were evaluated. The results are shown in Table 5B.

Image Forming Apparatus A

Image forming apparatus shown in FIG. 20 is a tandem image forming apparatus of direct transfer type that employs contact charging, one-component developing, direct transfer, cleaner-less, and internal-heating belt fixing.

The image forming apparatus A shown in FIG. 20 is equipped with charging rollers of contact type as charging units 310 as shown in FIG. 1. Developing units 324 are a one-component developing unit as shown in FIG. 5 that is cleaner-less to collect residual toners. The fixing unit 327 is a belt-type fixing device as shown in FIG. 9 that is equipped with a halogen lamp to heat the heating roller. Conveying belt 330 is also shown in FIG. 20.

The image forming element 341 of image forming apparatus A shown in FIG. 20 is equipped with charging unit 310, exposing unit 323, developing unit 324, and transfer unit 325 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto a recording medium 326 by the transfer unit 325, then the residual toner on the photoconductor drum 321 is collected by the developing unit 324. Similarly, visible images of magenta, cyan, and black toners are overlapped onto the recording medium by the image forming elements 342, 343, and 344, then a color image formed on the recording medium 326 is fixed by the fixing unit 327.

Lower-Limit Fixing Temperature

Using the image forming apparatus A, a solid image of 1.0±0.05 mg/cm$^2$ is printed on a thick paper (copy paper No. 135, by NBS Ricoh Co.) while varying the temperature of the fixing unit to evaluate the lower limit fixing temperature, which is defined as the temperature at which the residual rate of image density is no more than 70% after rubbing the fixed image by a pad.

Evaluation Criteria

A: lower limit fixing temperature<135° C.

B: 135° C.≦lower limit fixing temperature<145° C.

C: 145° C.≦lower limit fixing temperature<155° C.

D: 155° C.≦lower limit fixing temperature

Image Quality

The image quality is evaluated with respect to image density, background smear, thin line reproduction, and color tone of output images. The images are visually observed and evaluated into three steps below.

Evaluation Criteria

A: no problem and excellent image

B: problems being slightly observed in tone, image density, and background smear, when compared with original image, but substantially non-problem under usual temperatures and humidities C: problems being somewhat observed in tone uniformity, image density, and background smear, when compared with original image Stability with Time After running printing 50,000 sheets of an image chart with 35% image area in monochrome mode using the image forming apparatus A, the image quality is evaluated in the same manner as described above in comparison with the initial image.

Evaluation Criteria

A: no problem and excellent image

B: problems being slightly observed in tone, image density, and background smear, when compared with initial image, but substantially non-problem under usual temperatures and humidities C: problems being somewhat observed in tone uniformity, image density, and background smear, when compared with initial image Overall Judgment The evaluation results described above are totally judged in accordance with the criteria below.

A: excellent

B: practically allowable level

C: practically non-allowable level

Preparation of Two-Component Developer

5% of each of the resulting toners 1 to 9 and 95% of the carrier prepared as described above were stirred using Turbler mixer (T2F, by Willy A. Bachofen AG Maschinenfabrik) for 5 minutes to prepare two-component developers 1 to 9.

Image Formation and Evaluation

The resulting two-component developers 1 to 9 were filled into image forming apparatus B shown in FIG. 21 and images were formed, then temporal stability is evaluated as follows, and also lower-limit fixing temperature, image quality, and overall judgment are evaluated in the same manner as Examples B1 to B8 and Comparative Example B1. The results are shown in Table 6B.

Image Forming Apparatus B

Image forming apparatus shown in FIG. 21 is a tandem image forming apparatus of indirect transfer type that employs non-contact charging, two-component developing, secondary transfer, blade cleaning, and external-heating roller fixing.

The image forming apparatus B shown in FIG. 21 is equipped with corona chargers of non-contact type as charging units 311 as shown in FIG. 3. Developing units 324 are a two-component developing unit as shown in FIG. 6. The cleaning units 330 have a cleaning blade as shown in FIG. 10.

TABLE 5B

| | toner No. | strage stability | odor | image forming apparatus | LLFT | image quality | stability with time | overall judgement |
|---|---|---|---|---|---|---|---|---|
| Ex. B1 | toner 1 | A | A | A | A | A | A | A |
| Ex. B2 | toner 2 | B | A | A | A | A | A | A |
| Ex. B3 | toner 3 | B | A | A | A | A | B | A |
| Ex. B4 | toner 4 | A | A | A | B | A | A | A |
| Ex. B5 | toner 5 | B | A | A | A | B | B | A |
| Ex. B6 | toner 6 | B | A | A | A | B | B | A |
| Ex. B7 | toner 7 | B | A | A | A | A | A | A |
| Ex. B8 | toner 8 | C | C | A | A | B | B | B |
| Com. Ex. B1 | toner 9 | D | D | A | B | B | C | C |

LLFT: lower-limit fixing temperature

Examples B9 to B16 and Comparative Example B2

Preparation of Carrier

A coating material of the composition shown below was dispersed for 10 minutes using a stirrer to prepare a coating liquid. The coating liquid was poured into a coating device where 5000 parts of a core material (Cu—Zn ferrite particles, weight average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier.

Composition of Coating Material

| | |
|---|---|
| Toluene | 450 parts |
| Silicone resin (SR2400)*1) | 450 parts |
| Amino silane (SH6020)*2) | 10 parts |
| Carbon black | 10 parts |

*1)non-volatile content: 50%, by Toray Dow Corning Silicone Co.

*2)by Toray Dow Corning Silicone Co.

The fixing unit 327 is a roller-type fixing device of electromagnetic induction heating as shown in FIG. 12.

The image forming element 351 of image forming apparatus B shown in FIG. 21 is equipped with charging unit 311, exposing unit 323, developing unit 324, primary transfer unit 325, and cleaning unit 330 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto an intermediate transfer belt 355 by the primary transfer unit 325, then the residual yellow toner on the photoconductor drum 321 is removed by the cleaning unit 330. Similarly, visible images of magenta, cyan, and black toners are formed onto the recording medium by the image forming elements 352, 353, and 354, then a color image formed on the intermediate transfer belt 355 is fixed onto a recording medium 326 by a transfer device 356, then the residual toner on the intermediate transfer belt 355 is removed by an intermediate transfer belt cleaning unit 358. The color image formed on the recording medium 326 is fixed by the fixing unit 327.

Stability with Time

After running printing 100,000 sheets of an image chart with 35% image area in monochrome mode using the image forming apparatus B, the image quality is evaluated in the same manner as Example B1 to B8 and Comparative Example B1.

Evaluation Criteria

A: no problem and excellent image

B: problems being slightly observed in tone, image density, and background smear, when compared with original image, but substantially non-problem under usual temperatures and humidities C: problems being significantly observed in tone uniformity, image density, and background smear

TABLE 6B

| | two-component developer No. | image forming apparatus | LLFT | image quality | stability with time | overall judgement |
|---|---|---|---|---|---|---|
| Ex. B9 | 1 | B | A | A | A | A |
| Ex. B10 | 2 | B | A | A | A | A |
| Ex. B11 | 3 | B | A | A | B | A |
| Ex. B12 | 4 | B | B | A | A | A |
| Ex. B13 | 5 | B | A | B | B | A |
| Ex. B14 | 6 | B | A | B | B | A |
| Ex. B15 | 7 | B | A | A | A | A |
| Ex. B16 | 8 | B | A | B | B | B |
| Com. Ex. B2 | 9 | B | B | B | C | C |

LLFT: lower-limit fixing temperature

The results of Tables 5B and 6B demonstrate that the toners or two-component developers of Examples 1 to 16, comprising a polyester resin that is prepared by condensation polymerization between an alcohol component and a carboxylic acid component that contains fumaric acid-modified rosin as a binder resin of the toner, may exhibit excellent fixing ability and provide high quality images far from tone change with time, and with substantially no occurrences of abnormal images such as density-drop and background smear, compared to those of Comparative Examples 1 and 2 containing no fumaric acid-modified rosin.

It is believed that those of Examples 8 and 16 are somewhat inferior to those of Examples 1 to 3 and 9 to 11 with respect to image quality and temporal stability because of containing fumaric acid-modified rosin prepared by modifying unpurified rosin with fumaric acid.

Example C in Third Aspect of Present Invention

Modification Degree of Rosin by Fumaric Acid

The modification degree of rosin by fumaric acid, i.e. fumaric acid-modification degree, (referred to as "MD by FA") is calculated from the Formula (1C):

$$MD \text{ by } FA = \frac{X_1 - Y}{X_2 - Y} \times 100$$

In the Formula (1C), $X_1$ represents an SP value of fumaric acid-modified rosin to be calculated for the modification degree; $X_2$ represents a saturated SP value of fumaric acid-modified rosin obtained by reaction between one mole of fumaric acid and 0.7 mole of rosin; Y is an SP value of rosin.

The SP value of $X_2$ is of fumaric acid-modified rosin that is prepared in a way that 1 mole of fumaric acid, 0.7 mole of rosin, and 0.4 g of t-butyl catechol are mixed, the mixture is heated from 160° C. to 200° C. over 2 hours and allowed to react at 200° C. for 2 hours, then the reactant is distilled under a reduced pressure of 5.3 kPa. When the acid value of rosin is "x" (mg KOH/g), "x" mg of potassium hydroxide (molecular weight: 56.1) is allowed to react with 1 g of the rosin, thus the molecular weight of the rosin can be calculated by 56100÷x.

Synthetic Example 1

Purification of Rosin 1000 g of tall rosin (glass transition temperature Tg: 37.2° C.) was added into a flask of 2000 mL equipped with a fractionating column, a reflux condenser, and a trap, and was distilled under a reduced pressure of 1 kPa, thereby distillate of 195° C. to 250° C. was mainly collected. Hereinafter, tall rosin to be purified is referred to as unpurified rosin, and rosin from which main distilling components having been removed is referred to as purified rosin (Tg: 39.2° C.).

20 g of rosin was milled for 5 seconds by use of a coffee mill (National MK-61M), and passed through a mesh of opening 1 mm, then the resulting powder was weighed in an amount of 0.5 g into a vial (20 mL) for headspace. Headspace gas was sampled and impurities within unpurified or purified rosin were analyzed by a headspace GC-MS method as follows. The results are shown in Table 1C.

Measuring Condition in Headspace GC-MS Method (A) Headspace Sampler (HP7694, by Agilent Co.)

Sample temperature: 200° C.

Loop temperature: 200° C.

Transfer line temperature: 200° C.

Heating time of equilibrium sample: 30 minutes

Pressure gas in vial: helium (He)

Pressure time at vial: 0.3 minute

Loop filling time: 0.03 minute

Equilibrium time at loop: 0.3 minute

Injecting time: 1 minute (B) Gas Chromatography (GC) (HP6890, by Agilent Co.)

Analytical column: DB-1 (60 m-320 μm-5 μm)

Carrier gas: helium (He)

Flow rate: 1 mL/min

Injection temperature: 210° C.

Column head pressure: 34.2 kPa

Injection mode: split

Split ratio: 10:1

Oven temperature: 45° C. (3 minutes)-10° C./min-280° C. (15 minutes)

(C) Mass Spectrometry (MS) (HP5973, by Agilent Co.)

Ionization method: electron impulse (EI)

Interface temperature: 280° C.

Ion source temperature: 230° C.

Quadrupole temperature: 150° C.

Detection mode: Scan 29 to 350 m/sec

TABLE 1C

| | hexanoic acid | pentanoic acid | benzaldehyde | n-hexanal | 2-pentyl-furan | SP value ° C. | Softening Tem. ° C. | Acid Value (mgKOH/g) | Molecular weight |
|---|---|---|---|---|---|---|---|---|---|
| Unpurified Rosin | $0.9 \times 10^7$ | $0.6 \times 10^7$ | $0.6 \times 10^7$ | $1.8 \times 10^7$ | $1.1 \times 10^7$ | 77.0 | 74.3 | 169 | 332 |
| Purified Rosin | $0.4 \times 10^7$ | $0.2 \times 10^7$ | $0.2 \times 10^7$ | $1.4 \times 10^7$ | $0.7 \times 10^7$ | 76.8 | 75.1 | 166 | 338 |

Saturated SP Value

Saturated SP value for $X_2$ value of acrylic acid-modified rosin prepared from unpurified rosin was measured as follows. 332 g (1 mole) of unpurified rosin (SP value: 77.0° C.), 81 g (0.7 mole) of fumaric acid, and 0.4 g of t-butylcatechol were added into a flask of 1000 mL equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to remove unreacted fumaric acid and volatile substances to prepare fumaric acid-modified rosin. The SP value of the resulting fumaric acid-modified rosin, i.e. the SP value of the fumaric acid-modified rosin prepared from the unpurified rosin was 130.6° C.

Saturated SP Value

Saturated SP value for $X_2$ value of acrylic acid-modified rosin prepared from unpurified rosin was measured as follows. 338 g (1 mole) of unpurified rosin (SP value: 76.8° C.), 81 g (0.7 mole) of fumaric acid, and 0.4 g of t-butylcatechol were added into a flask of 1000 mL equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to remove unreacted fumaric acid and volatile substances to prepare fumaric acid-modified rosin. The SP value of the resulting fumaric acid-modified rosin, i.e. the SP value of the fumaric acid-modified rosin prepared from the unpurified rosin was 130.9° C.

Synthesis Example 2

Synthesis of Fumaric Acid-Modified Rosin A 5408 g (16 mole) of purified rosin (SP value: 76.8° C.), 928 g (8 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin A. The resulting fumaric acid-modified rosin A had an SP value of 130.8° C., a glass transition temperature Tg of 74.4° C., and a fumaric acid-modification degree of 100.

Synthesis Example 3

Synthesis of Fumaric Acid-Modified Rosin B 5408 g (16 mole) of purified rosin (SP value: 76.8° C.), 557 g (4.8 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin B. The resulting fumaric acid-modified rosin B had an SP value of 115.7° C., a glass transition temperature Tg of 53.9° C., and a fumaric acid-modification degree of 72.

Synthesis Example 4

Synthesis of Fumaric Acid-Modified Rosin C 5408 g (16 mole) of purified rosin (SP value: 76.8° C.), 278 g (2.4 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin C. The resulting fumaric acid-modified rosin C had an SP value of 98.4° C., a glass transition temperature Tg of 48.3° C., and a fumaric acid-modification degree of Synthesis Example 5

Synthesis of Fumaric Acid-Modified Rosin D 5312 g (16 mole) of unpurified rosin (SP value: 77.0° C.), 928 g (8 mole) of fumaric acid, and 0.4 g of t-butylcatechol were added into a flask of 10 L equipped with a fractionating column, a reflux condenser, and a trap, and the reactant was heated up from 160° C. to 200° C. over 2 hours and allowed to react at 200° C. for 2 hours, then the reactant was distilled under a reduced pressure of 5.3 kPa to prepare fumaric acid-modified rosin D. The resulting fumaric acid-modified rosin D had an SP value of 130.4° C., a glass transition temperature Tg of 72.1° C., and a fumaric acid-modification degree of 100.

Synthetic Examples 6 to 10 and 12 to 15

Synthesis of Polyester Binder Resins 1 to 5 and 7 to 10

The alcohol components, carboxylic acid components other than anhydrous trimellitic acid, and esterification catalysts shown in Table 2C were added into a four-necked 5 L flask, equipped with a distillation tube, flowing 98° C. warm water, mounted upward a condenser flowing water at room temperature, a nitrogen inlet, a water outlet, a stirrer, and a thermocouple, then the mixture was subjected to condensation polymerization at 160° C. for 2 hours under nitrogen atmosphere, then the reactant was heated to 210° C. over 6 hours, followed by allowing to react for 1 hour under 66 kPa. After cooling the reactant to 200° C., anhydrous trimellitic acid shown in Table 2C was added, then the mixture was allowed to react for 1 hour under normal pressure 101.3 kPa followed by rising to 210° C. and continued to react under 40 kPa till the reactant took an intended softening temperature; thereby, polyester binder resins 1 to 5 and 7 to 10 were synthesized.

Synthetic Example 11

Synthesis of Polyester Binder Resin 6

The alcohol components other than glycerin, carboxylic acid components other than anhydrous trimellitic acid, and esterification catalysts shown in Table 2C were added into a four-necked 5 L flask, equipped with a distillation tube, flowing 98° C. warm water, mounted upward a condenser flowing water at room temperature, a nitrogen inlet, a water outlet, a stirrer, and a thermocouple, then the mixture was subjected to condensation polymerization at 160° C. for 2 hours under nitrogen atmosphere, then the reactant was heated to 210° C. over 6 hours, followed by allowing to react for 1 hour under 66 kPa. After cooling the reactant to 180° C., glycerin shown in Table 2C was added and the mixture was heated to 200° C. at a rate of 5° C./30 min, then the mixture was allowed to react at 200° C. for 1 hour under normal pressure 101.3 kPa followed by allowing to react for 1 hour under 66 kPa. Then anhydrous trimellitic acid shown in Table 2C was added, and the mixture was allowed to react for 1 hour under normal pressure 101.3 kPa followed by rising to 210° C. and continued to react under 40 kPa till the reactant took an intended softening temperature; thereby, polyester binder resin 6 was synthesized.

Production Example 1

Production of Master Batch 1

The pigments shown below, polyester binder resin 1, and pure water were mixed in a ratio of 1:1:0.5 by mass, and kneaded by a twin roll at 70° C.; then the roll temperature was risen to 120° C. to evaporate water, thereby to produce master batch 1 of cyan toner master batch 1 (TB-C1), magenta toner master batch 1 (TB-M1), yellow toner master batch 1 (TB-Y1), and black toner master batch 1 (TB-K1).

Formulation of Cyan Toner Master Batch 1 (TB-C1)

| | |
|---|---|
| Polyester binder resin 1 | 100 parts |
| Cyan pigment (C.I. Pigment Blue 15:3) | 100 parts |
| Pure water | 50 parts |

Formulation of Magenta Toner Master Batch 1 (TB-M1)

| | |
|---|---|
| Polyester binder resin 1 | 100 parts |
| Magenta pigment (C.I. Pigment Red 122) | 100 parts |
| Pure water | 50 parts |

TABLE 2C

| | Synthesis Example | | | | | | | | | |
|---|---|---|---|---|---|---|---|---|---|---|
| | 6 | 7 | 8 | 9 | 10 | 11 | 12 | 13 | 14 | 15 |
| polyester binder resin No. | 1 | 2 | 3 | 4 | 5 | 6 | 7 | 8 | 9 | 10 |
| alcohol component | | | | | | | | | | |
| 1,2-propanediol | 851 g | 851 g | 851 g | 851 g | 851 g | 851 g | 1216 g | 851 g | 851 g | 851 g |
| 1,3-propanediol | 122 g | 122 g | 122 g | 122 g | 122 g | 122 g | — | — | — | 122 g |
| 1,4-butanediol | — | — | — | — | — | — | — | 144 g | — | — |
| BPA-PO* | — | — | — | — | — | — | — | — | 560 g | — |
| glycerin | 294 g | 294 g | 294 g | 294 g | 294 g | 294 g | — | 294 g | 294 g | 294 g |
| carboxylic acid component | | | | | | | | | | |
| terephthalic acid | 1859 g | 1859 g | 1859 g | 1859 g | 1859 g | 1859 g | 1859 g | 1859 g | 1859 g | 1859 g |
| anhydrous trimellitic acid | 399 g | 399 g | 399 g | 399 g | 399 g | 399 g | 399 g | 399 g | 399 g | 399 g |
| unpurified rosin** | — | — | — | — | — | — | — | — | — | 528 g |
| acrylic acid-modified rosin A | 717 g | — | — | — | 358 g | 1075 g | 717 g | 717 g | 717 g | — |
| acrylic acid-modified rosin B | — | 717 g | — | — | — | — | — | — | — | — |
| acrylic acid-modified rosin C | — | — | 717 g | — | — | — | — | — | — | — |
| acrylic acid-modified rosin D | — | — | — | 717 g | — | — | — | — | — | — |
| esterification catalyst | | | | | | | | | | |
| dibutyl tin oxide | — | — | — | — | — | — | — | 25 g | — | — |
| dioctanoic acid tin (II) salt | 25 g | 25 g | 25 g | 25 g | — | 25 g | — | — | 25 g | 25 g |
| TIB*** | — | — | — | — | 25 g | — | 25 g | — | — | — |
| content of rosin in carboxylic acid component (% by mass) | 24.1 | 24.1 | 24.1 | 24.1 | 13.7 | 32.3 | 24.1 | 24.1 | 24.1 | 19.0 |
| properties of polyester | | | | | | | | | | |
| acid value (mgKOH/g) | 38.4 | 36.2 | 33.7 | 28.7 | 25.4 | 43.9 | 34.2 | 31.6 | 31.5 | 33.1 |
| hydroxyl value (mgKOH/g) | 20.4 | 21.5 | 18.7 | 17.9 | 18.8 | 14.3 | 16.8 | 14.1 | 22.3 | 16.4 |
| softening temp. (° C.) | 119.1 | 116.5 | 115.4 | 113.1 | 116.7 | 110.1 | 103.6 | 113.4 | 120.6 | 104.2 |
| glass transition temp. (° C.) | 65.8 | 63.1 | 62.3 | 59.6 | 61.3 | 57.1 | 63.4 | 58.7 | 65.1 | 55.4 |
| content of low molecular weight components**** | 6.2 | 6.8 | 7.3 | 8.1 | 6.8 | 10.4 | 7.9 | 6.7 | 6.8 | 15.8 |

*BPA-PO: polyoxypropylene(2.2)-2,2-bis(4-hydroxyphenyl)propane (divalent aromatic alcoh

**unmodofied rosin

***TIB: titanium isopropylate bistriethanolaminate

****molecular weight: 500 or less

Formulation of Yellow Toner Master Batch 1 (TB-Y1)

| | |
|---|---|
| Polyester binder resin 1 | 100 parts |
| Yellow pigment (C.I. Pigment Yellow 180) | 100 parts |
| Pure water | 50 parts |

Production Examples 2 to 10

Production of Master Batches 2 to 10

The master batches 2 to 10 of cyan toner master batches 2 to 10 (TB-C2 to TB-C10), yellow toner master batches 2 to 10 (TB-Y2 to TB-Y10), magenta toner master batches 2 to 10 (TB-M2 to TB-M10), and black toner master batches 2 to 10 (TB-K2 to TB-K10) shown in Table 3C were produced in the same manner as Production Example 1 except that the polyester binder resin 1 was changed into the polyester binder resins 2 to 10.

TABLE 3C

| | | | binder resin formulation | | pigment formulation | | pure |
|---|---|---|---|---|---|---|---|
| | | | binder resin | amount (part) | pigment | amount (part) | water (part) |
| master batch 1 | cyan | TB-C1 | binder resin 1 | 100 | C.I. Pigment blue 15:3 | 100 | 50 |
| | magenta | TB-M1 | | 100 | C.I. Pigment red 122 | 100 | 50 |
| | yellow | TB-Y1 | | 100 | C.I. Pigment yellow 180 | 100 | 50 |
| | black | TB-K1 | | 100 | carbon black | 100 | 50 |
| master batch 2 | cyan | TB-C2 | binder resin 2 | 100 | C.I. Pigment blue 15:3 | 100 | 50 |
| | magenta | TB-M2 | | 100 | C.I. Pigment red 122 | 100 | 50 |
| | yellow | TB-Y2 | | 100 | C.I. Pigment yellow 180 | 100 | 50 |
| | black | TB-K2 | | 100 | carbon black | 100 | 50 |
| master batch 3 | cyan | TB-C3 | binder resin 3 | 100 | C.I. Pigment blue 15:3 | 100 | 50 |
| | magenta | TB-M3 | | 100 | C.I. Pigment red 122 | 100 | 50 |
| | yellow | TB-Y3 | | 100 | C.I. Pigment yellow 180 | 100 | 50 |
| | black | TB-K3 | | 100 | carbon black | 100 | 50 |
| master batch 4 | cyan | TB-C4 | binder resin 4 | 100 | C.I. Pigment blue 15:3 | 100 | 50 |
| | magenta | TB-M4 | | 100 | C.I. Pigment red 122 | 100 | 50 |
| | yellow | TB-Y4 | | 100 | C.I. Pigment yellow 180 | 100 | 50 |
| | black | TB-K4 | | 100 | carbon black | 100 | 50 |
| master batch 5 | cyan | TB-C5 | binder resin 5 | 100 | C.I. Pigment blue 15:3 | 100 | 50 |
| | magenta | TB-M5 | | 100 | C.I. Pigment red 122 | 100 | 50 |
| | yellow | TB-Y5 | | 100 | C.I. Pigment yellow 180 | 100 | 50 |
| | black | TB-K5 | | 100 | carbon black | 100 | 50 |
| master batch 6 | cyan | TB-C6 | binder resin 6 | 100 | C.I. Pigment blue 15:3 | 100 | 50 |
| | magenta | TB-M6 | | 100 | C.I. Pigment red 122 | 100 | 50 |
| | yellow | TB-Y6 | | 100 | C.I. Pigment yellow 180 | 100 | 50 |
| | black | TB-K6 | | 100 | carbon black | 100 | 50 |
| master batch 7 | cyan | TB-C7 | binder resin 7 | 100 | C.I. Pigment blue 15:3 | 100 | 50 |
| | magenta | TB-M7 | | 100 | C.I. Pigment red 122 | 100 | 50 |
| | yellow | TB-Y7 | | 100 | C.I. Pigment yellow 180 | 100 | 50 |
| | black | TB-K7 | | 100 | carbon black | 100 | 50 |
| master batch 8 | cyan | TB-C8 | binder resin 8 | 100 | C.I. Pigment blue 15:3 | 100 | 50 |
| | magenta | TB-M8 | | 100 | C.I. Pigment red 122 | 100 | 50 |
| | yellow | TB-Y8 | | 100 | C.I. Pigment yellow 180 | 100 | 50 |
| | black | TB-K8 | | 100 | carbon black | 100 | 50 |
| master batch 9 | cyan | TB-C9 | binder resin 9 | 100 | C.I. Pigment blue 15:3 | 100 | 50 |
| | magenta | TB-M9 | | 100 | C.I. Pigment red 122 | 100 | 50 |
| | yellow | TB-Y9 | | 100 | C.I. Pigment yellow 180 | 100 | 50 |
| | black | TB-K9 | | 100 | carbon black | 100 | 50 |
| master batch 10 | cyan | TB-C10 | binder resin 10 | 100 | C.I. Pigment blue 15:3 | 100 | 50 |
| | magenta | TB-M10 | | 100 | C.I. Pigment red 122 | 100 | 50 |
| | yellow | TB-Y10 | | 100 | C.I. Pigment yellow 180 | 100 | 50 |
| | black | TB-K10 | | 100 | carbon black | 100 | 50 |

Formulation of Black Toner Master Batch 1 (TB-K1)

| | |
|---|---|
| Polyester binder resin 1 | 100 parts |
| Black pigment (carbon black) | 100 parts |
| Pure water | 50 parts |

Production Example 11

Production of Toner 1

Toner 1 of cyan toner 1, magenta toner 1, yellow toner 1, and black toner 1 were produced as follows.

Production of Cyan Toner 1

The ingredients of cyan toner formulation 1 shown below were pre-mixed by Henschel mixer (FM10B, by Mitsui Mining Co.), then kneaded by a two-axis kneader (PCM-30, by Ikegai, Ltd.). Then the mixture was finely milled by a Jet Mill (Labo Jet, by Japan Pneumatic Mfg. Co.) and classified by an air classifier (MDS-I, by Japan Pneumatic Mfg. Co.) thereby to produce toner base particles having a weight average particle diameter of 7 μm.

To 100 parts by mass of the toner base particles, 1.0 part by mass of colloidal silica (H-2000, by Clariant Co.) was mixed by a sample mill to produce cyan toner 1.

Cyan Toner Formulation 1

| | |
|---|---|
| Polyester binder resin 1 | 100 parts |
| Cyan toner master batch (TB-C1) | 20 parts |
| Charge control agent (E-84)*1) | 1 part |
| Ester wax*2) | 5 parts |

*1)by Orient Chemical Industries, Ltd.
*2)acid value: 5 mgKOH/g, weight average molecular weight: 1600

Production of Magenta Toner 1

Magenta toner 1 was produced in the same manner as cyan toner 1 except that cyan toner formulation 1 was changed into magenta toner formulation 1 shown below.

Magenta Toner Formulation 1

| | |
|---|---|
| Polyester binder resin 1 | 100 parts |
| Magenta toner master batch (TB-M1) | 18 parts |
| Charge control agent (E-84)*1) | 1 part |
| Ester wax*2) | 5 parts |

*1)by Orient Chemical Industries, Ltd.
*2)acid value: 5 mgKOH/g, weight average molecular weight: 1600

Production of Yellow Toner 1

Yellow toner 1 was produced in the same manner as cyan toner 1 except that cyan toner formulation 1 was changed into yellow toner formulation 1 shown below.

Yellow Toner Formulation 1

| | |
|---|---|
| Polyester binder resin 1 | 100 parts |
| Yellow toner master batch (TB-Y1) | 20 parts |
| Charge control agent (E-84)*1) | 1 part |
| Ester wax*2) | 5 parts |

*1)by Orient Chemical Industries, Ltd.
*2)acid value: 5 mgKOH/g, weight average molecular weight: 1600

Production of Black Toner 1

Black toner 1 was produced in the same manner as cyan toner 1 except that cyan toner formulation 1 was changed into black toner formulation 1 shown below.

Black Toner Formulation 1

| | |
|---|---|
| Polyester binder resin 1 | 100 parts |
| Black toner master batch (TB-K1) | 16 parts |
| Charge control agent (E-84)*1) | 1 part |
| Ester wax*2) | 5 parts |

*1)by Orient Chemical Industries, Ltd.
*2)acid value: 5 mgKOH/g, weight average molecular weight: 1600

Production Examples 12 to 20

Production of Toners 2 to 10

Toners 2 to 10 of cyan toners 2 to 10, yellow toners 2 to 10, magenta toners 2 to 10, and black toners 2 to 10 shown in Table 4C were produced in the same manner as Production Example 11, except that polyester binder resin 1 was changed into polyester binder resins 2 to 10 and master batch 1 was changed into master batches 2 to 10.

TABLE 4C

| | | binder resin formulation | | master batch formulation | | charge control agent formulation | | wax formulation | |
|---|---|---|---|---|---|---|---|---|---|
| | | binder resin | amount (part) | master batch | amount (part) | charge control agent | amount (part) | wax | amount (part) |
| toner 1 | cyan | binder resin 1 | 100 | TB-C1 | 20 | E-84 | 1 | ester | 5 |
| | magenta | | 100 | TB-M1 | 18 | | 1 | wax | 5 |
| | yellow | | 100 | TB-Y1 | 20 | | 1 | | 5 |
| | black | | 100 | TB-K1 | 16 | | 1 | | 5 |
| toner 2 | cyan | binder resin 2 | 100 | TB-C2 | 20 | E-84 | 1 | ester | 5 |
| | magenta | | 100 | TB-M2 | 18 | | 1 | wax | 5 |
| | yellow | | 100 | TB-Y2 | 20 | | 1 | | 5 |
| | black | | 100 | TB-K2 | 16 | | 1 | | 5 |
| toner 3 | cyan | binder resin 3 | 100 | TB-C3 | 20 | E-84 | 1 | ester | 5 |
| | magenta | | 100 | TB-M3 | 18 | | 1 | wax | 5 |
| | yellow | | 100 | TB-Y3 | 20 | | 1 | | 5 |
| | black | | 100 | TB-K3 | 16 | | 1 | | 5 |
| toner 4 | cyan | binder resin 4 | 100 | TB-C4 | 20 | E-84 | 1 | ester | 5 |
| | magenta | | 100 | TB-M4 | 18 | | 1 | wax | 5 |
| | yellow | | 100 | TB-Y4 | 20 | | 1 | | 5 |
| | black | | 100 | TB-K4 | 16 | | 1 | | 5 |
| toner 5 | cyan | binder resin 5 | 100 | TB-C5 | 20 | E-84 | 1 | ester | 5 |
| | magenta | | 100 | TB-M5 | 18 | | 1 | wax | 5 |
| | yellow | | 100 | TB-Y5 | 20 | | 1 | | 5 |
| | black | | 100 | TB-K5 | 16 | | 1 | | 5 |
| toner 6 | cyan | binder resin 6 | 100 | TB-C6 | 20 | E-84 | 1 | ester | 5 |
| | magenta | | 100 | TB-M6 | 18 | | 1 | wax | 5 |
| | yellow | | 100 | TB-Y6 | 20 | | 1 | | 5 |
| | black | | 100 | TB-K6 | 16 | | 1 | | 5 |

TABLE 4C-continued

| | | binder resin formulation | | master batch formulation | | charge control agent formulation | | wax formulation | |
|---|---|---|---|---|---|---|---|---|---|
| | | binder resin | amount (part) | master batch | amount (part) | charge control agent | amount (part) | wax | amount (part) |
| toner 7 | cyan | binder resin 7 | 100 | TB-C7 | 20 | E-84 | 1 | ester | 5 |
| | magenta | | 100 | TB-M7 | 18 | | 1 | wax | 5 |
| | yellow | | 100 | TB-Y7 | 20 | | 1 | | 5 |
| | black | | 100 | TB-K7 | 16 | | 1 | | 5 |
| toner 8 | cyan | binder resin 8 | 100 | TB-C8 | 20 | E-84 | 1 | ester | 5 |
| | magenta | | 100 | TB-M8 | 18 | | 1 | wax | 5 |
| | yellow | | 100 | TB-Y8 | 20 | | 1 | | 5 |
| | black | | 100 | TB-K8 | 16 | | 1 | | 5 |
| toner 9 | cyan | binder resin 9 | 100 | TB-C9 | 20 | E-84 | 1 | ester | 5 |
| | magenta | | 100 | TB-M9 | 18 | | 1 | wax | 5 |
| | yellow | | 100 | TB-Y9 | 20 | | 1 | | 5 |
| | black | | 100 | TB-K9 | 16 | | 1 | | 5 |
| toner 10 | cyan | binder resin | 100 | TB-C10 | 20 | E-84 | 1 | ester | 5 |
| | magenta | 10 | 100 | TB-M10 | 18 | | 1 | wax | 5 |
| | yellow | | 100 | TB-Y10 | 20 | | 1 | | 5 |
| | black | | 100 | TBK10 | 16 | | 1 | | 5 |

Evaluation of Toner Properties

The resulting toners 1 to 10 were evaluated with respect to storage stability and odor in the following ways. The results are shown in Table 5C.

Evaluation of Storage Stability

A toner is filled into two open-cylindrical containers of 5 cm diameter and 2 cm high in a weight of 4 g respectively. One container is allowed to stand at temperature 40° C. and relative humidity 60%, and another container is allowed to stand at temperature 55° C. and relative humidity 60%, for 72 hours. After this period, the containers with a toner are shaken mildly, then the existence of toner agglomeration is visually observed and the storage stability is evaluated in accordance with the following criteria.

Evaluation Criteria

A: no toner agglomeration under both conditions of 40° C. and 55° C.

B: no toner agglomeration under 40° C., but some agglomerated granules under 55° C.

C: some agglomerated granules under 40° C., and significant agglomeration under 55° C.

D: significant agglomeration under both conditions of 40° C. and 55° C.

Evaluation of Odor

A toner is weighed into an aluminum cup in an amount of 20 g, which is placed on a hot plate at 150° C. for 30 minutes, then the odor from the toner is evaluated in accordance with the following criteria.

Evaluation Criteria

A: no odor

B: almost no odor

C: some odor, but practically no problem

D: significant odor

Examples C1 to C9 and Comparative Example C1

Image Formation and Evaluation

The resulting toners 1 to 10 were filled into image forming apparatus A shown in FIG. 20 and images were formed, then various properties were evaluated. The results are shown in Table 5C.

Image Forming Apparatus A

Image forming apparatus shown in FIG. 20 is a tandem image forming apparatus of direct transfer type that employs contact charging, one-component developing, direct transfer, cleaner-less, and internal-heating belt fixing.

The image forming apparatus A shown in FIG. 20 is equipped with charging rollers of contact type as charging units 310 as shown in FIG. 1. Developing units 324 are a one-component developing unit as shown in FIG. 5 that is cleaner-less to collect residual toners. The fixing unit 327 is a belt-type fixing device as shown in FIG. 9 that is equipped with a halogen lamp to heat the heating roller. Conveying belt 330 is also shown in FIG. 20.

The image forming element 341 of image forming apparatus A shown in FIG. 20 is equipped with charging unit 310, exposing unit 323, developing unit 324, and transfer unit 325 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto a recording medium 326 by the transfer unit 325, then the residual toner on the photoconductor drum 321 is collected by the developing unit 324. Similarly, visible images of magenta, cyan, and black toners are overlapped onto the recording medium by the image forming elements 342, 343, and 344, then a color image formed on the recording medium 326 is fixed by the fixing unit 327.

Fixing Ability

Lower-Limit Fixing Temperature

Using the image forming apparatus A, a solid image of 1.0±0.05 mg/cm$^2$ is printed on a regular paper and a thick paper (type 6200, by Ricoh Co., copy paper No. 135, by NBS Ricoh Co.) while varying the temperature of the fixing unit to evaluate the lower limit fixing temperature, which is defined as the temperature at which the residual rate of image density is no more than 70% after rubbing the fixed image by a pad.

Evaluation Criteria

A: lower limit fixing temperature<135° C.

B: 135° C.≦lower limit fixing temperature<145° C.

C: 145° C.≦lower limit fixing temperature<155° C.

D: 155° C.≦lower limit fixing temperature

Hot Offset Generating Temperature

Using the image forming apparatus A, a solid image of 1.0±0.05 mg/cm$^2$ was printed on a regular paper (type 6200, by Ricoh Co.) while varying the temperature of the fixing unit to evaluate the hot offset generating temperature, which is defined as the temperature of the fixing roll at which the hot offset generates.

Evaluation Criteria

A: 190° C.≦hot offset generating temperature

B: 180° C.≦hot offset generating temperature<190° C.

C: 170° C.≦hot offset generating temperature<180° C.

D: hot offset generating temperature<170° C.

Image Quality

The image quality is evaluated with respect to image density, background smear, thin line reproduction, and color tone of output images. The images are visually observed and evaluated into three steps below.

Evaluation Criteria

A: no problem and excellent image

B: problems being slightly observed in tone, image density, and background smear, when compared with original image, but substantially non-problem under usual temperatures and humidities C: problems being somewhat observed in tone uniformity, image density, and background smear, when compared with original image Stability with Time After running printing 50,000 sheets of an image chart with 35% image area in monochrome mode using the image forming apparatus A, the image quality is evaluated in the same manner as described above in comparison with the initial image.

Evaluation Criteria

A: no problem and excellent image

B: problems being slightly observed in tone, image density, and background smear, when compared with initial image, but substantially non-problem under usual temperatures and humidities C: problems being somewhat observed in tone uniformity, image density, and background smear, when compared with initial image Overall Judgment The evaluation results described above are totally judged in accordance with the criteria below.

A: excellent

B: practically allowable level

C: practically non-allowable level

TABLE 5C

| | | strage | | image forming | fixing ability | | image | stability | overall |
|---|---|---|---|---|---|---|---|---|---|
| | toner No. | stability | odor | apparatus | LLFT | HOGT | quality | with time | judgement |
| Ex. C1 | toner 1 | A | A | A | A | A | A | A | A |
| Ex. C2 | toner 2 | B | A | A | A | A | A | A | A |
| Ex. C3 | toner 3 | B | A | A | A | B | B | B | B |
| Ex. C4 | toner 4 | B | C | A | A | A | B | B | B |
| Ex. C5 | toner 5 | A | A | A | B | B | B | A | B |
| Ex. C6 | toner 6 | C | A | A | A | B | B | B | B |
| Ex. C7 | toner 7 | A | A | A | A | B | B | B | B |
| Ex. C8 | toner 8 | B | A | A | A | A | B | B | B |
| Ex. C9 | toner 9 | A | A | A | A | B | B | A | B |
| Com. Ex. C1 | toner 10 | D | D | A | B | C | B | C | C |

LLFT: lower-limit fixing temperature

HOGT: hot offset generating temperature

Examples C10 to C18 and Comparative Example C2

Preparation of Carrier

A coating material of the composition shown below was dispersed for 10 minutes using a stirrer to prepare a coating liquid. The coating liquid was poured into a coating device where 5000 parts of a core material (Cu—Zn ferrite particles, weight average particle diameter: 35 μm) was coated with the coating liquid while forming a swirl flow by action of a rotatable bottom disc and stirring blades within a fluidized bed. The resulting coated material was heated at 250° C. for 2 hours in an electric furnace to prepare a carrier.

Composition of Coating Material

| | |
|---|---|
| Toluene | 450 parts |
| Silicone resin (SR2400)*1) | 450 parts |
| Amino silane (SH6020)*2) | 10 parts |
| Carbon black | 10 parts |

*1)non-volatile content: 50%, by Toray Dow Corning Silicone Co.

*2)by Toray Dow Corning Silicone Co.

Preparation of Two-Component Developer

5% of each of the resulting toners 1 to 10 and 95% of the carrier prepared as described above were stirred using Turbler mixer (T2F, by Willy A. Bachofen AG Maschinenfabrik) for 5 minutes to prepare two-component developers 1 to 10.

Image Formation and Evaluation

The resulting two-component developers 1 to 10 were filled into image forming apparatus B shown in FIG. 21 and images were formed, then temporal stability is evaluated as follows, and also lower-limit fixing temperature, image quality, and overall judgment are evaluated in the same manner as Examples C1 to C9 and Comparative Example C1. The results are shown in Table 6C.

Image Forming Apparatus B

Image forming apparatus shown in FIG. 21 is a tandem image forming apparatus of indirect transfer type that employs non-contact charging, two-component developing, secondary transfer, blade cleaning, and external-heating roller fixing.

The image forming apparatus B shown in FIG. 21 is equipped with corona chargers of non-contact type as charging units 311 as shown in FIG. 3. Developing units 324 are a two-component developing unit as shown in FIG. 6. The cleaning units 330 have a cleaning blade as shown in FIG. 10. The fixing unit 327 is a roller-type fixing device of electromagnetic induction heating as shown in FIG. 12.

The image forming element 351 of image forming apparatus B shown in FIG. 21 is equipped with charging unit 311, exposing unit 323, developing unit 324, primary transfer unit 325, and cleaning unit 330 around photoconductor drum 321. The photoconductor drum 321 of the image forming element 341 bears a latent electrostatic image while rotating by action of charging unit 310 and exposing unit 323. The latent electrostatic image is developed using a yellow toner by the developing unit 324, and a visible image of the yellow toner is formed on the photoconductor drum 321. The visible image is transferred onto an intermediate transfer belt 355 by the primary transfer unit 325, then the residual yellow toner on the photoconductor drum 321 is removed by the cleaning unit 330. Similarly, visible images of magenta, cyan, and black toners are formed onto the recording medium by the image forming elements 352, 353, and 354, then a color image formed on the intermediate transfer belt 355 is fixed onto a recording medium 326 by a transfer device 356, then the residual toner on the intermediate transfer belt 355 is removed by an intermediate transfer belt cleaning unit 358. The color image formed on the recording medium 326 is fixed by the fixing unit 327.

Stability with Time

After running printing 100,000 sheets of an image chart with 35% image area in monochrome mode using the image forming apparatus B, the image quality is evaluated in the same manner as Example C1 to C9 and Comparative Example C1.

Evaluation Criteria

A: no problem and excellent image

B: problems being slightly observed in tone, image density, and background smear, when compared with original image, but substantially non-problem under usual temperatures and humidities C: problems being significantly observed in tone uniformity, image density, and background smear The results of Tables 5C and 6C demonstrate that the toners or two-component developers of Examples C1 to C18, comprising a polyester resin that is prepared by condensation polymerization between an alcohol component that contains an aliphatic polyvalent alcohol and a carboxylic acid component that contains fumaric acid-modified rosin as a binder resin of the toner, may exhibit excellent fixing ability and provide high quality images far from tone change with time, and with substantially no occurrences of abnormal images such as density-drop and background smear, compared to those of Comparative Examples C1 and C2 containing no fumaric acid-modified rosin.

It is believed that those of Examples C4 and C13 are somewhat inferior to those of Examples C1 to C3 and C10 to C12 with respect to image quality and temporal stability because of containing fumaric acid-modified rosin prepared by modifying unpurified rosin with fumaric acid.

The image forming apparatuses, image forming methods, and process cartridges according to the present invention employ toners that are excellent in low temperature fixing ability, hot offset resistance, and storage stability, and also generate less odor, therefore, can provide high quality images with superior fixing ability, far from tone change with time, and less likely to occur abnormal images such as density-drop and background smear, consequently, can be widely utilized for laser printers, direct digital printmakers, full color copiers of direct or indirect electrophotographic multi-color development, full color laser printers, full color facsimiles for regular paper, etc.

What is claimed is:

1. An image forming method, comprising:

charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner comprises a binder resin and a colorant, the binder resin comprises a polyester resin prepared by condensation polymerization between an alcohol component that contains an aliphatic polyvalent alcohol and a carboxylic acid component that contains at least one of (meth)acrylic acid-modified rosin and fumaric acid-modified rosin, and

TABLE 6C

| | two-component developer No. | image forming apparatus | fixing ability LLFT | fixing ability HOGT | image quality | stability with time | overall judgement |
|---|---|---|---|---|---|---|---|
| Ex. C10 | 1 | B | A | A | A | A | A |
| Ex. C11 | 2 | B | A | A | A | A | A |
| Ex. C12 | 3 | B | A | B | B | B | B |
| Ex. C13 | 4 | B | A | A | B | B | B |
| Ex. C14 | 5 | B | B | B | B | A | B |
| Ex. C15 | 6 | B | A | B | B | B | B |
| Ex. C16 | 7 | B | A | B | B | B | B |
| Ex. C17 | 8 | B | A | A | B | B | B |
| Ex. C18 | 9 | B | A | B | B | A | B |
| Com. Ex. C2 | 10 | B | B | C | B | C | C |

LLFT: lower-limit fixing temperature

HOGT: hot offset generating temperature wherein the content of low molecular weight components having a molecular weight of 500 or less is 12% by mass or less in the polyester resin.

2. The image forming method according to claim 1, wherein the aliphatic polyvalent alcohol comprises one having a carbon number of 2 to 6.

3. The image forming method according to claim 1, wherein said carboxylic acid component contains (meth) acrylic acid-modified rosin and wherein the content of the (meth)acrylic acid-modified rosin is 5% by mass to 85% by mass in the carboxylic acid component.

4. The image forming method according to claim 1, wherein said carboxylic acid component contains (meth) acrylic acid-modified rosin and wherein the (meth)acrylic acid-modified rosin is prepared by modifying a purified rosin with (meth)acrylic acid.

5. The image forming method according to claim 1, wherein said carboxylic acid component contains fumaric acid-modified rosin and wherein the content of the fumaric acid-modified rosin is 5% by mass to 85% by mass in the carboxylic acid component.

6. The image forming method according to claim 1, wherein said carboxylic acid component contains fumaric acid-modified rosin and wherein the fumaric acid-modified rosin is prepared by modifying a purified rosin with fumaric acid.

7. The image forming method according to claim 1, wherein the alcohol component comprises an alcohol of trivalent or more, and/or the carboxylic acid component comprises a carboxylic acid of trivalent or more.

8. The image forming method according to claim 1, wherein the condensation polymerization is carried out in the presence of a titanium compound and/or a tin (II) compound having no Sn—C bond.

9. An image forming method, comprising:

charging a surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner comprises a binder resin and a colorant, the binder resin comprises a polyester resin prepared by condensation polymerization between an alcohol component and a carboxylic acid component that contains fumaric acid-modified rosin, and wherein the content of low molecular weight components having a molecular weight of 500 or less is 12% by mass or less in the polyester resin.

10. The image forming method according to claim 9, wherein the alcohol component is alkylene oxide adducts of bisphenol A expressed by the structural formula (I)

Structural Formula (I)

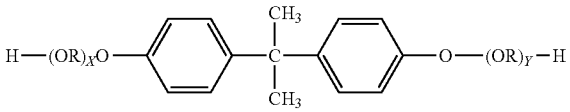

where OR represents an alkylene oxide, R represents an alkylene group of 2 or 3 carbon atoms, X, and Y are each a positive number that represents an average mole number of added alkylene oxide, and the sum of X and Y is 1 to 16.

11. The image forming method according to claim 9, wherein the content of the alkylene oxide adducts of bisphenol A expressed by the Structural Formal (I) is no less than 30% by mole in the alcohol component.

12. The image forming method according to claim 9, wherein the content of the fumaric acid-modified rosin is 5% by mass to 85% by mass in the carboxylic acid component.

13. The image forming method according to claim 9, wherein the fumaric acid-modified rosin is prepared by modifying a purified rosin with fumaric acid.

14. The image forming method according to claim 9, wherein the condensation polymerization is carried out in the presence of a titanium compound and/or a tin (II) compound having no Sn—C bond.

* * * * *